US011031697B2

(12) United States Patent
Pance et al.

(10) Patent No.: US 11,031,697 B2
(45) Date of Patent: Jun. 8, 2021

(54) ELECTROMAGNETIC DEVICE

(71) Applicant: Rogers Corporation, Chandler, AZ (US)

(72) Inventors: Kristi Pance, Auburndale, MA (US); Gianni Taraschi, Arlington, MA (US); Roshin Rose George, Burlington, MA (US); Sergio Clavijo, Phoenix, AZ (US); Shailesh Pandey, Woburn, MA (US); Karl E. Sprentall, Medford, MA (US); Trevor Polidore, Scottsdale, AZ (US); Stephen O'Connor, West Roxbury, MA (US); Jared DuPerre, South Portland, ME (US)

(73) Assignee: ROGERS CORPORATION, Chandler, AZ (US)

( * ) Notice: Subject to any disclaimer, the term of this patent is extended or adjusted under 35 U.S.C. 154(b) by 0 days.

(21) Appl. No.: 16/680,610

(22) Filed: Nov. 12, 2019

(65) Prior Publication Data

US 2020/0176876 A1 Jun. 4, 2020

Related U.S. Application Data

(60) Provisional application No. 62/772,884, filed on Nov. 29, 2018.

(51) Int. Cl.
*H01Q 9/04* (2006.01)
*H01Q 5/364* (2015.01)
(Continued)

(52) U.S. Cl.
CPC ..... *H01Q 9/0485* (2013.01); *H01Q 1/36* (2013.01); *H01Q 1/422* (2013.01); *H01Q 3/24* (2013.01);
(Continued)

(58) Field of Classification Search
CPC .. H01Q 9/0485; H01Q 9/0495; H01Q 9/0492; H01Q 5/364; H01Q 5/50;
(Continued)

(56) References Cited

U.S. PATENT DOCUMENTS 2,624,002 A 10/1952 Bouix
3,321,765 A 5/1967 Peters et al.
(Continued)

FOREIGN PATENT DOCUMENTS

EP 0468413 A2 1/1992
EP 0587247 A1 3/1994
(Continued)

OTHER PUBLICATIONS

Buerkle, A. et al; "Fabrication of a DRA Array Using Ceramic Stereolithography"; IEEE Antennas and Wireless Popagation Letters; IEEE; vol. 5 No. 1, Jan. 2007; pp. 479-481.
(Continued)

*Primary Examiner* — Lam T Mai
(74) *Attorney, Agent, or Firm* — Cantor Colburn LLP

(57) ABSTRACT

An electromagnetic, EM, device includes: a 3D body made from a dielectric material having a proximal end and a distal end; the 3D body having a first region toward the center of the 3D body made from a dielectric material having a first average dielectric constant, the first region extending at least partially to the distal end of the 3D body; and the 3D body having a second region outboard of the first region made from a dielectric material other than air having a second average dielectric constant that is greater than the first average dielectric constant, the second region extending from the proximal end to the distal end of the 3D body.

34 Claims, 29 Drawing Sheets

(51) Int. Cl.

| | |
|---|---|
| ***H01Q 5/50*** | (2015.01) |
| ***H01Q 1/36*** | (2006.01) |
| ***H01Q 1/42*** | (2006.01) |
| ***H01Q 3/24*** | (2006.01) |
| ***H01Q 21/06*** | (2006.01) |

(52) U.S. Cl.
CPC ..... *H01Q 5/364* (2015.01); *H01Q 5/50* (2015.01); *H01Q 21/061* (2013.01)

(58) Field of Classification Search
CPC H01Q 1/36; H01Q 1/422; H01Q 3/24; H01Q 3/26; H01Q 21/0006; H01Q 21/061; H01Q 15/14
USPC ..... 343/785
See application file for complete search history.

(56) References Cited

U.S. PATENT DOCUMENTS 4,366,484 A 12/1982 Weiss et al.
4,743,915 A 5/1988 Rammos et al.
5,227,749 A 7/1993 Raguenet et al.
5,453,754 A 9/1995 Fray
5,589,842 A 12/1996 Wang et al.
5,667,796 A 9/1997 Otten
5,854,608 A 12/1998 Leisten
5,940,036 A 8/1999 Oliver et al.
5,952,972 A 9/1999 Ittipiboon et al.
6,031,433 A 2/2000 Tanizaki et al.
6,052,087 A 4/2000 Ishikawa et al.
6,061,026 A 5/2000 Ochi et al.
6,061,031 A 5/2000 Cosenza et al.
6,075,485 A 6/2000 Lilly et al.
6,147,647 A 11/2000 Tassoudji et al.
6,181,297 B1 1/2001 Leisten
6,188,360 B1 2/2001 Kato et al.
6,198,450 B1 3/2001 Adachi et al.
6,268,833 B1 7/2001 Tanizaki et al.
6,292,141 B1 9/2001 Lim
6,314,276 B1 11/2001 Hilgers et al.
6,317,095 B1 11/2001 Teshirogi et al.
6,323,808 B1 11/2001 Heinrichs et al.
6,323,824 B1 11/2001 Heinrichs et al.
6,344,833 B1 2/2002 Lin et al.
6,373,441 B1 4/2002 Porath et al.
6,437,747 B1 8/2002 Stoiljkovic et al.
6,476,774 B1 11/2002 Davidson et al.
6,528,145 B1 3/2003 Berger et al.
6,552,687 B1 4/2003 Rawnick et al.
6,556,169 B1 4/2003 Fukuura et al.
6,621,381 B1 9/2003 Kundu et al.
6,743,744 B1 6/2004 Kim et al.
6,794,324 B1 9/2004 Kim et al.
6,816,118 B2 11/2004 Kingsley et al.
6,816,128 B1 11/2004 Jennings
7,161,535 B2 1/2007 Palmer et al.
7,179,844 B2 2/2007 Aki et al.
7,183,975 B2 2/2007 Thomas et al.
7,196,663 B2 3/2007 Bozer et al.
7,253,789 B2 8/2007 Kingsley et al.
7,292,204 B1 11/2007 Chang et al.
7,310,031 B2 12/2007 Pance et al.
7,379,030 B1 5/2008 Lier
7,382,322 B1 6/2008 Yang et al.
7,405,698 B2 7/2008 De Rochemont
7,443,363 B2 10/2008 Ying
7,498,969 B1 3/2009 Paulsen et al.
7,545,327 B2 6/2009 Iellici et al.
7,570,219 B1 8/2009 Paulsen et al.
7,595,765 B1 9/2009 Hirsch et al.
7,636,063 B2 12/2009 Channabasappa
7,663,553 B2 2/2010 Chang et al.
7,710,325 B2 5/2010 Cheng
7,876,283 B2 1/2011 Bouche et al.
7,961,148 B2 6/2011 Goldberger
8,098,197 B1 1/2012 Herting et al.
8,497,804 B2 7/2013 Haubrich et al.
8,498,539 B1 7/2013 Iichenko et al.
8,736,502 B1 5/2014 Langfield et al.
8,773,319 B1 7/2014 Anderson et al.
8,902,115 B1 12/2014 Loui et al.
9,112,273 B2 8/2015 Christie et al.
9,184,697 B2 11/2015 Sekiguchi et al.
9,225,070 B1 12/2015 Zeweri et al.
9,455,488 B2 9/2016 Chirila
9,608,330 B2 3/2017 Singleton et al.
9,825,373 B1 11/2017 Smith
9,917,044 B2 3/2018 Zhou et al.
10,355,361 B2 7/2019 Pance et al.
10,476,164 B2 11/2019 Pance et al.
10,522,917 B2 12/2019 Pance et al.
10,587,039 B2 3/2020 Pance et al.
10,601,137 B2 3/2020 Pance et al.
2001/0013842 A1 8/2001 Ishikawa et al.
2001/0043158 A1 11/2001 Adachi et al.
2002/0000947 A1 1/2002 Al-Rawi et al.
2002/0057138 A1 5/2002 Takagi et al.
2002/0180646 A1 12/2002 Kivekas et al.
2002/0196190 A1 12/2002 Lim
2003/0016176 A1 1/2003 Kingsley et al.
2003/0034922 A1 2/2003 Isaacs et al.
2003/0043075 A1 3/2003 Bit-Babik et al.
2003/0122729 A1 7/2003 Diaz et al.
2003/0151548 A1 8/2003 Kingsley et al.
2003/0181312 A1 9/2003 Mailadil et al.
2004/0029709 A1 2/2004 Oba et al.
2004/0036148 A1 2/2004 Block et al.
2004/0051602 A1 3/2004 Pance et al.
2004/0080455 A1 4/2004 Lee
2004/0113843 A1 6/2004 Le Bolzer et al.
2004/0119646 A1 6/2004 Ohno et al.
2004/0127248 A1 7/2004 Lin et al.
2004/0130489 A1 7/2004 Le Bolzer et al.
2004/0155817 A1 8/2004 Kingsley et al.
2004/0233107 A1 11/2004 Popov et al.
2004/0257176 A1 12/2004 Pance et al.
2004/0263422 A1 12/2004 Lynch
2005/0017903 A1 1/2005 Ittipiboon et al.
2005/0024271 A1 2/2005 Ying et al.
2005/0057402 A1 3/2005 Ohno et al.
2005/0099348 A1 5/2005 Pendry
2005/0122273 A1 6/2005 Legay et al.
2005/0162316 A1 7/2005 Thomas et al.
2005/0179598 A1 8/2005 Legay et al.
2005/0200531 A1 9/2005 Huang et al.
2005/0219130 A1 10/2005 Koch et al.
2005/0225499 A1 10/2005 Kingsley et al.
2005/0242996 A1 11/2005 Palmer et al.
2005/0264449 A1 12/2005 Strickland
2005/0264451 A1 12/2005 Aikawa et al.
2006/0022875 A1 2/2006 Pidwerbetsky et al.
2006/0119518 A1 6/2006 Ohmi et al.
2006/0145705 A1 7/2006 Raja
2006/0194690 A1 8/2006 Osuzu
2006/0232474 A1 10/2006 Fox
2006/0293651 A1 12/2006 Cronin
2007/0152884 A1 7/2007 Bouche et al.
2007/0164420 A1 7/2007 Chen et al.
2007/0252778 A1 11/2007 Ide et al.
2008/0036675 A1 2/2008 Fujieda
2008/0042903 A1 2/2008 Cheng
2008/0048915 A1 2/2008 Chang et al.
2008/0094309 A1 4/2008 Pance et al.
2008/0122703 A1 5/2008 Ying
2008/0129616 A1* 6/2008 Li ..... H01Q 9/0485 343/713
2008/0129617 A1 6/2008 Li et al.
2008/0260323 A1 10/2008 Jalali et al.
2008/0272963 A1 11/2008 Chang et al.
2008/0278378 A1 11/2008 Chang et al.
2009/0040131 A1 2/2009 Mosallaei
2009/0073332 A1 3/2009 Irie
2009/0102739 A1 4/2009 Chang et al.

(56) References Cited

U.S. PATENT DOCUMENTS

2009/0128262 A1* 5/2009 Lee ..... H01Q 9/0485 333/219.1
2009/0128434 A1 5/2009 Chang et al.
2009/0140944 A1 6/2009 Chang et al.
2009/0153403 A1 6/2009 Chang et al.
2009/0179810 A1 7/2009 Kato et al.
2009/0184875 A1 7/2009 Chang et al.
2009/0206957 A1 8/2009 Hiroshima et al.
2009/0262022 A1 10/2009 Ying
2009/0270244 A1 10/2009 Chen et al.
2009/0305652 A1 12/2009 Boffa et al.
2010/0051340 A1 3/2010 Yang et al.
2010/0103052 A1 4/2010 Ying
2010/0156754 A1 6/2010 Kondou
2010/0220024 A1 9/2010 Snow et al.
2011/0012807 A1 1/2011 Sorvala
2011/0050367 A1 3/2011 Yen et al.
2011/0121258 A1 5/2011 Hanein et al.
2011/0122036 A1 5/2011 Leung et al.
2011/0133991 A1 6/2011 Lee et al.
2011/0248890 A1 10/2011 Lee et al.
2012/0092219 A1 4/2012 Kim
2012/0212386 A1 8/2012 Massie et al.
2012/0242553 A1 9/2012 Leung et al.
2012/0245016 A1 9/2012 Curry et al.
2012/0256796 A1 10/2012 Leiba
2012/0274523 A1 11/2012 Ayatollahi
2012/0276311 A1 11/2012 Chirila
2012/0287008 A1 11/2012 Kim
2012/0306713 A1 12/2012 Raj et al.
2012/0329635 A1 12/2012 Hill
2013/0076570 A1 3/2013 Lee et al.
2013/0088396 A1 4/2013 Han
2013/0113674 A1 5/2013 Ryu
2013/0120193 A1 5/2013 Hoppe et al.
2013/0234898 A1 9/2013 Leung et al.
2013/0278610 A1 10/2013 Stephanou et al.
2014/0043189 A1 2/2014 Lee et al.
2014/0327591 A1 11/2014 Kokkinos
2014/0327597 A1 11/2014 Rashidian et al.
2015/0035714 A1 2/2015 Zhou
2015/0077198 A1 3/2015 Yatabe
2015/0138036 A1 4/2015 Harper
2015/0207233 A1 7/2015 Kim et al.
2015/0207234 A1 7/2015 Ganchrow et al.
2015/0236428 A1 8/2015 Caratelli et al.
2015/0244082 A1 8/2015 Caratelli et al.
2015/0303546 A1 10/2015 Rashidian et al.
2015/0314526 A1 11/2015 Cohen
2015/0346334 A1 12/2015 Nagaishi et al.
2015/0380824 A1 12/2015 Tayfeh Aligodarz et al.
2016/0111769 A1 4/2016 Pance et al.
2016/0218437 A1 7/2016 Guntupalli et al.
2016/0294066 A1 10/2016 Djerafi et al.
2016/0294068 A1 10/2016 Djerafi et al.
2016/0322708 A1 11/2016 Tayfeh Aligodarz et al.
2016/0351996 A1 12/2016 Ou
2016/0372955 A1 12/2016 Fackelmeier et al.
2017/0018851 A1 1/2017 Henry et al.
2017/0040700 A1 2/2017 Leung et al.
2017/0125901 A1 5/2017 Sharawi et al.
2017/0125908 A1 5/2017 Pance et al.
2017/0125909 A1 5/2017 Pance et al.
2017/0125910 A1 5/2017 Pance et al.
2017/0179569 A1 6/2017 Kim et al.
2017/0188874 A1 7/2017 Suhami
2017/0256847 A1 9/2017 Vollmer et al.
2017/0271772 A1 9/2017 Miraftab et al.
2017/0272149 A1 9/2017 Michaels
2018/0054234 A1* 2/2018 Stuckman ..... H01P 3/12
2018/0069594 A1* 3/2018 Henry ..... H01P 3/12
2018/0115072 A1 4/2018 Pance et al.
2018/0309202 A1 10/2018 Pance et al.
2018/0323514 A1* 11/2018 Pance ..... H01Q 19/18
2019/0020105 A1 1/2019 Pance et al.
2019/0214732 A1 7/2019 Leung et al.
2019/0221926 A1* 7/2019 Pance ..... H01Q 1/36
2019/0221939 A1* 7/2019 George ..... H01Q 19/18
2019/0221940 A1* 7/2019 Pance ..... H01Q 9/0485
2019/0319357 A1 10/2019 Pance et al.
2019/0319358 A1 10/2019 Pance et al.
2019/0379123 A1 12/2019 Leung et al.
2019/0393607 A1 12/2019 Pance et al.
2020/0083602 A1 3/2020 Sethumadhavan et al.
2020/0083609 A1 3/2020 Pance et al.
2020/0099136 A1 3/2020 Pance et al.
2020/0194881 A1 6/2020 Pance et al.

FOREIGN PATENT DOCUMENTS

EP 0801436 A2 10/1997
EP 1783516 A1 5/2007
EP 2905632 A1 8/2015
JP 2004112131 A 4/2004
WO 2017075184 A1 5/2017

OTHER PUBLICATIONS

Guo, Yomg-Xin, et al.,; "Wide-Band Stacked Double Annular-Ring Dielectric Resonator Antenna at the End-Fire Mode Dperation"; IEEE Transacions on Antennas and Propagation; vol. 53; No. 10; Oct. 2005; 3394-3397 pages.

Kakade, A.B., et al; "Analysis of the Rectangular Waveguide Slot Coupled Multilayer hemispherical Dielectric Resonator Antenna"; IET Microwaves, Antennas & Propagation, The Institution of Engineering and Technology; vol. 6;. No. 3; Jul. 11, 2011; 338-347 pages.

Kakade, Anandrao, et al.; Mode Excitation in the Coaxial Probe Coupled Three-Layer Hemispherical Dielectric Resonator Antenna; IEEE Transactions on Antennas and Propagation; vol. 59; No. 12; Dec. 2011; 7 pages.

Kishk, A. Ahmed, et al.,; "Analysis of Dielectric-Resonator with Emphasis on Hemispherical Structures"; IEEE Antennas & Propagation Magazine; vol. 36; No. 2; Apr. 1994; 20-31 pages.

Petosa, Aldo, et al.; "Dielectric Resonator Antennas: A Historical Review and the Current State of the Art"; IEEE Antennas and Propagation Magazine; vol. 52, No. 5, Oct. 2010; 91-116 pages.

Ruan, Yu-Feng, et al; "Antenna Effects Consideration for Space-Time Coding UWB-Impulse Radio System in IEEE 802.15 Multipath Channel"; Wireless Communications, Networking and Mobile Computing; 2006; 1-4 pages.

Wong, Kin-Lu, et al.,; "Analysis of a Hemispherical Dielectric Resonator Antenna with an Airgap"; IEEE Microwave and Guided Wave Letters; vol. 3; No. 9; Oct. 3, 1993; 355-357 pages.

Zainud-Deen, S H et al; "Dielectric Resonator Antenna Phased Array for Fixed RFID Reader in Near Field Region"; IEEE; Mar. 6, 2012; pp. 102-107.

Notification of Transmittal of the International Search Report for International Application No. PCT/US2019/061079, which is related to U.S. Appl. No. 16/680,610; Report dated Mar. 18, 2020; Report Received Date: Jul. 1, 2020; 8 pages.

Written Opinion of the International Searching Authority for International Application No. PCT/US2019/061079, which is related to U.S. Appl. No. 16/680,610; Report dated Mar. 18, 2020; Report Received Date: Jul. 1, 2020; 14 pages.

Raghvendra Kumar Chaudhary et al; Variation of Permittivity in Radial Direction in Concentric Half-Split Cylindrical Dielectric Resonator Antenna for Wideband Application: Permittivity Variation in R-Dir. In CDRA; International Journal of RF and Microwave Computer-Aided Engineering; vol. 25; No. 4; May 1, 2015; pp. 321-329.

Zhang Shiyu et al.; "3D-Printed Graded Index Lens for RF Applications"; 2016 International Symposium on Antennas and Propagation (ISAP), IEICE; Oct. 24, 2016; pp. 90-91.

International Preliminary Report on Patentability for International Application No. PCT/US2019/061079, which is related to U.S.

(56) References Cited

OTHER PUBLICATIONS

Appl. No. 16/680,610; Report dated Sep. 29, 2020; Report Received Date: Nov. 2, 2020; 17 pages.

* cited by examiner

ELECTROMAGNETIC DEVICE

CROSS REFERENCE TO RELATED APPLICATIONS

This application claims the benefit of U.S. Provisional Application Ser. No. 62/772,884, filed 29 Nov. 2018, which is incorporated herein by reference in its entirety.

BACKGROUND OF THE INVENTION

The present disclosure relates generally to an electromagnetic, EM, device, and particularly to an electromagnetic device having a three-dimensional, 3D, body made from a dielectric material that is so configured to have an EM radiation pattern in the far field with a wide field of view, FOV.

An example EM device having a 3D body made from a dielectric material is disclosed in WO 2017/075177 A1, assigned to Applicant.

While existing EM devices configured to radiate an EM radiation pattern in the far field may be suitable for their intended purpose, the art relating EM devices would be advanced with an EM device having a 3D body made from a dielectric material that is capable of producing an EM radiation pattern in the far field with a wide FOV.

BRIEF DESCRIPTION OF THE INVENTION

In an embodiment, an EM device includes: a 3D body made from a dielectric material having a proximal end and a distal end; the 3D body having a first region toward the center of the 3D body made from a dielectric material having a first average dielectric constant, the first region extending at least partially to the distal end of the 3D body; and the 3D body having a second region outboard of the first region made from a dielectric material other than air having a second average dielectric constant that is greater than the first average dielectric constant, the second region extending from the proximal end to the distal end of the 3D body.

In another embodiment, an EM device includes: a 3D body made from a dielectric material having a proximal end and a distal end; the 3D body having a first portion made from a dielectric material other than air having a first average dielectric constant, the first portion extending from the proximal end and only partially toward the distal end of the 3D body, the first portion forming an inner portion of the 3D body; the 3D body having a second portion made from a dielectric material other than air having a second average dielectric constant that is less than the first average dielectric constant, the second portion extending from the proximal end to the distal end of the 3D body, the second portion forming an outer portion of the 3D body that envelopes the inner portion; the first portion having a first inner region having a third average dielectric constant that is less than the first average dielectric constant; and the second portion having a second inner region having a fourth average dielectric constant that is less than the second average dielectric constant, the second inner region being an extension of the first inner region.

In another embodiment, an EM device includes: a 3D body made from a dielectric material having a proximal end and a distal end; the 3D body having a first region made from a dielectric material having a first average dielectric constant, the first region extending from the distal end and only partially toward the proximal end of the 3D body; and the 3D body having a second region outboard of and subordinate to the first region made from a dielectric material other than air having a second average dielectric constant that is greater than the first average dielectric constant, the second region extending from the proximal end to the distal end of the 3D body.

In another embodiment, an EM device includes: a three dimensional, 3D, body made from a dielectric material having a proximal end and a distal end; the 3D body having a first region toward the center of the 3D body made from a dielectric material having a first average dielectric constant, the first region extending at least partially to the distal end of the 3D body from a first base structure proximate the proximal end of the 3D body; the 3D body having a second region outboard of the first region made from a dielectric material other than air having a second average dielectric constant that is greater than the first average dielectric constant, the second region extending at least partially to the distal end of the 3D body from the proximal end of the 3D body; the 3D body having a third region outboard of the second region made from a dielectric material having a third average dielectric constant that is less than the second average dielectric constant, the third region extending to the distal end of the 3D body from a second base structure proximate the proximal end of the 3D body; and the 3D body having a fourth region outboard of the third region made from a dielectric material having a fourth average dielectric constant that is greater than the third average dielectric constant, the fourth region extending to the distal end of the 3D body from the proximal end of the 3D body.

In another embodiment, an EM device includes: a three dimensional, 3D, body made from a dielectric material having a proximal end and a distal end; the 3D body having a first region toward the center of the 3D body made from a dielectric material having a first average dielectric constant, the first region extending at least partially to the distal end of the 3D body from a first base structure proximate the proximal end of the 3D body; the 3D body having a second region outboard of the first region made from a dielectric material other than air having a second average dielectric constant that is greater than the first average dielectric constant, the second region extending at least partially to the distal end of the 3D body from the proximal end of the 3D body; the 3D body having a third region outboard of the second region made from a dielectric material having a third average dielectric constant that is less than the second average dielectric constant, the third region extending to the distal end of the 3D body from a second base structure proximate the proximal end of the 3D body; the 3D body having a fourth region outboard of the third region made from a dielectric material having a fourth average dielectric constant that is greater than the third average dielectric constant, the fourth region extending to the distal end of the 3D body from the proximal end of the 3D body; wherein the second base structure includes a relatively thin connecting structure, disposed at the proximal end of the 3D body, that is integrally formed with and bridges between the second region and the fourth region, such that the second region, the fourth region, and the relatively thin connecting structure, are integrally formed with each other to form a monolithic, the relatively thin connecting structure having an overall height, H5, that is less than 30% of an overall height, H6, of the 3D body; and wherein the second base structure in the third region is absent dielectric material of the monolithic except for the relatively thin connecting structure.

In another embodiment, an EM device includes: a base substrate having a first plurality of vias; a three dimensional, 3D, body made from a dielectric material comprised of a medium other than air, the 3D body having a proximal end and a distal end, the proximal end of the 3D body being disposed on the base substrate so that the 3D body at least partially or completely covers the first plurality of vias; wherein the first plurality of vias are at least partially filled with the dielectric material of the 3D body, such that the 3D body and the dielectric material of the first plurality of vias form a monolithic.

In another embodiment, an antenna subsystem for a steerable array of EM devices includes: a plurality of the EM devices, each EM device of the plurality of EM devices having a wide FOV dielectric resonator antenna, DRA, arranged on a surface; a subsystem board having for each EM device of the plurality of EM devices a signal feed structure; the plurality of EM devices being affixed to the subsystem board.

In another embodiment, an antenna subsystem for a steerable array of EM devices includes: a plurality of the EM devices, each EM device of the plurality of EM devices having a wide FOV dielectric resonator antenna, DRA, arranged on a surface, each EM device of the plurality of EM devices further having a base substrate, each base substrate having a signal feed structure disposed in EM signal communication with a corresponding DRA; wherein the base substrate of each EM device is a contiguous extension of a neighboring base substrate to form an aggregate base substrate, the DRAs being affixed to the aggregate base substrate; wherein the aggregate base substrate includes a plurality of input ports equal in number to the number of DRAs, each input port being electrically connected to a corresponding signal feed structure that is in signal communication with a corresponding DRA; the antenna subsystem providing a structure suitable for an arrangement of the EM devices to any arrangement size formable from multiple ones of the antenna subsystem.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike, or wherein similar elements are numbered similarly but with a differing leading numeral, in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the appended claims. Accordingly, the following example embodiments are set forth without any loss of generality to, and without imposing limitations upon, the claimed invention disclosed herein.

As used herein, an orthogonal set of x-y-z axes are provided in the various figures for describing plan views (a view in the plane of the x-y axis) and elevation views (a view in the plane of either the x-z axis or the y-z axis) of embodiments of the invention.

An embodiment, as shown and described by the various figures and accompanying text, provides an EM device and an array of EM devices having a DRA configured and structured to provide an EM radiation pattern in the far field with a wide FOV. In an embodiment, the DRA is configured having a central region with a lower average dielectric constant, Dk, than a surrounding outer region of the DRA, where the lower average Dk central region extends at least partially to the distal end of the DRA. In an embodiment, the array of EM devices is configured as an antenna subsystem for providing a steerable array of EM devices, which is steerable by an EM beam steering subsystem. While embodiments illustrated and described herein depict DRAs having a particular cross-section profile (x-y, x-z, or y-z), it will be appreciated that such profiles may be modified without departing from a scope of the invention. As such, any profile that falls within the ambit of the disclosure herein, and is suitable for a purpose disclosed herein, is contemplated and considered to be complementary to the embodiments disclosed herein.

Figure 1A:
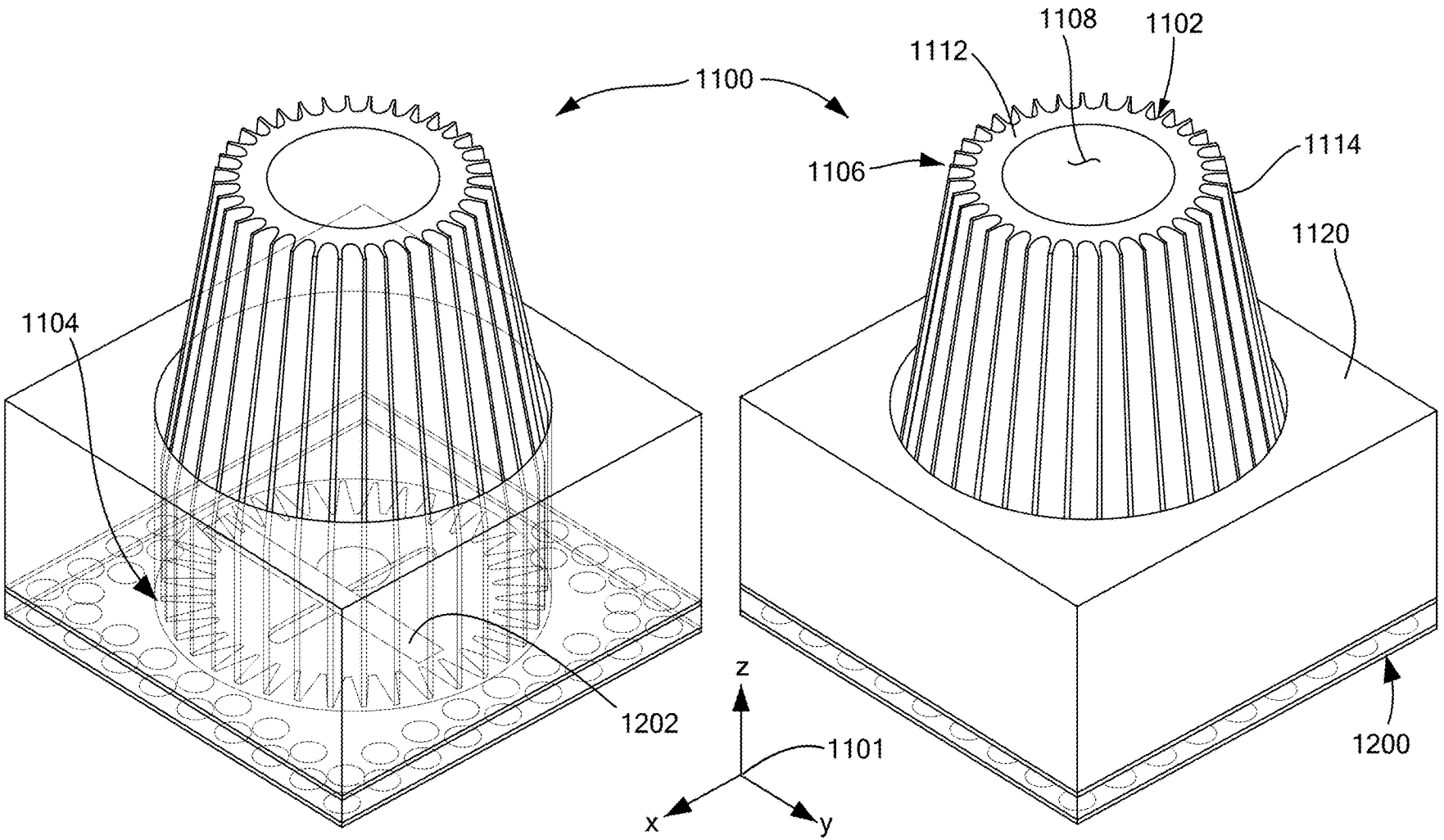
FIG. 1A depicts corresponding transparent and solid rotated isometric views of an EM device, in accordance with an embodiment.
Figure 1B:
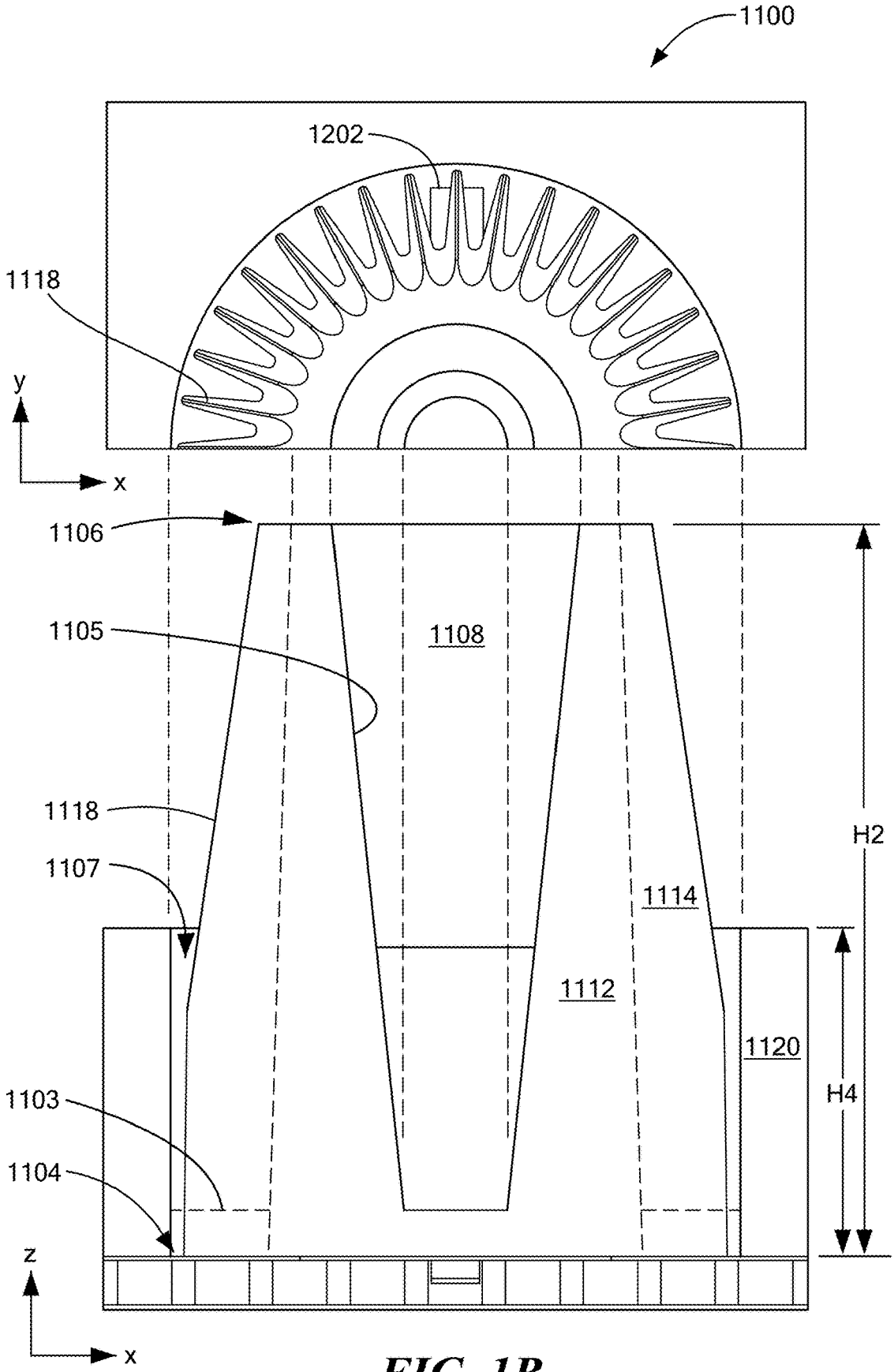
FIG. 1B depicts a partial plan view and a corresponding elevation view of the EM device of FIG. 1A, in accordance with an embodiment.
Figure 1C:
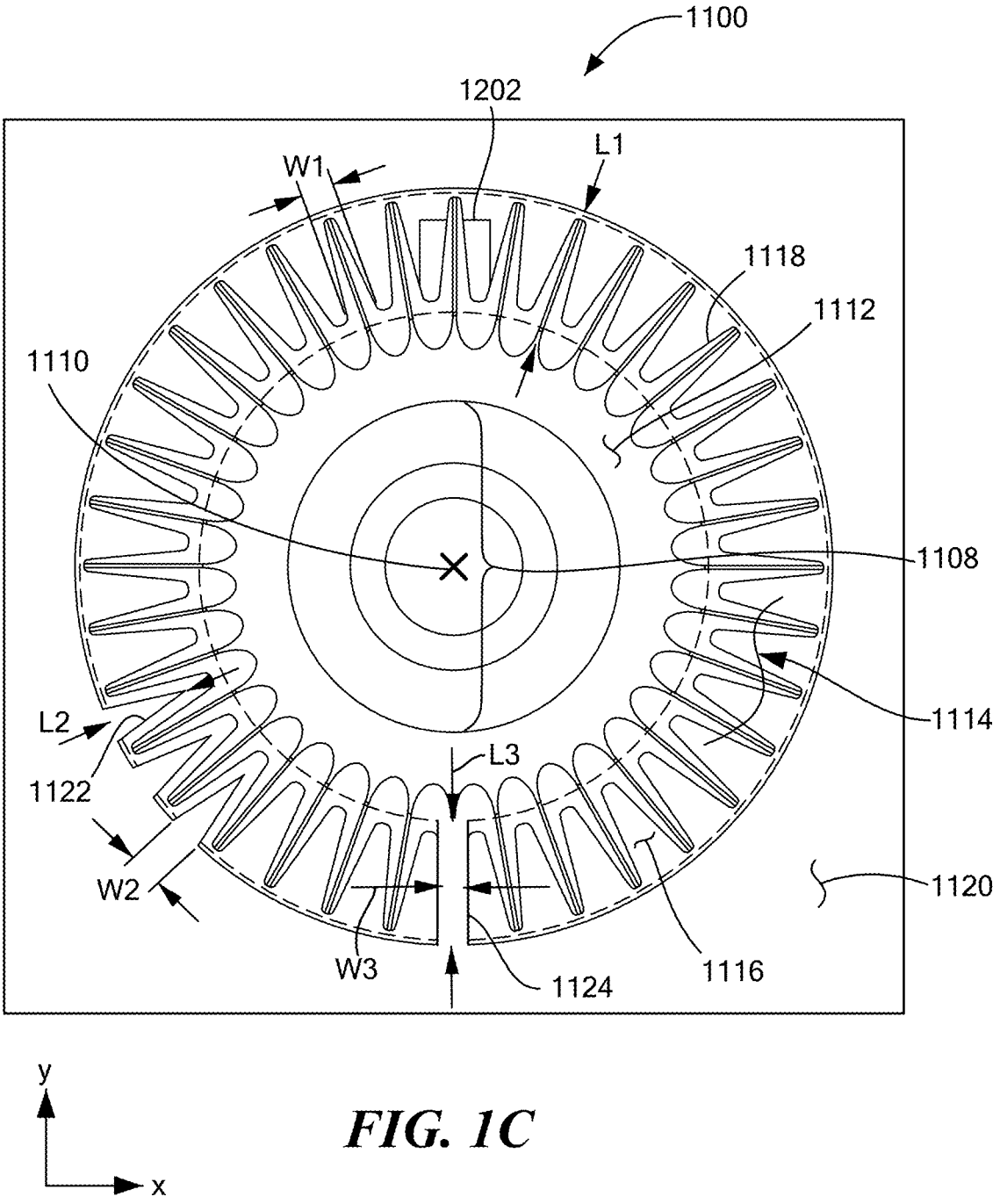
FIG. 1C depicts a plan view of the EM device of FIGS. 1A and 1B, in accordance with an embodiment.

The following description of an example EM device 1100 is made with particular reference to FIGS. 1A, 1B, and 1C, collectively. The orthogonal set of x-y-z axes 1101 depicted in FIGS. 1A, 1B and 1C are for illustration purposes, and establish the three dimensional, 3D, arrangement of the various features of the EM device 1100 relative to each other.

In an embodiment, the example EM device 1100 includes: a 3D body 1102 made from a dielectric material having a proximal end 1104 and a distal end 1106; the 3D body 1102 having a first region 1108 disposed toward the center 1110 (see FIG. 1C) of the 3D body 1102, as observed in a plan view of the EM device 1100, made from a dielectric material having a first average dielectric constant (Dk1-1100), the first region 1108 extending at least partially to the distal end 1106 of the 3D body 1102, and in an embodiment extending completely to the distal end 1106 of the 3D body 1102; and, the 3D body 1102 having a second region 1112 disposed radially outboard of the first region 1108, as observed in a plan view of the EM device 1100, made from a dielectric material comprising a dielectric medium other than air, which may also comprise air such as a dielectric foam, having a second average dielectric constant (Dk2-1100) that is greater than the first average dielectric constant, the second region 1112 extending from the proximal end 1104 to the distal end 1106 of the 3D body 1102, as observed in an elevation view of the EM device 1100 (see FIG. 1B for example). Axes 1101 (depicted in FIGS. 1B and 1C) may be translated such that the z-axis aligns with the center 1110 of the 3D body 1102, and the x-y plane is coincident with the proximal end 1104 of the 3D body 1102 (see FIGS. 1B and 1C) to establish a local coordinate system of the EM device 1100. As used herein below, reference to the x-y-z coordinate system 1101 is reference to the aforementioned translated coordinate system that establishes the local coordinate system of the EM device 1100.

In an embodiment, the first region 1108 is centrally disposed within the 3D body 1102 relative to the z-axis of axes 1101. In an embodiment, the first region 1108 comprises air, which may be composed entirely of air, or may be composed of air and another dielectric medium other than air. In an embodiment, the first region 1108 comprises a dielectric medium in the form of a foam. In an embodiment the Dk1-1100 of the first region 1108 has a relatively low dielectric constant that is equal to or greater than 1 (including air) and equal to or less than 8, or more particularly equal to or greater than 1 and equal to or less than 5. In an embodiment, the first region 1108 is a depression in the 3D body 1102, relative to the second region 1112, that extends from the distal end 1106 toward the proximal end 1104. In an embodiment, the depression of the first region 1108 may be formed by removal of material of the second region 1112, by use of a removable insert during the forming of the second region 1112, or by any other means suitable for a purpose disclosed herein. In an embodiment, the depression extends anywhere between about 30% and about 100% of the distance from the distal end 1106 to the proximal end 1104 of the 3D body 1102. As noted herein above, the Dk1-1100 of the depression of the first region 1108 is a relatively lower dielectric constant than that of the Dk2-1100 of the second region 1112.

In an embodiment, the 3D body 1102 further includes a third region 1114 disposed radially outboard of the second region 1112, as observed in the plan view of the EM device 1100, made from a dielectric material having a third average dielectric constant (Dk3-1100) that is less than the second average dielectric constant, the third region 1114 extending from the proximal end 1104 to the distal end 1106 of the 3D body 1102, as observed in the elevation view of the EM device 1100. In an embodiment, the third region 1114 includes a combination of; a dielectric material (see projections 1118 described herein below for example) having the second average dielectric constant, and another dielectric material 1116 that is different from the dielectric material having the second average dielectric constant. In an embodiment, the other dielectric material 1116 of the third region 1114 comprises air, which may be composed entirely of air, or may be composed of air and another dielectric medium other than air. In an embodiment, the other dielectric material 1116 of the third region 1114 comprises a dielectric medium in the form of a foam. In an embodiment, the combination of dielectric materials of the third region 1114 form a dielectric region having a relatively lower dielectric constant than that of the second region 1112. In an embodiment, the third region 1114 includes projections 1118 that extend radially outward, relative to the z-axis of axes 1101, from and are integral and monolithic with the second region 1112. In an embodiment, as observed in the plan view of the EM device 1100 and as also observed in an x-y plane cross-section, each one of the projections 1118 has a cross-section overall length, L1, and a cross-section overall width, W1, where L1 and W1 are each less than $\lambda$, where $\lambda$ is an operating wavelength of the EM device 1100 when the EM device 1100 is electromagnetically excited. In an embodiment, L1 and W1 are each less than $\lambda/4$. In an embodiment, each one of the projections 1118 has a cross-section shape, as observed in a plan view or an x-y plane cross-section, that is tapered radially outward from broad to narrow.

In an embodiment, the EM device 1100 further includes: a fourth region 1120 made from a dielectric material other than air having a fourth average dielectric constant (Dk4-1100); wherein the fourth region 1120, as observed in the plan view of the the EM device 1100, substantially surrounds the proximal end 1104 of the 3D body 1102 and wherein the fourth average dielectric constant is different from the third average dielectric constant. In an embodiment, the fourth region 1120 has a height H4 that is less than the height H2 of the second region 1112, relative to the proximal end 1104 of the 3D body 1102 and as observed in the elevation view of the EM device 1100. In an embodiment, the fourth region 1120, as observed in the plan view of the EM device 1100, substantially surrounds the third region 1114 at the proximal end 1104 of the 3D body 1102.

In an embodiment, the third region 1114 includes a combination of; a dielectric material having the fourth average dielectric constant (see projections 1122 described herein below for example), and another dielectric material having a dielectric constant that is different from the fourth dielectric constant. In an embodiment, the third region 1114 includes projections 1122 that extend outward from and are integral and monolithic with the fourth region 1120. As depicted in FIG. 1C, the projections 1122 extend outward and away from the fourth region 1120 and also extend radially inward toward the center 1110 of the 3D body 1102.

In an embodiment, as observed in the plan view of the EM device 1100, each one of the projections 1122 that are monolithic with the fourth region 1120 has a cross-section overall length, L2, and a cross-section overall width, W2, as also observed in an x-y plane cross-section, where L2 and W2 are each less than λ, where λ is an operating wavelength of the EM device 1100 when the EM device 1100 is electromagnetically excited. In an embodiment, L2 and W2 are each less than λ/4. In an embodiment, each one of the projections 1122 that are monolithic with the fourth region 1120 has a cross-section shape, as observed in a plan view or an x-y plane cross-section, that is tapered outwardly, relative to the fourth region 1120, from broad to narrow.

In an embodiment, the fourth region 1120 is integral and monolithic with the second region 1112 and the fourth average dielectric constant is equal to the second average dielectric constant, as observed by dashed lines 1103 in FIG. 1B.

In an embodiment, as observed in the plan view of the EM device 1100, the third region 1114 includes bridge sections 1124 that extend between the second and fourth regions 1112, 1120 across the third region 1114, the bridge sections 1124 being integral and monolithic with both the second and fourth regions 1112, 1120. In an embodiment, the bridge sections 1124 have height H4. In an embodiment, as observed in the plan view of the EM device 1100, each one of the bridge sections 1124 has a cross-section overall length, L3, and a cross-section overall width, W3, as also observed in an x-y plane cross-section, where L3 and W3 are each less than λ, where λ is an operating wavelength of the EM device 1100 when the EM device 1100 is electromagnetically excited. In an embodiment, L3 and W3 are each less than λ/4.

In an embodiment, the second region 1112 of the 3D body 1102 has a textured outer surface having texture features (denoted generally by reference numeral 1118) with overall dimensions in any direction that are less than λ, where λ is an operating wavelength of the EM device 1100 when the EM device 1100 is electromagnetically excited.

In an embodiment, at least a portion of all exposed internal surfaces of at least the second region 1112 of the 3D body 1102 draft inward from the proximal end 1104 to the distal end 1106 of the 3D body 1102, as depicted by tapered (draft) lines 1105 in FIG. 1B.

In an embodiment, the EM device 1100 further includes: a base substrate 1200 having a signal feed 1202 configured to electromagnetically excite the 3D body 1102 to radiate an EM field into the far field; wherein the proximal end 1104 of the 3D body 1102 is disposed on the base substrate 1200 relative to the signal feed 1202 such that the 3D body 1102 is centrally electromagnetically excited when a particular electrical signal is present on the signal feed 1202.

In an embodiment and as observed in a plan view of the EM device 1100, the dielectric material of the fourth region 1120 is a dielectric material that surrounds a cavity 1107 in which at least a portion of the dielectric materials of the first, second, and third regions 1108, 1112, 1114, are disposed. As noted herein above, the dielectric material of the fourth region 1120 has the Dk4-1100, which in an embodiment may be either a relatively high dielectric constant, such as greater than 8 for example, or a relatively low dielectric constant, such as greater than 1 and equal to or less than 8 for example, or more particularly greater than 1 and equal to or less than 5. In an embodiment, the Dk4-1100 is equal to or greater than 10 and equal to or less than 20.

As noted herein above, portions of the third region 1114, such as projections 1118, are integral and monolithic with the second region 1112, portions of the second region 1112 (see dashed lines 1103 for example) are integral an monolithic with the fourth region 1120, and/or portions of the third region 1114, such as the projections 1122, are integral and monolithic with the fourth region 1120. From the foregoing, it follows that an embodiment includes an EM device 1100 where at least portions of the second region 1112 and portions of the third region 1114 are integral an monolithic with the fourth region 1120, which in an embodiment has the Dk4-1100 that is equal to or greater than 8, or more particularly equal to or greater than 10, and equal to or less than 20.

Figure 2:
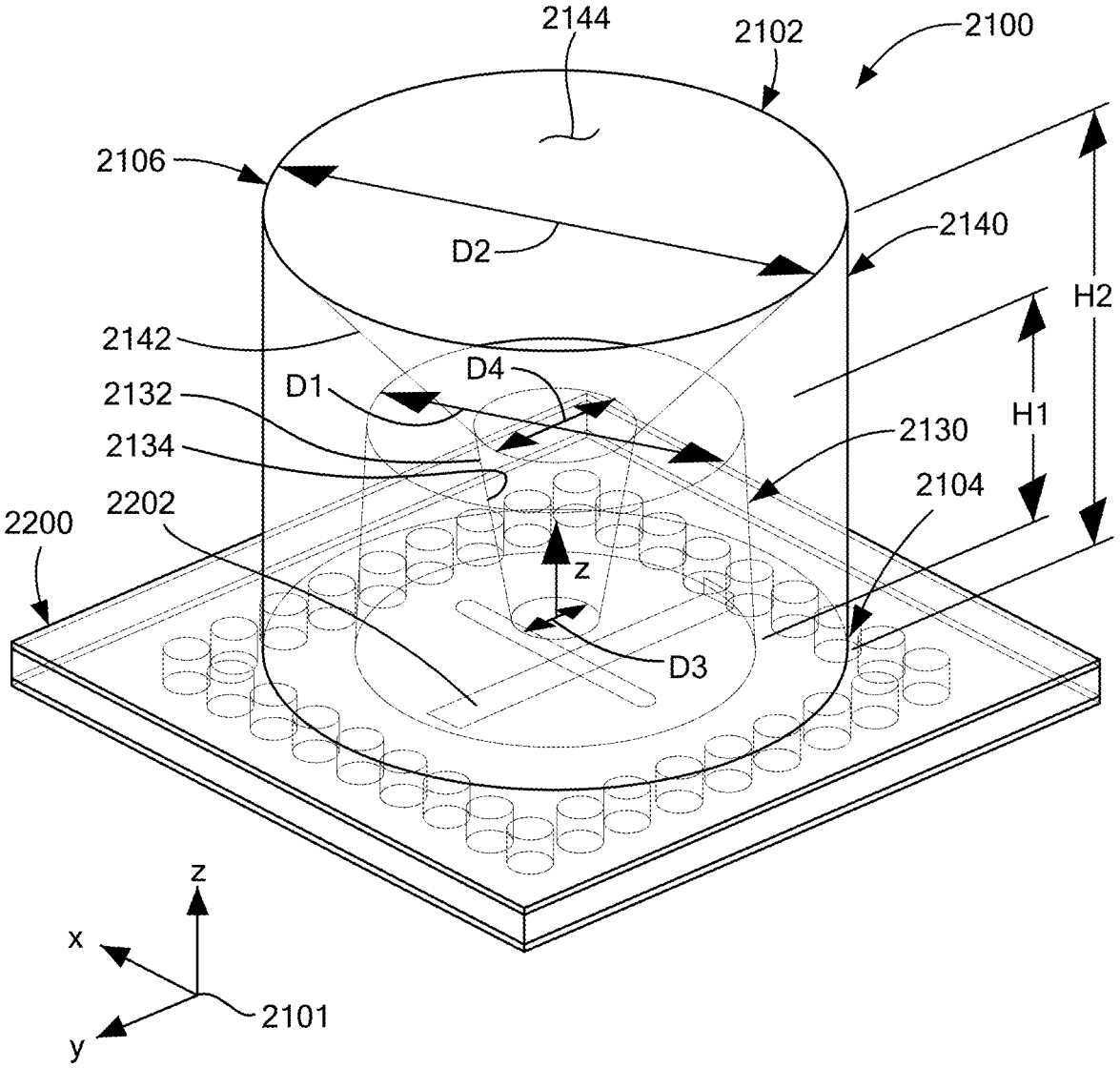
FIG. 2 depicts a transparent rotated isometric view of an EM device alternative to that of FIGS. 1A-1C, in accordance with an embodiment.

The following description of an example EM device 2100 is made with particular reference to FIG. 2. The orthogonal set of x-y-z axes 2101 depicted in FIG. 2 is for illustration purposes, and establishes the 3D arrangement of the various features of the EM device 2100 relative to each other.

In an embodiment, the example EM device 2100 includes: a 3D body 2102 made from a dielectric material having a proximal end 2104 and a distal end 2106; the 3D body 2102 having a first portion 2130 made from a dielectric material other than air having a first average dielectric constant (Dk1-2100), the first portion 2130 extending from the proximal end 2104 and only partially toward the distal end 2106 of the 3D body 2102, the first portion 2130 forming an inner portion of the 3D body 2102; the 3D body 2102 having a second portion 2140 made from a dielectric material other than air having a second average dielectric constant (Dk2-2100) that is less than the first average dielectric constant, the second portion extending from the proximal end 2104 to the distal end 2106 of the 3D body 2102, the second portion 2140 forming an outer portion of the 3D body 2102 that envelopes the inner portion 2130; the first portion 2130 having a first inner region 2132 having a third average dielectric constant (Dk3-2100) that is less than the first average dielectric constant; and the second portion 2140 having a second inner region 2142 having a fourth average dielectric constant (Dk4-2100) that is less than the second average dielectric constant. In an embodiment, the second inner region 2142 is a contiguous extension of the first inner region 2132.

In an embodiment, the 3D body 2102 is symmetrical about the z-axis, where the first portion 2130 is disposed radially inboard relative to an outer surface of the second portion 2140, the first inner region 2132 is disposed radially inboard relative to an outer surface of the first portion 2130, and the second inner region 2142 is disposed radially inboard relative to an outer surface of the second portion 2140.

In an embodiment, the first portion 2130 has a frustoconical surface 2134 proximate to and defining the first inner region 2132 that is inboard of the outer surface of the first portion 2130. In an embodiment, the frustoconical surface 2134 tapers down from a diameter D4 at a distal end of the first portion 2130 to a diameter D3 at a proximal end of the first portion (the proximal end 2104 of the 3D body 2102). In an embodiment, the second portion 2140 has a frustoconical surface 2144 proximate to and defining the second inner region 2142 that is inboard of the outer surface of the second portion 2140. In an embodiment, the frustoconical surface 2144 tapers down from a diameter D2 at a distal end of the second portion 2140 (the distal end of the 3D body 2102) to the diameter D4. In an embodiment, the first inner region 2132 is contiguous with the second inner region 2142, and the third average dielectric constant is equal to the fourth average dielectric constant.

In an embodiment, the first inner region 2132 and the second inner region 2142 each comprise air, which may be composed entirely of air, or may be composed of air and another dielectric medium other than air. In an embodiment, the first and second inner regions 2132, 2142 comprise a dielectric medium in the form of a foam. In an embodiment, at least one of the first inner region 2132 and the second inner region 2142 comprises a dielectric material other than air.

In an embodiment, the third average dielectric constant and the fourth average dielectric constant are both less than each of the first average dielectric constant and the second average dielectric constant. In an embodiment, the fourth average dielectric constant is less than the third average dielectric constant.

In an embodiment, the first portion 2130 has an overall height, H1; the second portion 2140 has an overall height, H2; and, H1 is less than about 70% of H2. In an embodiment, H1 is about 50% of H2.

In an embodiment, the first portion 2130 and the second portion 2140 each have an outer cross-section shape, as observed in a plan view or an x-y plane cross-section, that is circular. In an embodiment, the first portion 2130 and the second portion 2140 each have an inner cross-section shape, as observed in a plan view or an x-y plane cross-section, that is circular.

In an embodiment, the first inner region 2132 and the second inner region 2142 are each centrally disposed relative to the central z-axis of axes 2101.

In an embodiment, the first portion 2130 has an overall outside cross-section dimension, D1, as observed in a plan view or an x-y plane cross-section; the second portion 2140 has an overall outside cross-section dimension, D2, as observed in a plan view or an x-y plane cross-section; and D1 is less than D2. In an embodiment, D1 is less than about 70% of D2. In an embodiment, D1 is about 60% of D2. In an embodiment, D3 is less than D1, D2, and D4, and D4 is less than D1 and D2.

In an embodiment: the first average dielectric constant, Dk1-2100, is equal to or greater than 10, or more particularly equal to or greater than 10 and equal to or less than 20; the second average dielectric constant, Dk2-2100, is equal to or greater than 4 and less than 10, or more particularly equal to or greater than 4 equal to or less than 9; and, the third average dielectric constant, Dk3-2100, and fourth average dielectric constant, Dk4-2100, each have a relatively lower dielectric constant that is equal to or greater than 1 (including air) and less than 4, or more particularly equal to or greater than 1 and equal to or less than 3. From the foregoing, it will be generally appreciated that the dielectric constants of the various portions and regions of the 3D body 2102 is such that Dk3-2100 and Dk4-2100 are relatively lower than Dk2-2100, and Dk2-2100 is relatively lower than Dk1-2100. In an embodiment, the first inner region 2132 and the second inner region 2142 are in the form of a depression formed by removal of material of the first portion 2130 and the second portion 2140, by use of a removable insert during the forming of the first portion 2130 and the second portion 2140, or by any other means suitable for a purpose disclosed herein.

In an embodiment, at least a portion of all exposed internal surfaces of the 3D body 2102 draft inward from the proximal end 2104 to the distal end 2106 of the 3D body 2102, as depicted generally by frustoconical surfaces 2144, 2134.

In an embodiment, the EM device 2100 further includes: a base substrate 2200 having a signal feed 2202 configured to electromagnetically excite the 3D body 2102 to radiate an EM field into the far field; wherein the 3D body 2102 is disposed on the base substrate 2200 relative to the signal feed 2202 such that the 3D body 2102 is centrally electromagnetically excited when a particular electrical signal is present on the signal feed 2202.

Figure 3A:
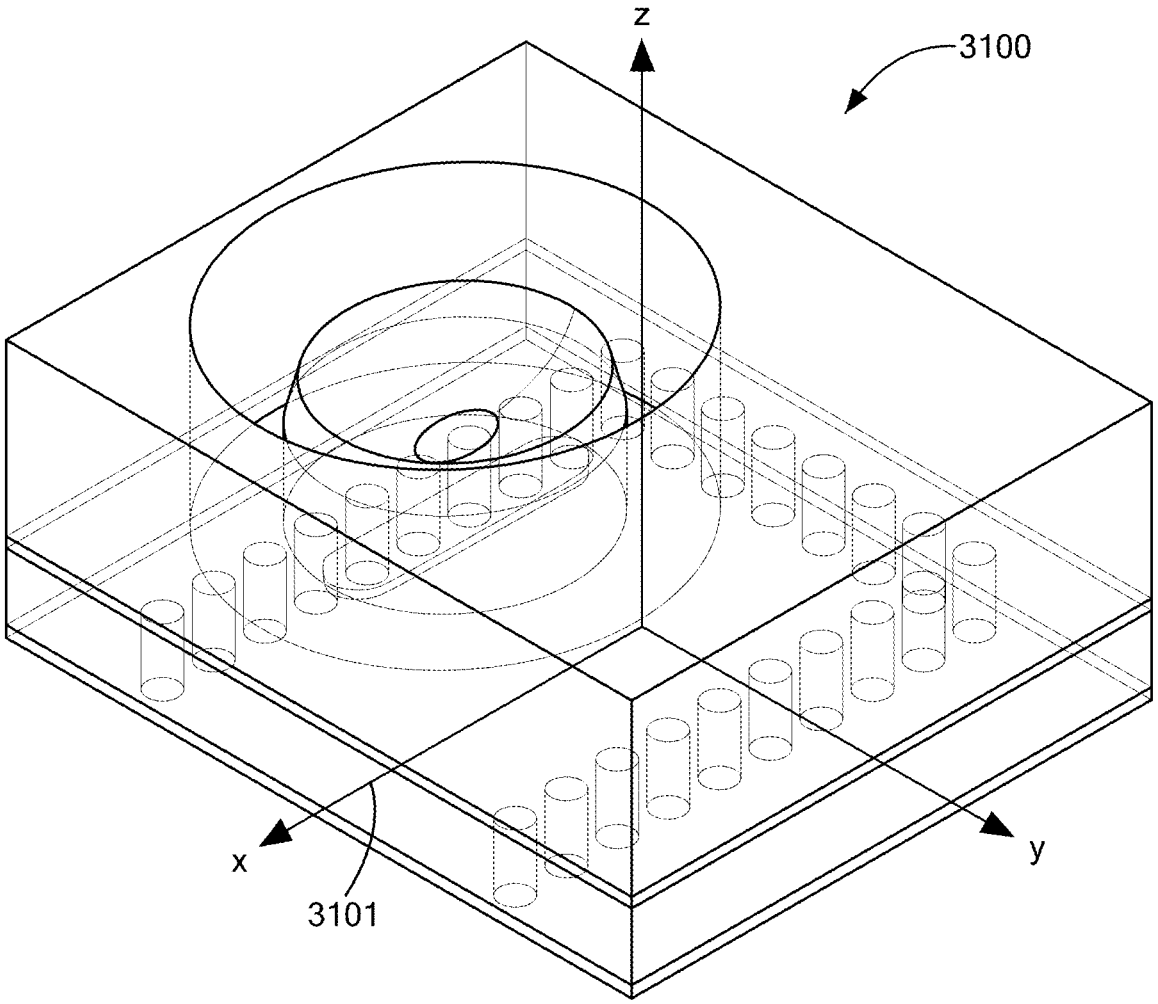
FIG. 3A depicts corresponding transparent rotated isometric, y-z cross section elevation, and x-z cross section elevation, views of an EM device alternative to that of FIG. 2, but related to FIGS. 1A-1C, in accordance with an embodiment.
Figure 3A:
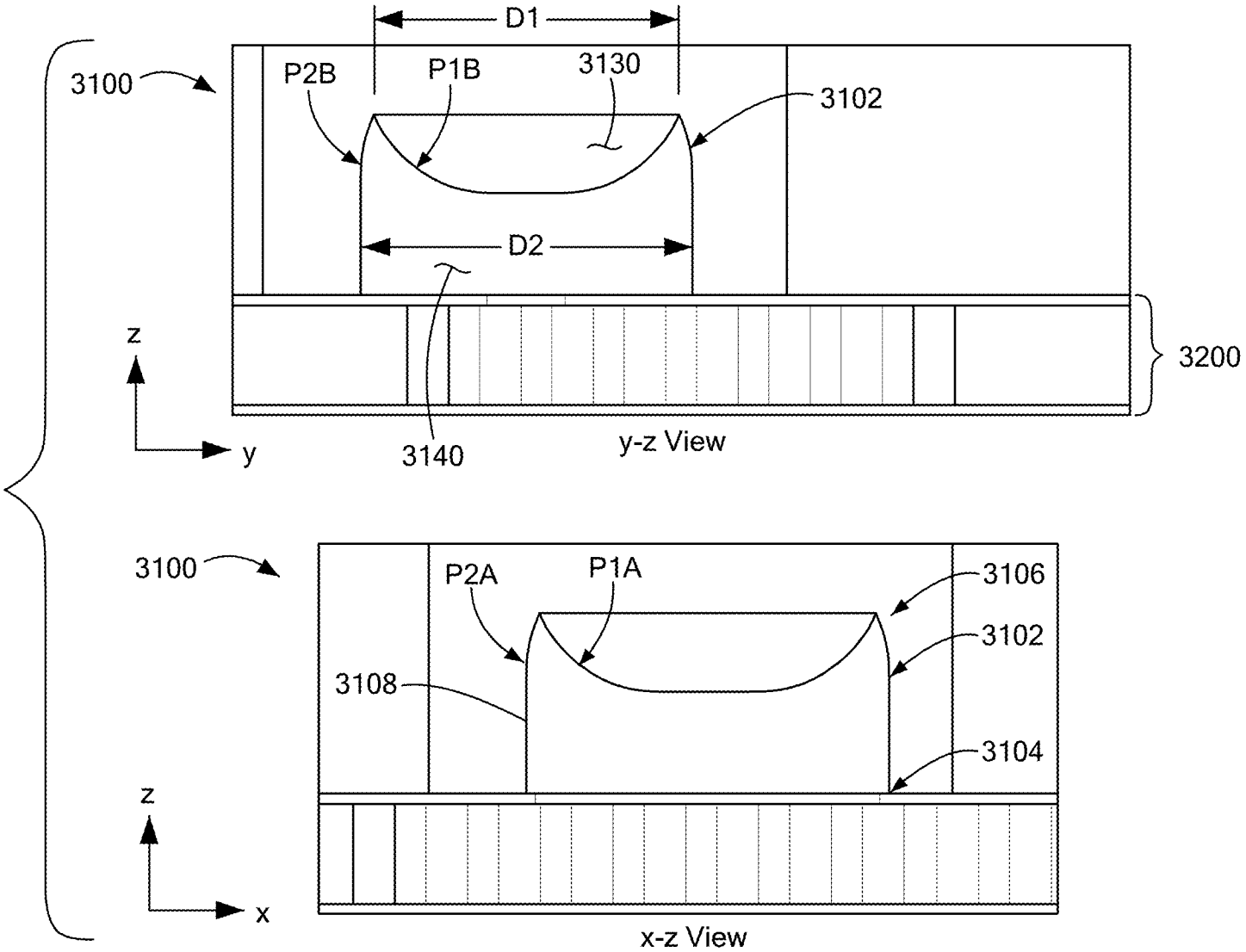
Figure 3B:
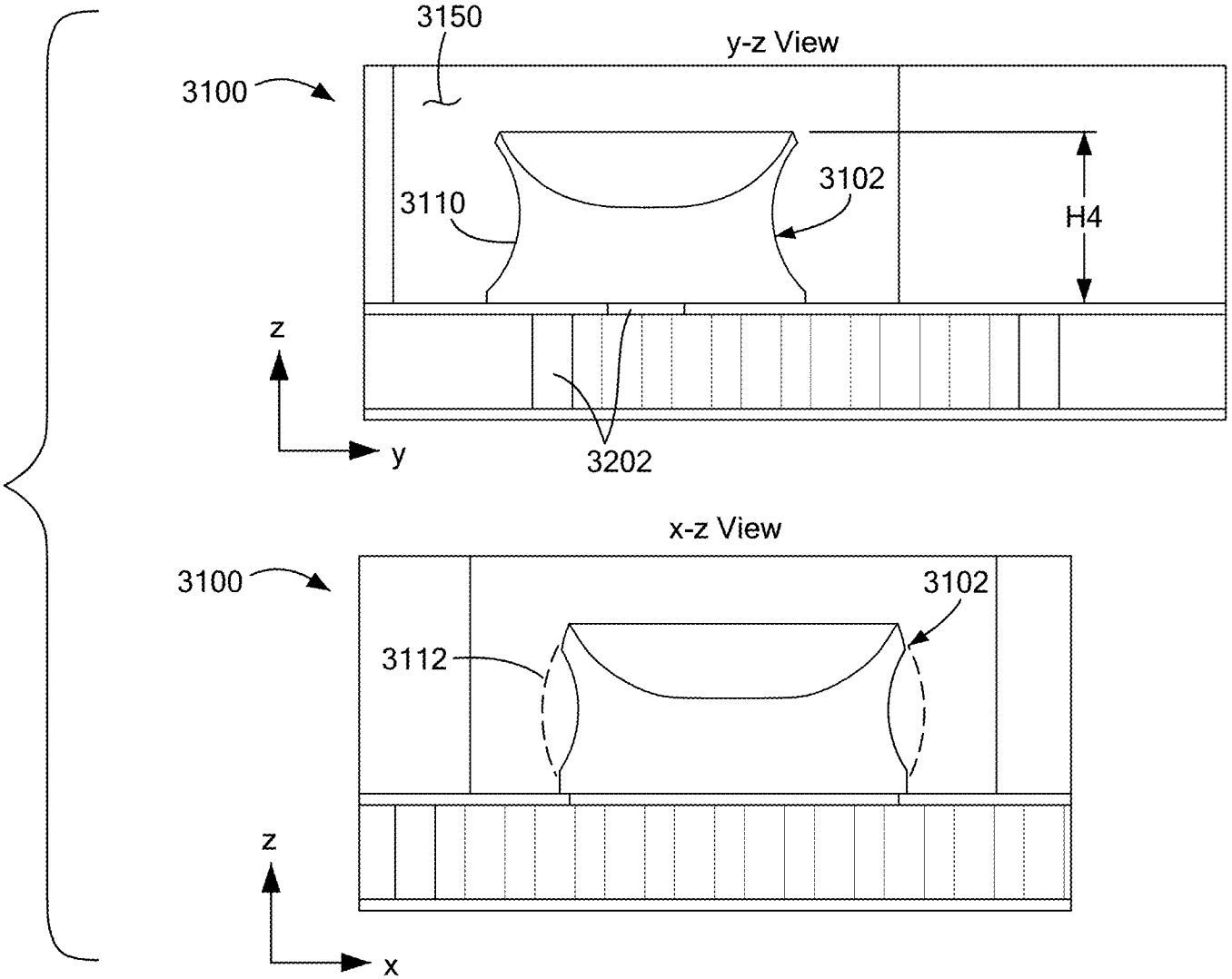
FIG. 3B depicts corresponding transparent y-z cross section elevation, and x-z cross section elevation, views of the EM device of FIG. 3A, in accordance with an embodiment.

The following description of an example EM device 3100 is made with particular reference to FIGS. 3A and 3B, collectively, in combination with FIGS. 1A-1C. The orthogonal set of x-y-z axes 3101 depicted in FIGS. 3A and 3B is for illustration purposes, and establishes the 3D arrangement of the various features of the EM device 3100 relative to each other.

In an embodiment, the example EM device 3100 includes a structure comparable to the EM device 1100, wherein: the first region 1108, 3130 extends from the distal end 1106, 3106 and only partially toward the proximal end 1104, 3104 of the 3D body 1102, 3102; and the second region 1112, 3140 is subordinate to the first region 1108, 3130.

In another embodiment, the example EM device 3100 includes: a 3D body 3102 made from a dielectric material having a proximal end 3104 and a distal end 3106; the 3D body 3102 having a first region 3130 made from a dielectric material having a first average dielectric constant (Dk1-3100), the first region 3130 extending from the distal end 3106 and only partially toward the proximal end 3104 of the 3D body 3102; and the 3D body 3102 having a second region 3140 disposed radially outboard of and subordinate to the first region 3130, as observed in an elevation view of the EM device 3100, made from a dielectric material other than air having a second average dielectric constant (Dk2-3100) that is greater than the first average dielectric constant, the second region 3140 extending, at least at an outer periphery of the second region 3140, from the proximal end 3104 to the distal end 3106 of the 3D body 3102.

In an embodiment, the dielectric material of the first region 3130 comprises air, which may be composed entirely of air, or may be composed of air and another dielectric medium other than air. In an embodiment, the first region 3130 comprises a dielectric medium in the form of a foam. In an embodiment, the dielectric material of the first region 3130 comprises a dielectric material other than air.

In an embodiment, the first region 3130 is a depression formed in the second region 3140. In an embodiment, the depression of the first region 3130 may be formed by removal of material of the second region 3140, by use of a removable insert during the forming of the second region 3140, or by any other means suitable for a purpose disclosed herein. In an embodiment, the depression extends anywhere between about 30% and about 95% of the distance from the distal end 3106 to the proximal end 3104 of the 3D body 3102, such as equal to or greater than 30%, or equal to or greater than 50%, or equal to or greater than 70%, or equal to or greater than 90%, and less than 100%. In an embodiment, the depression forms a region of the 3D body 3102 having a relatively lower dielectric constant (Dk) value than that of the second region 3140.

In an embodiment, the first region 3130 has an overall outside cross-section dimension, D1, as observed in a plan view or an x-y plane cross-section; the second region 3140 has an overall outside cross-section dimension, D2, as observed in a plan view or an x-y plane cross-section; and D1 is less than D2. In an embodiment, the second region 3140 has an outer cross-section shape, as observed in a plan view or an x-y plane cross-section, that is circular. In an embodiment, the second region 3140 has an inner cross-section shape, as observed in a plan view or an x-y plane cross-section, that is circular. In an embodiment, D1 and D2 are corresponding outer diameters of the first and second regions 3130, 3140.

In an embodiment, the first region 3130 has a first cross-section profile, P1A, as observed in a first side elevation view or an x-z plane cross-section; the first region 3130 has a second cross-section profile, P1B, as observed in a second side elevation view or a y-z plane cross-section; and P1B is different from P1A. In an embodiment, the first region 3130 has a first cross-section profile, P1A, as observed in a first side elevation view or an x-z plane cross-section; the first region 3130 has a second cross-section profile, P1B, as observed in a second side elevation view or a y-z plane cross-section; and P1B is the same as P1A. For example in a non-limiting way, one profile of P1A and P1B may follow the curvature of a circle, while the other profile follows the curvature of an ellipse, or, both profiles follow the same curvature as each other.

In an embodiment, outer sidewalls 3108 of the 3D body 3102 are vertical, relative to a central z-axis (see FIG. 3A). In an embodiment, outer sidewalls 3110 of the 3D body 3102 are concave, relative to a central z-axis (see FIG. 3B). In an embodiment, outer sidewalls 3112 of the 3D body 3102 are convex, relative to a central z-axis (see FIG. 3B).

In an embodiment, the second region 3140 has a first outer cross-section profile, P2A, as observed in a first side elevation view or an x-z plane cross-section; the second region 3140 has a second outer cross-section profile, P2B, as observed in a second elevation view or a y-z plane cross-section; and P2B is the same as P2A. In an embodiment, the second region 3140 has a first outer cross-section profile, P2A, as observed in a first side elevation view or an x-z plane cross-section; the second region 3140 has a second outer cross-section profile, P2B, as observed in a second elevation view or a y-z plane cross-section; and P2B is different from P2A.

In an embodiment, the EM device 3100 further includes: a third region 3150 made from a dielectric material having a third average dielectric constant (Dk3-3100), the third region 3150 enveloping at least the sides of the outer perimeter of the 3D body 3102 from the proximal end 3104 to at least the distal end 3106 of the 3D body 3102, the third average dielectric constant being less than the second average dielectric constant and greater than the dielectric constant of air. In an embodiment, the third region 3150 extends beyond, relative to the z-axis, the distal end 3106 of the 3D body 3102. In an embodiment, the dielectric material of the first region 3130 comprises the dielectric material of the third region 3150.

In an embodiment, the EM device 3100 further includes: a base substrate 3200 having a signal feed 3202 (see FIG. 3B) configured to electromagnetically excite the 3D body 3102 to radiate an EM field into the far field; wherein the 3D body 3102 is disposed on the base substrate 3200 relative to the signal feed 3202 such that the 3D body 3102 is centrally electromagnetically excited when a particular electrical signal is present on the signal feed 3202.

Figure 3C:
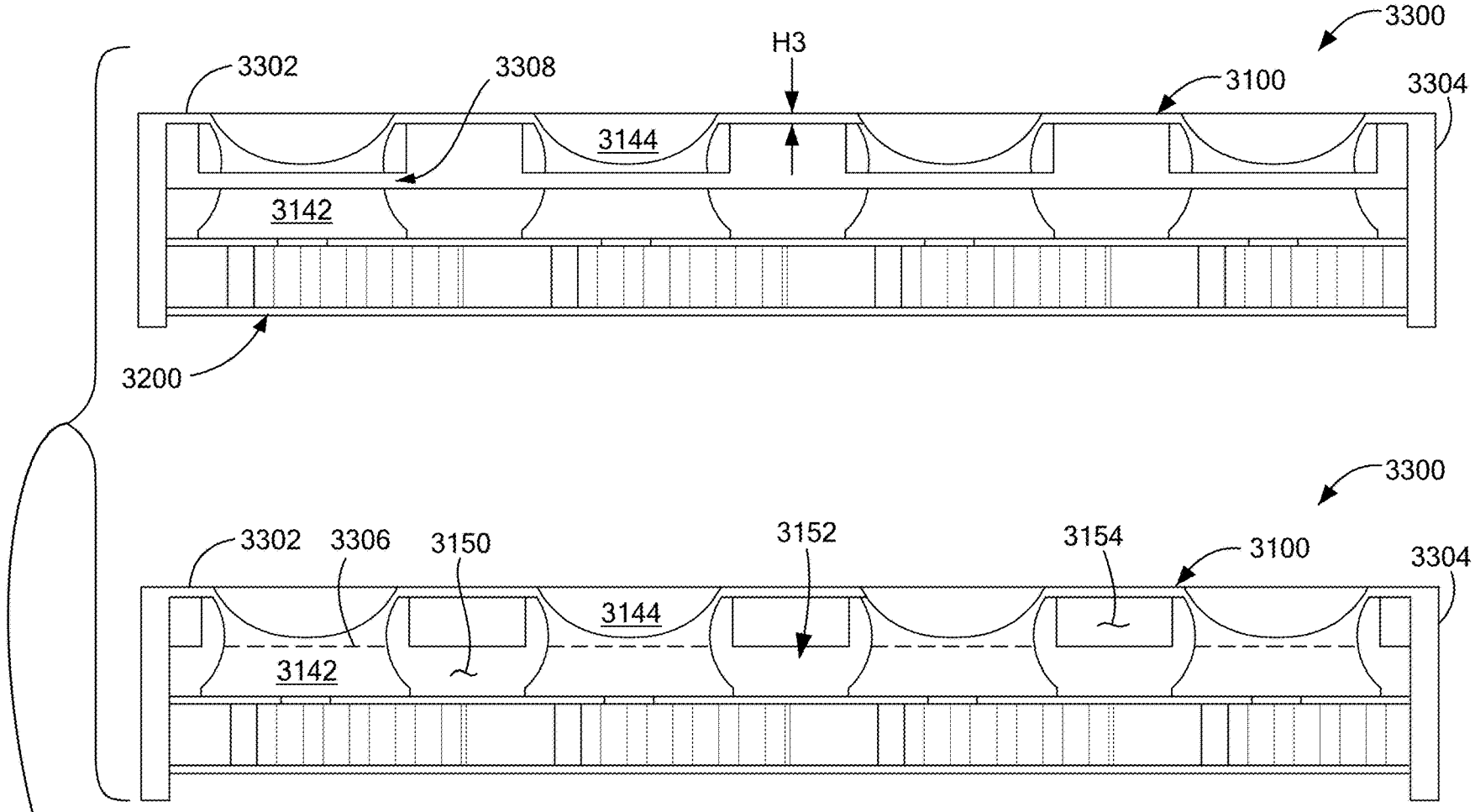
FIG. 3C depicts alternative transparent cross section elevation views of an array of the EM device of any of FIGS. 3A-3B, in accordance with an embodiment.

In an embodiment, an array 3300 of the EM device 3100 (see FIG. 3C) is operational at an operating frequency and associated wavelength, wherein: the array 3300 includes a plurality of the EM devices 3100, each EM device 3100 of the plurality of EM devices 3100 being physically connected to at least one other of the plurality of EM devices 3100 via a relatively thin connecting structure 3302 to form a connected array 3300, each connecting structure 3302 being relatively thin as compared to an overall outside dimension of one of the plurality of EM devices 3100, each connecting structure 3302 having a cross sectional overall height, H3, that is less than 20% of an overall height, H4, of a respective connected EM device 3100 and being formed from the dielectric material of the second region 3140, each connecting structure 3302 and the associated EM device 3100 forming a single monolithic portion of the connected array 3300. In an embodiment, each connecting structure 3302 is disposed proximate the distal end 3106 of the 3D body 3102 at a distance away from the proximal end 3104 of the 3D body 3102. In an embodiment, the array 3300 further includes a base substrate 3200, wherein the array 3300 is disposed on the base substrate 3200. In an embodiment, the connecting structure 3302 further includes at least one leg 3304 that is integrally formed with and monolithic with the connecting structure 3302, the at least one leg 3304 extending down from the connecting structure 3302 to the base substrate 3200.

In an embodiment, the second region 3140 has a first portion 3142 proximate the proximal end 3104 of the 3D body 3102, and a second portion 3144 proximate the distal end 3106 of the 3D body 3102. In an embodiment, the second portion 3144 abuts and is in contact with (depicted as dashed line 3306 in FIG. 3C) the first portion 3142. In an embodiment, the second portion 3144 is proximate the first portion 3142 with a material gap 3308 of the second average dielectric constant therebetween. That is, the gap 3308 is absent dielectric material of the second region 3140.

In an embodiment, the material gap 3308 of the second average dielectric constant comprises air, which may be composed entirely of air, or may be composed of air and another dielectric medium other than air. In an embodiment, the material gap 3308 comprises a dielectric medium in the form of a foam.

In an embodiment, the array 3300 further includes a third region 3150 made from a dielectric material having a third average dielectric constant (Dk3-3100), the third region 3150 enveloping at least the sides of the outer perimeter of the 3D body 3102 from the proximal 3104 to at least the distal end 3106 of the 3D body 3102, the third average dielectric constant being less than the second average dielectric constant and greater than the dielectric constant of air.

In an embodiment, the third region 3150 extends via bridge portion 3152 between adjacent ones of the plurality of EM devices 3100 of the array 3300. In an embodiment, the third region 3150 extends via bridge portion 3152 between adjacent ones of the first portion 3142 of corresponding ones of the plurality of EM devices 3100 of the array 3300, and the third region 3150 does not extend via a void 3154 between adjacent ones of the second portion 3144 of corresponding ones of the plurality of EM devices 3100 of the array 3300.

In an embodiment, the gap 3308 that is absent dielectric material having the second average dielectric constant comprises the dielectric material having the third average dielectric constant.

In an embodiment of the array 3300, the base substrate 3200 includes a plurality of signal feeds 3202, each signal feed 3202 of the plurality of signal feeds 3202 configured to electromagnetically excite a corresponding one of the plurality of EM devices 3100 to radiate an EM field into the far field, wherein a given one of the plurality of EM devices 3100 is disposed on the base substrate 3200 relative to a corresponding signal feed 3202 such that the given EM device 3100 is centrally electromagnetically excited when a particular electrical signal is present on the corresponding signal feed 3202.

Figure 4A:
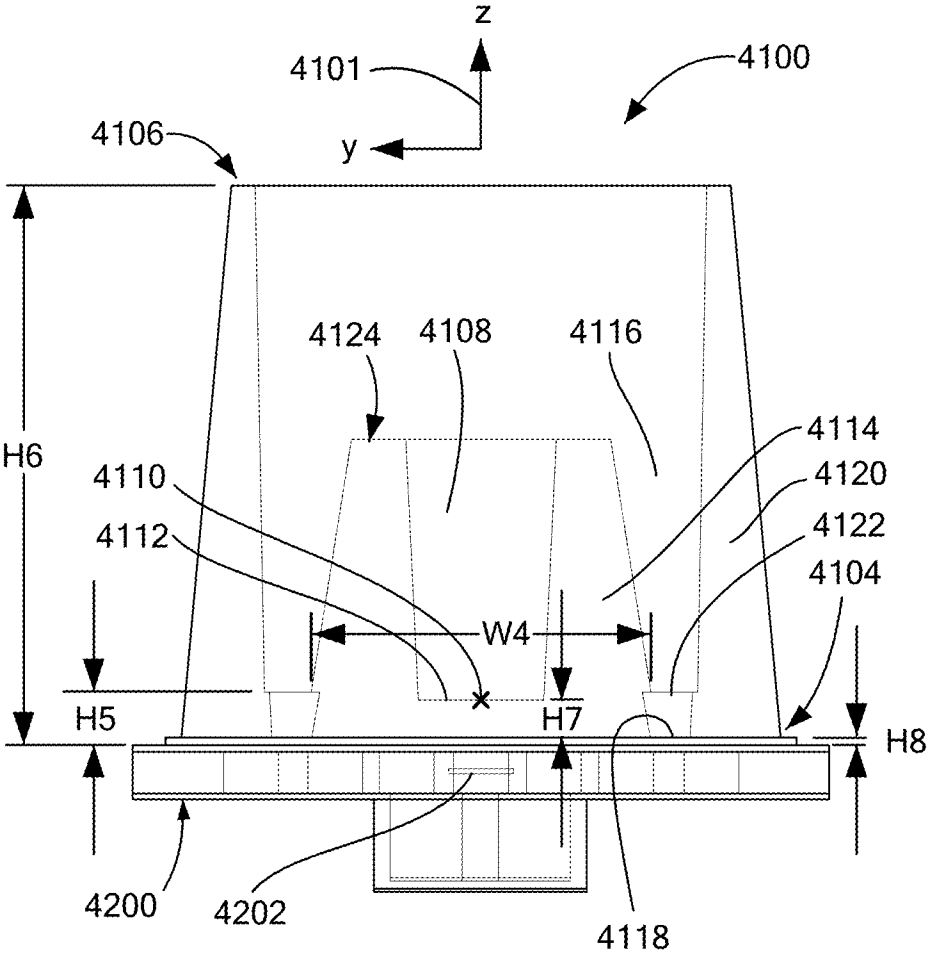
FIG. 4A depicts corresponding solid rotated isometric, and transparent cross section elevation, views of an EM device alternative to that of FIG. 2, but related to FIGS. 1A-1C, in accordance with an embodiment.
Figure 4A:
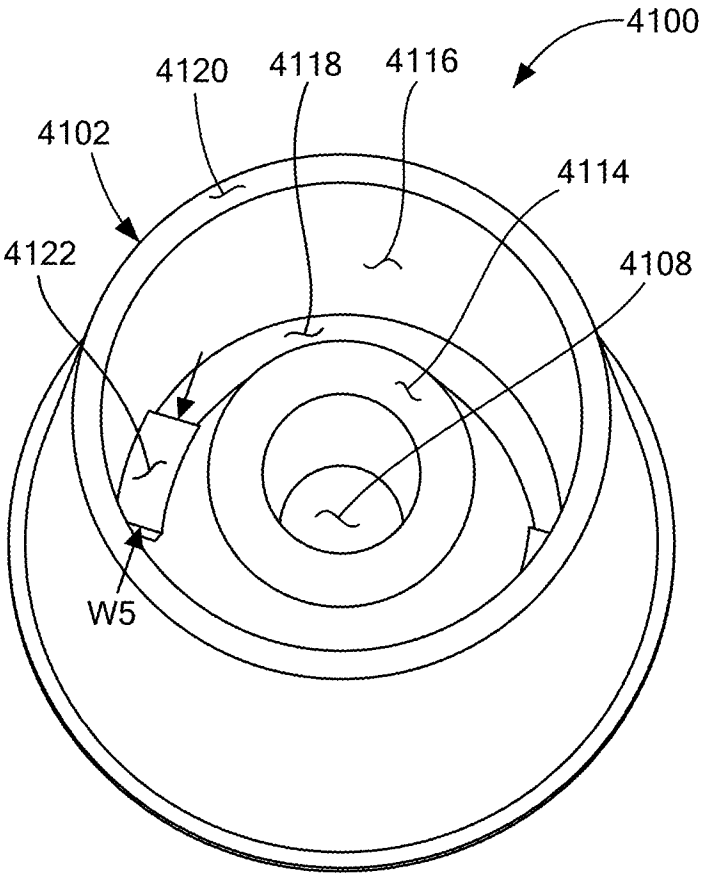
Figure 4B:
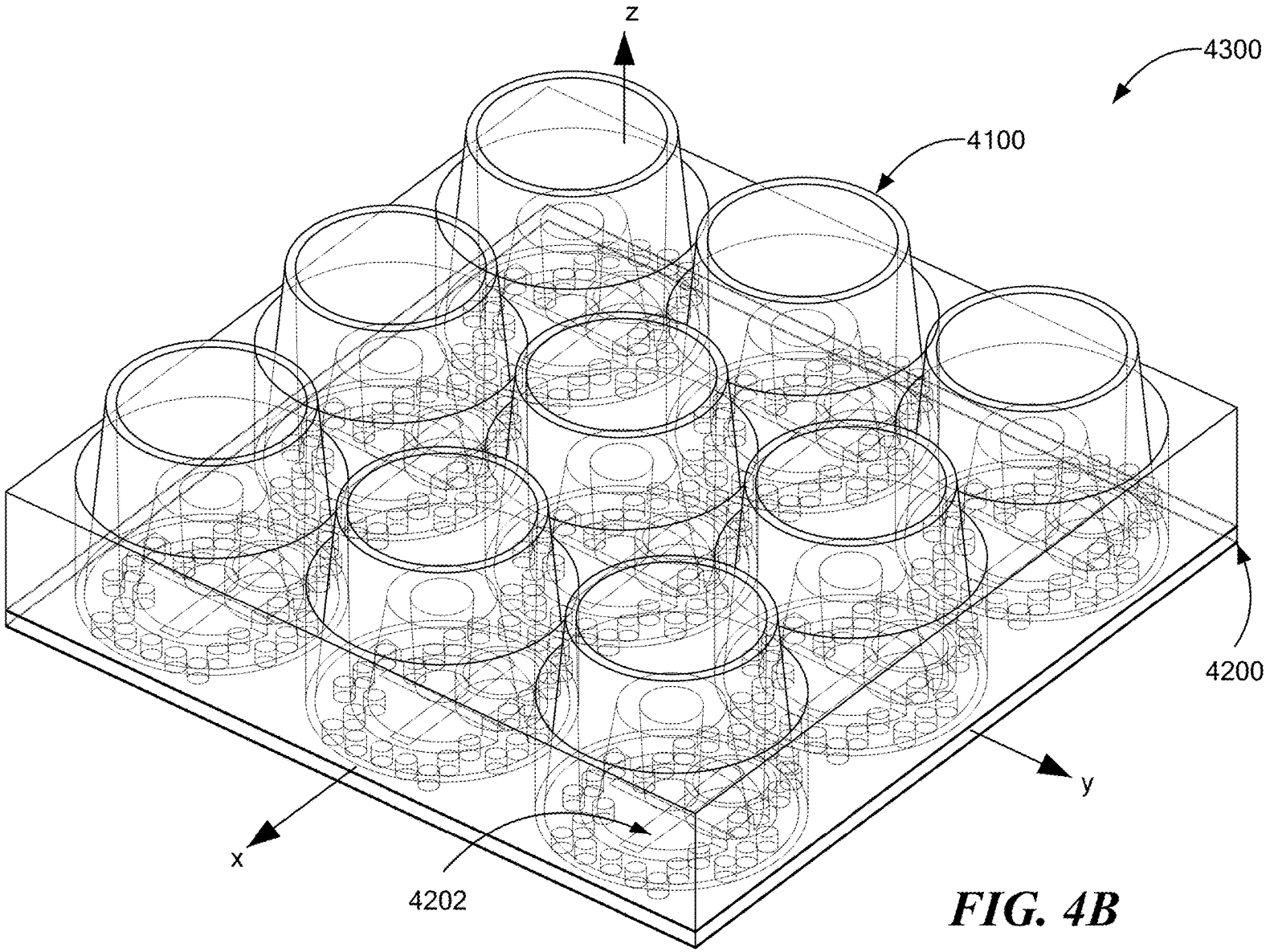
FIG. 4B depicts a corresponding transparent rotated isometric view of an array of the EM device of FIG. 4A, in accordance with an embodiment.

The following description of an example EM device 4100 is made with particular reference to FIGS. 4A and 4B, collectively, in combination with FIGS. 1A-1C. The orthogonal set of x-y-z axes 4101 depicted in FIGS. 4A and 4B is for illustration purposes, and establishes the 3D arrangement of the various features of the EM device 4100 relative to each other.

In an embodiment, the example EM device 4100 includes a structure comparable to the EM device 1100, wherein: the first region 1108, 4108 extends at least partially to the distal end 1106, 4106 of the 3D body 1102, 4102 from a first base structure 4112 proximate the proximal end 1104, 4104 of the 3D body 1102, 4102; the second region 1112, 4114 extends at least partially to the distal end 1106, 4106 of the 3D body 1102, 4102 from the proximal end 1104, 4104 of the 3D body 1102, 4102; the 3D body 1102, 4102 further comprises a third region 1114, 4116 disposed radially outboard of the second region 1112, 4114 made from a dielectric material having a third average dielectric constant (Dk3-1100, Dk3-4100) that is less than the second average dielectric constant (Dk2-1100), the third region 1114, 4116 extending to the distal end 1106, 4106 of the 3D body 1102, 4102 from a second base structure 4118 proximate the proximal end 1104, 4104 of the 3D body 1102, 4102; and the 3D body 1102, 4102 further comprising a fourth region 1120, 4120 disposed radially outboard of the third region 1114, 4116 made from a dielectric material having a fourth average dielectric constant (Dk4-4100) that is greater than the third average dielectric constant, the fourth region 1120, 4120 extending to the distal end 1106, 4106 of the 3D body 1102, 4102 from the proximal end 1104, 4104 of the 3D body 1102, 4102.

In another embodiment, the example EM device 4100 includes: a 3D body 4102 made from a dielectric material having a proximal end 4104 and a distal end 4106; the 3D body 4102 having a first region 4108 disposed toward the axial center 4110 of the 3D body 4102 made from a dielectric material having a first average dielectric constant (Dk1-4100), the first region 4108 extending at least partially, and in an embodiment only partially, to the distal end 4106 of the 3D body 4102 from a first base structure 4112 proximate the proximal end 4104 of the 3D body 4102; the 3D body 4102 having a second region 4114 disposed radially outboard of the first region 4108 made from a dielectric material other than air having a second average dielectric constant (Dk2-4100) that is greater than the first average dielectric constant, the second region 4114 extending at least partially, and in an embodiment only partially, to the distal end 4106 of the 3D body 4102 from the proximal end 4104 of the 3D body 4102; the 3D body 4102 having a third region 4116 disposed radially outboard of the second region 4114 made from a dielectric material having a third average dielectric constant (Dk3-4100) that is less than the second average dielectric constant, the third region 4116 extending to the distal end 4106 of the 3D body 4102 from a second base structure 4118 proximate the proximal end 4104 of the 3D body 4102; and the 3D body 4102 having a fourth region 4120 disposed radially outboard of the third region 4116 made from a dielectric material having a fourth average dielectric constant (Dk4-4100) that is greater than the third average dielectric constant, the fourth region 4120 extending to the distal end 4106 of the 3D body 4102 from the proximal end 4104 of the 3D body 4102. In an embodiment, the first base structure 4112 of the first region 4108, as observed in an elevation view of the EM device 4100, has a thickness, H7, and is integrally formed and monolithic with the second region 4114. In an embodiment, H7 is equal to or less than 0.015 inches. In an embodiment, the first region 4108 is centrally disposed with respect to a central z-axis within the 3D body 4102.

In an embodiment, the third region 4116 is a continuum of the first region 4108, and each of the first region 4108 and the third region 4116 comprises air, which may be composed entirely of air, or may be composed of air and another dielectric medium other than air. In an embodiment, the first and third regions 4108, 4116 comprise a dielectric medium in the form of a foam. In an embodiment, the third region 4116 is a continuum of the first region 4108, and at least one of the first region 4108 and the third region 4116 comprises a dielectric material other than air. In an embodiment, the third region 4116 comprises a dielectric material that is different from the dielectric material of the first region 4108. In an embodiment, the dielectric material of the third region 4116 has a dielectric constant that is less than the dielectric constant of the dielectric material of the first region 4108.

In an embodiment, the fourth region 4120 is a continuum of the second region 4114, via the second base structure 4118 for example, such that the second and fourth regions 4114, 4120 and the second base structure 4118 are integrally formed with each other to form a monolithic, and the fourth average dielectric constant is equal to the second average dielectric constant.

In an embodiment, the EM device 4100 further includes a relatively thin connecting structure 4122 disposed at the proximal end 4104 of the 3D body 4102 and being integrally formed with and bridging between the second region 4114 and the fourth region 4120, such that the second region 4114, the fourth region 4120, and the relatively thin connecting structure 4122, form a monolithic, the relatively thin connecting structure 4122, as observed in an elevation view of the EM device 4100, having an overall height, H5, that is less than 20% of an overall height, H6, of the 3D body 4102. The relatively thin connecting structure 4122 having an overall width, W5, as observed in the rotated isometric view of the EM device 4100, that is less than an overall outside dimension, W4, of the second region 4114.

In an embodiment, the second base structure 4118, as observed in an elevation view of the EM device 4100, has a thickness H8 that is less than H5. In an embodiment, H8 is equal to or less than 0.005 inches, or equal to or less than 0.003 inches. In an embodiment, the second base structure 4118 may be a separate layer disposed adjacent to and under the first, second, third, and fourth regions 4108, 4114, 4116, and 4120 of the 3D body 4102, made from a dielectric material having a dielectric constant that is relatively high as compared to that of the 3D body 4102, and preferably substantially matches the dielectric constant of the 3D body 4102.

In an embodiment, the first region 4108 is a depression formed in the second region 4114. In an embodiment, the depression extends anywhere between about 30% and about 95% of the distance from a distal end 4124 of the second region 4114 to the proximal end 4104 of the 3D body 4102. In an embodiment, the second region 4114 and the first region 4108 have coexisting central z-axes, the third region 4116 and the second region 4114 have coexisting central z-axes, and the fourth region 4120 and the third region 4116 have coexisting central z-axes. In an embodiment and as observed in a plan view of the EM device 4100, the second region 4114 completely surrounds the first region 4108, the third region 4116 completely surrounds the second region 4114, and the fourth region 4120 completely surrounds the third region 4116.

In an embodiment, the second region 4114 and the fourth region 4120 each have an outer cross-section shape, as observed in a plan view or an x-y plane cross-section, that is circular. In an embodiment, the second region 4114 and the fourth region 4120 each have an inner cross-section shape, as observed in a plan view or an x-y plane cross-section, that is circular.

In an embodiment, at least a portion of all exposed internal surfaces of at least the second region 4114 and the fourth region 4120 of the 3D body 4102 draft inward from the proximal end 4104 disposed toward the distal end 4106 of the 3D body 4102, as illustrated by tapered inner and outer surfaces in FIG. 4A.

In view of the foregoing, the first region 4108 and/or the third region 4116 are depressions in the 3D body 4102 formed by removal of material of the 3D body 4102 (such as the second region 4114 and the fourth region 4120), by use of a removable insert during the forming of the 3D body 4102, or by any other means suitable for a purpose disclosed herein. In an embodiment, the aforementioned depressions (first region 4108 and third region 4116 for example) are regions of the 3D body 4102 having a relatively lower dielectric constant than the non-depression regions (second region 4114 and fourth region 4120 for example).

In an embodiment, the EM device 4100 further includes: a base substrate 4200 having a signal feed 4202 configured to electromagnetically excite the 3D body 4102 to radiate an EM field into the far field; wherein the 3D body 4102 is disposed on the base substrate 4200 relative to the signal feed 4202 such that the 3D body 4102 is centrally electromagnetically excited when a particular electrical signal is present on the signal feed 4202.

In an embodiment, an array 4300 of the EM device 4100 (see FIG. 4B) is operational at an operating frequency and associated wavelength, wherein: the array 4300 includes a plurality of the EM devices 4100 disposed on a base substrate 4200; the base substrate 4200 having a plurality of signal feeds 4202, each signal feed 4202 of the plurality of signal feeds 4202 being configured to electromagnetically excite a corresponding one of the plurality of EM devices 4100 to radiate an EM field into the far field; wherein a given EM device 4100 is disposed on the base substrate 4200 relative to a corresponding signal feed 4202 such the given EM device 4100 is centrally electromagnetically excited when a particular electrical signal is present on the corresponding signal feed 4202.

Figure 5:
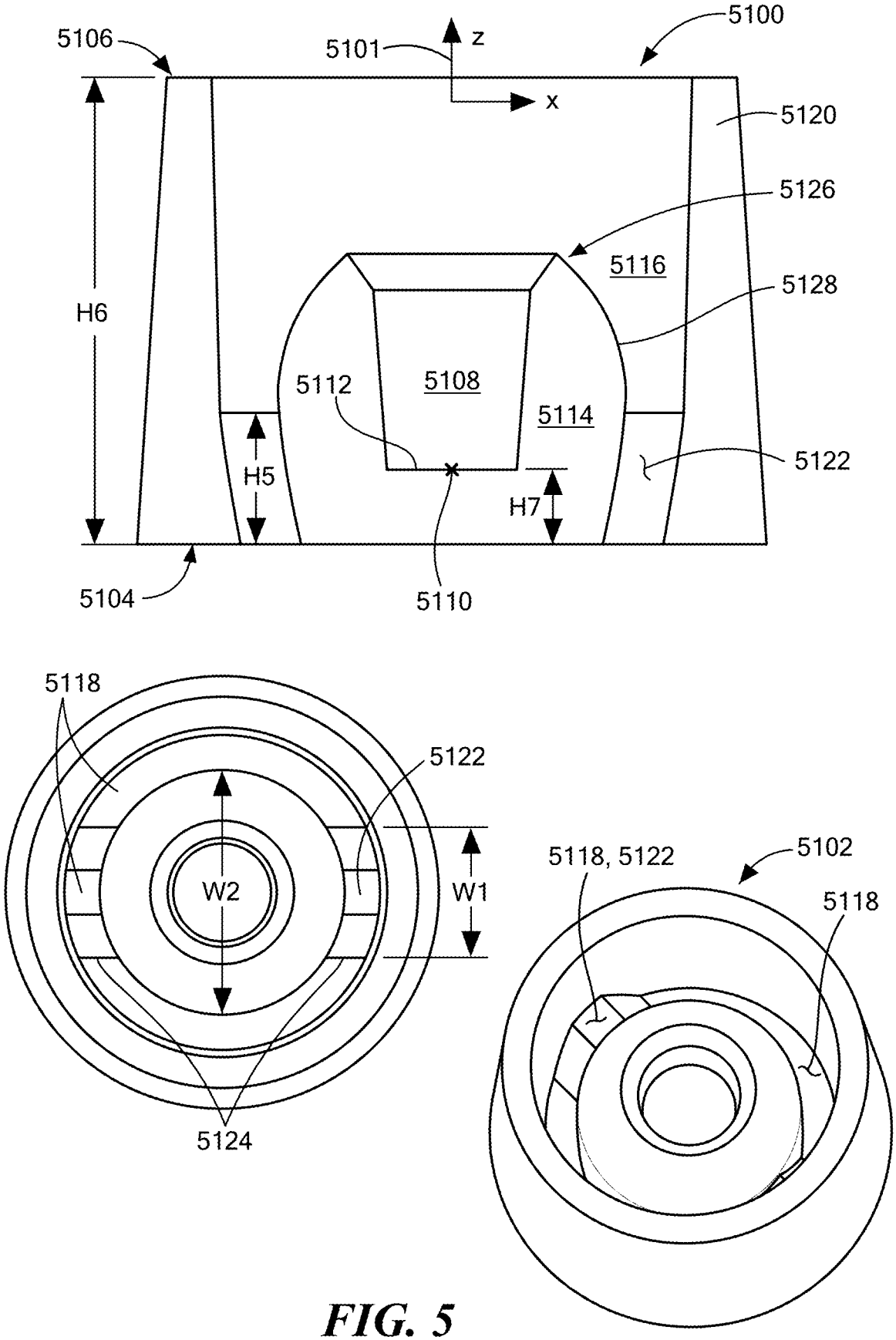
FIG. 5 depicts corresponding cross section elevation, plan, and solid rotated isometric, views of an EM device alternative to that of FIG. 2, but related to FIGS. 1A-1C, in accordance with an embodiment.

The following description of an example EM device 5100 is made with particular reference to FIG. 5, in combination with FIGS. 1A-1C. The orthogonal set of x-y-z axes 5101 depicted in FIG. 5 is for illustration purposes, and establishes the 3D arrangement of the various features of the EM device 5100 relative to each other.

In an embodiment, the example EM device 5100 includes a structure comparable to the EM device 1100, wherein: the first region 1108, 5108 extends at least partially to the distal end 1106, 5106 of the 3D body 1102, 5102 from a first base structure 5112 proximate the proximal end 1104, 5104 of the 3D body 1102, 5102; the second region 1112, 5114 extends at least partially to the distal end 1106, 5106 of the 3D body 1102, 5102 from the proximal end 1104, 5104 of the 3D body 1102, 5102; the 3D body 1102, 5102 further comprises a third region 1114, 5116 disposed radially outboard of the second region 1112, 5114 made from a dielectric material having a third average dielectric constant (Dk3-1100, Dk3-5100) that is less than the second average dielectric constant (Dk2-1100), the third region 1114, 5116 extending to the distal end 1106, 5106 of the 3D body 1102, 5102 from a second base structure 5118 proximate the proximal end 1104, 5104 of the 3D body 1102, 5102; the 3D body 1102, 5102 further comprises a fourth region 1120, 5120 disposed radially outboard of the third region 1114, 5116 made from a dielectric material having a fourth average dielectric constant (Dk4-5100) that is greater than the third average dielectric constant, the fourth region 1120, 5120 extending to the distal end 1106, 5106 of the 3D body 1102, 5102 from the proximal end 1104, 5104 of the 3D body 1102, 5102; the second base structure 5118 comprising a relatively thin connecting structure 5122, disposed at the proximal end 5104 of the 3D body 5102, that is integrally formed with and bridges between the second region 5114 and the fourth region 5120, such that the second region 5114, the fourth region 5120, and the relatively thin connecting structure 5122, are integrally formed with each other to form a monolithic, the relatively thin connecting structure 5122 having an overall height, H5, that is less than 30% of an overall height, H6, of the 3D body 1102; and the second base structure 5118 in the third region 5116 being absent dielectric material of the monolithic except for the relatively thin connecting structure 5122.

In another embodiment, the example EM device 5100 includes: a 3D body 5102 made from a dielectric material having a proximal end 5104 and a distal end 5106; the 3D body 5102 having a first region 5108 disposed toward the center 5110 of the 3D body 5102 made from a dielectric material having a first average dielectric constant (Dk1-5100), the first region 5108 extending at least partially to the distal end 5106 of the 3D body 5102 from a first base structure 5112 proximate the proximal end 5104 of the 3D body 5102; the 3D body 5102 having a second region 5114 disposed radially outboard of the first region 5108 made from a dielectric material other than air having a second average dielectric constant (Dk2-5100) that is greater than the first average dielectric constant, the second region 5114 extending at least partially to the distal end 5106 of the 3D body 5102 from the proximal end 5104 of the 3D body 5102; the 3D body 5102 having a third region 5116 disposed radially outboard of the second region 5114 made from a dielectric material having a third average dielectric constant (Dk3-5100) that is less than the second average dielectric constant, the third region 5116 extending to the distal end 5106 of the 3D body 5102 from a second base structure 5118 proximate the proximal end 5104 of the 3D body 5102; the 3D body 5102 having a fourth region 5120 disposed radially outboard of the third region 5116 made from a dielectric material having a fourth average dielectric constant (Dk4-5100) that is greater than the third average dielectric constant, the fourth region 5120 extending to the distal end 5106 of the 3D body 5102 from the proximal end 5104 of the 3D body 5102; wherein the second base structure 5118 includes a relatively thin connecting structure 5122, disposed at the proximal end 5104 of the 3D body 5102, that is integrally formed with and bridges between the second region 5114 and the fourth region 5120, such that the second region 5114, the fourth region 5120, and the relatively thin connecting structure 5122, are integrally formed with each other to form a monolithic, the relatively thin connecting structure 5122, as observed in an elevation view of the EM device 5100, having an overall height, H5, that is less than 30% of an overall height, H6, of the 3D body 5102; and wherein the second base structure 5118 in the third region 5116 is absent dielectric material of the monolithic except for the relatively thin connecting structure 5122.

In an embodiment, the first base structure 5112 of the first region 5108, as observed in an elevation view of the EM device 5100, has a thickness, H7, and is integrally formed and monolithic with the second region 5114. In an embodiment, H7 is equal to or less than 0.015 inches.

In an embodiment, the relatively thin connecting structure 5122 has at least two arms 5124 that bridge between the second region 5114 and the fourth region 5120. In an embodiment, the relatively thin connecting 5122 structure, as observed in a plan view of the EM device 5100, has an overall width, W1, that is less than an overall width, W2, of the second region 5114.

In an embodiment, the first region 5108 is axially centrally disposed with respect to a central z-axis within the 3D body 5102.

In an embodiment, the third region 5116 is a continuum of the first region 5108, and each of the first region 5108 and the third region 5116 comprises air, which may be composed entirely of air, or may be composed of air and another dielectric medium other than air. In an embodiment, the first and third regions 5108, 5116 comprise a dielectric medium in the form of a foam. In an embodiment, the third region 5116 is a continuum of the first region 5108, and at least one of the first region 5108 and the third region 5116 comprises a dielectric material other than air. In an embodiment, the third region 5116 comprises a dielectric material that is different from the dielectric material of the first region 5108. In an embodiment, the dielectric material of the third region 5116 has a dielectric constant that is less than the dielectric constant of the dielectric material of the first region 5108. In an embodiment, the monolithic has a dielectric constant equal to the second average dielectric constant. In an embodiment, the first region 5108 is a depression formed in the second region 5114. In an embodiment, the depression of the first region 5108 may be formed by removal of material of the second region 5114, by use of a removable insert during the forming of the second region 5114, or by any other means suitable for a purpose disclosed herein. In an embodiment, the depression extends anywhere between about 30% and about 95% of the distance from a distal end 5126 of the second region 5114 to the proximal end 5104 of the 3D body 5102. In an embodiment, the second region 5114 and the first region 5108 have coexisting central z-axes, the third region 5116 and the second region 5114 have coexisting central z-axes, and the fourth region 5120 and the third region 5116 have coexisting central z-axes. In an embodiment and as observed in a plan view of the EM device 5100, the second region 5114 completely surrounds the first region 5108, the third region 5116 completely surrounds the second region 5114, and the fourth region 5120 completely surrounds the third region 5116.

In an embodiment and as observed in an elevation view of the EM device 5100, at least a portion of the second region 5114 has a convex outer surface 5128. In an embodiment, the convex outer surface 5128 extends from the proximal end 5104 of the 3D body 5102 to the distal end 5126 of the second region 5114.

In an embodiment and as observed in a plan view of the EM device 5100, the second region 5114 and the fourth region 5120 each have an outer cross-section shape, as also observed in an x-y plane cross-section, that is circular. In an embodiment and as observed in a plan view of the EM device 5100, the second region 5114 and the fourth region 5120 each have an inner cross-section shape, as also observed in an x-y plane cross-section, that is circular. In an embodiment, at least a portion of all exposed internal surfaces of at least the second region 5114 and the fourth region 5120 of the 3D body 5102 draft inward from the proximal end 5104 toward the distal end 5106 of the 3D body 5102.

In an embodiment, the EM device 5100 further includes: a base substrate (see 4200, FIGS. 4A and 4B, for example) having a signal feed (see 4202, FIGS. 4A and 4B, for example) configured to electromagnetically excite the 3D body 5102 to radiate an EM field into the far field; wherein the 3D body 5102 is disposed on the base substrate relative to the signal feed such that the 3D body 5102 is centrally electromagnetically excited when a particular electrical signal is present on the signal feed.

In an embodiment, an array (see 4300, FIG. 4B, for example) of the EM device 5100 is operational at an operating frequency and associated wavelength, wherein: the array comprises a plurality of the EM devices 5100 disposed on a base substrate (see 4200, FIG. 4B, for example); the base substrate comprises a plurality of signal feeds (see 4202, FIG. 4B, for example), each signal feed of the plurality of signal feeds being configured to electromagnetically excite a corresponding one of the plurality of EM devices 5100 to radiate an EM field into the far field; wherein a given EM device 5100 is disposed on the base substrate relative to a corresponding signal feed such the given EM device 5100 is centrally electromagnetically excited when a particular electrical signal is present on the corresponding signal feed.

The following description of an example EM device 6100 is made with particular reference to FIGS. 6A, 6B, 6C, 6D, 6E, 6F, 6G, 6H, 6I, and 6J, collectively, in combination with FIGS. 1A-1C. The orthogonal set of x-y-z axes 6101 depicted in FIGS. 6B-6C, 6I and 6J, are for illustration purposes, and establishes the 3D arrangement of the various features of the EM device 6100 relative to each other.

In an embodiment, the example EM device 6100 includes a structure comparable to the EM device 1100, that further includes: a base substrate 6200 having a first plurality of vias 6204 that extend through the base substrate 6200; wherein the 3D body 1102, 6102 comprises a medium other than air, the proximal end 1104, 6104 of the 3D body 1102, 6102 being disposed on the base substrate 6200 so that the 3D body 1102, 6102 at least partially or completely covers the first plurality of vias 6204; wherein the first plurality of vias 6204 are at least partially filled with the dielectric material of the 3D body 1102, 6102, such that the 3D body 1102, 6102 and the dielectric material of the first plurality of vias 6204 form a monolithic.

In another embodiment, the example EM device 6100 includes: a base substrate 6200 having a first plurality of vias 6204 that extend through the base substrate 6200 from one side to an opposing side; a 3D body 6102 made from a dielectric material comprised of a medium other than air, the 3D body 6102 having a proximal end 6104 and a distal end 6106, the proximal end 6104 of the 3D body 6102 being disposed on the base substrate 6200 so that the 3D body 6102 at least partially or completely covers the first plurality of vias 6204; wherein the first plurality of vias 6204 are at least partially filled with the dielectric material of the 3D body 6102, such that the 3D body 6102 and the dielectric material of the first plurality of vias 6204 form a monolithic. In an embodiment, the 3D body 6102 completely covers the first plurality of vias 6204. In an embodiment, the first plurality of vias 6204 are completely filled with the dielectric material of the 3D body 6102. In an embodiment, the dielectric material of the 3D body 6102 is a moldable dielectric material.

In an embodiment, the base substrate 6200 further comprises a second plurality of vias 6206 that may be fully covered by the 3D body 6102, partially covered by the 3D body 6102, or fully exposed relative to the 3D body 6102. In an embodiment, the second plurality of vias 6206 that are fully or partially covered by the 3D body 6102 are either; at least partially filled with the dielectric material of the 3D body 6102, or filled with an electrically conductive material (such as but not limited to copper for example); and the second plurality of vias 6206 that are fully exposed relative to the 3D body 6102 are filled with an electrically conductive material (such as but not limited to copper for example).

From the foregoing description of the first and second plurality of vias 6204, 6206, it will be appreciated that a distinction may be made between the two. That is, the first plurality of vias 6204 are necessarily at least partially filled with the dielectric material of the 3D body 6102, while the second plurality of vias 6206 are not necessarily at least partially filled with the dielectric material of the 3D body 6102. In an embodiment, the first plurality of vias 6204 may serve as a structural anchor for anchoring the 3D body 6102 to the substrate 6200, and the second plurality of vias 6206 may serve as an electrically conductive wall for a slotted aperture signal feed (discussed further below).

In an embodiment, the base substrate 6200 further includes a signal feed 6202 configured to electromagnetically excite the 3D body 6102 to radiate an EM field into the far field when a particular electrical signal is present on the signal feed 6202. In an embodiment, the 3D body 6102 is disposed on the base substrate 6200 relative to the signal feed 6202 such that the 3D body 6102 is centrally electromagnetically excited when a particular electrical signal is present on the signal feed 6202. In an embodiment, the signal feed 6202 comprises a stripline 6208 and a slotted aperture 6210 (see FIG. 6D), the slotted aperture 6210 being completely covered by the 3D body 6102.

Figure 6A:
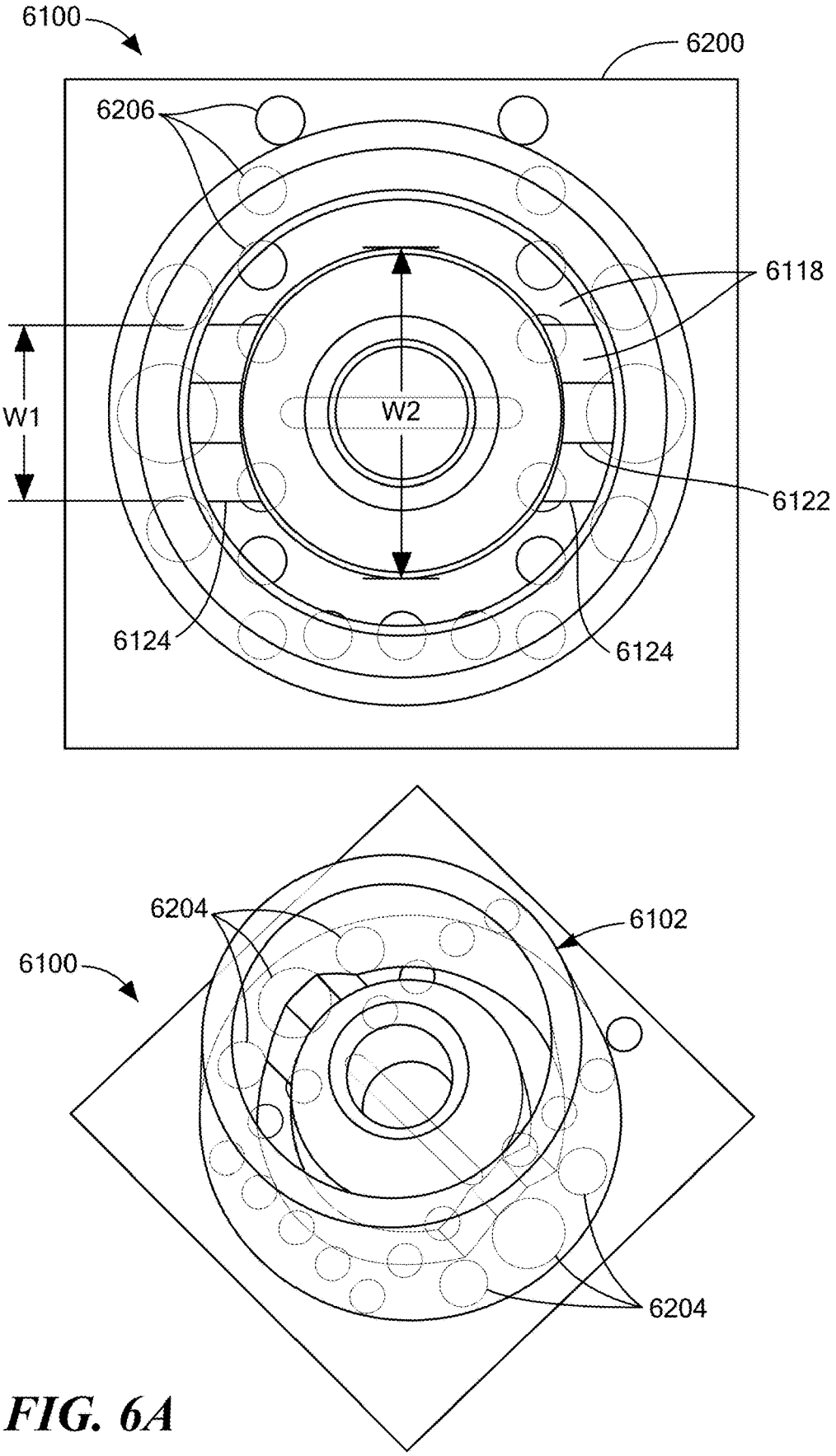
FIG. 6A depicts corresponding transparent plan and rotated isometric views of an EM device alternative to that of FIG. 2, but related to FIGS. 1A-1C, in accordance with an embodiment.
Figure 6B:
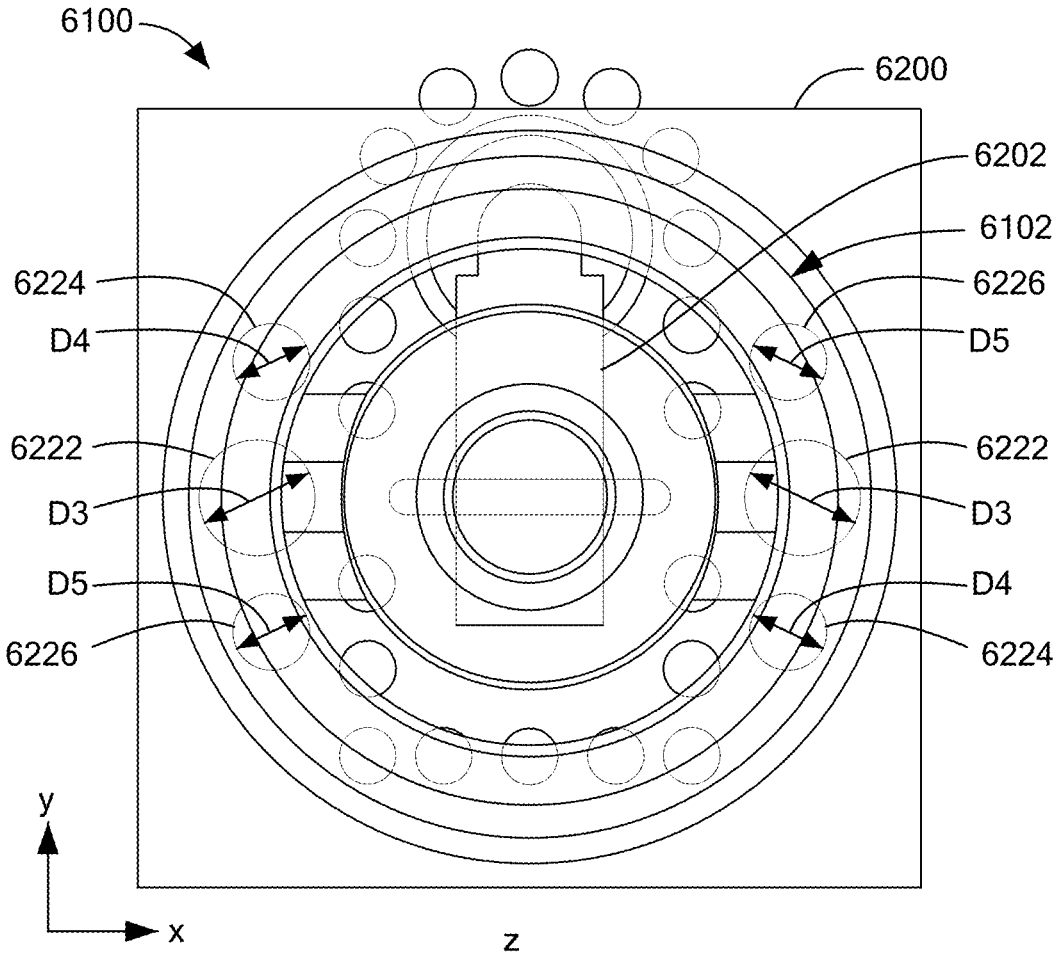
FIG. 6B depicts corresponding transparent plan and rotated isometric views of a form of the EM device of FIG. 6A, in accordance with an embodiment.
Figure 6B:
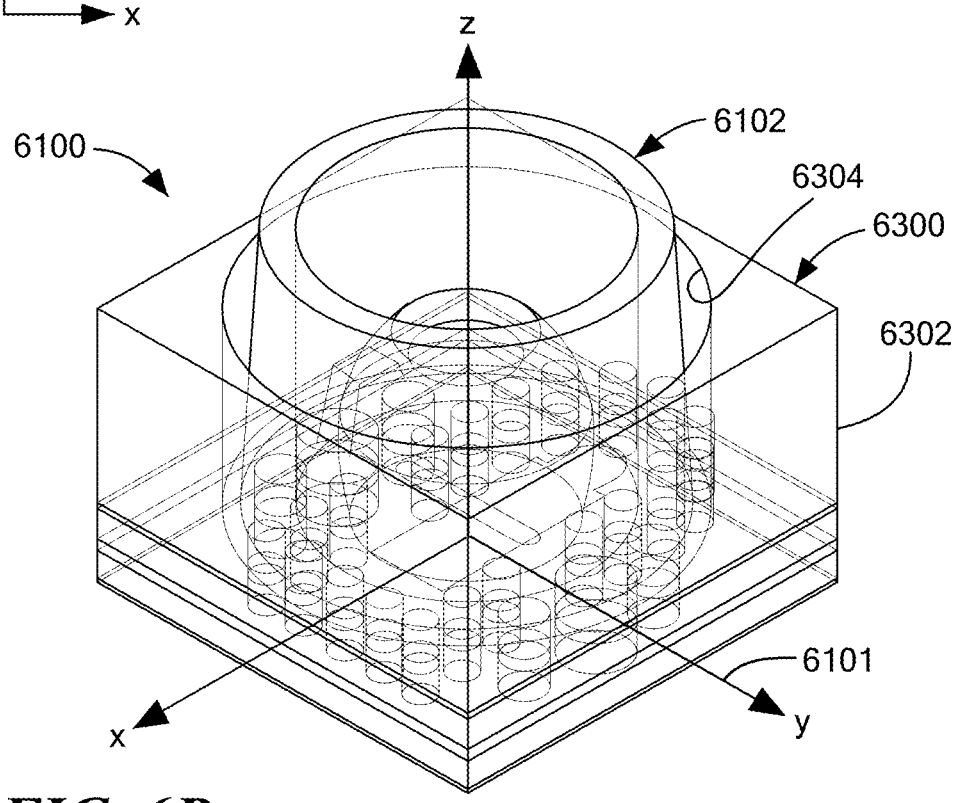
Figure 6C:
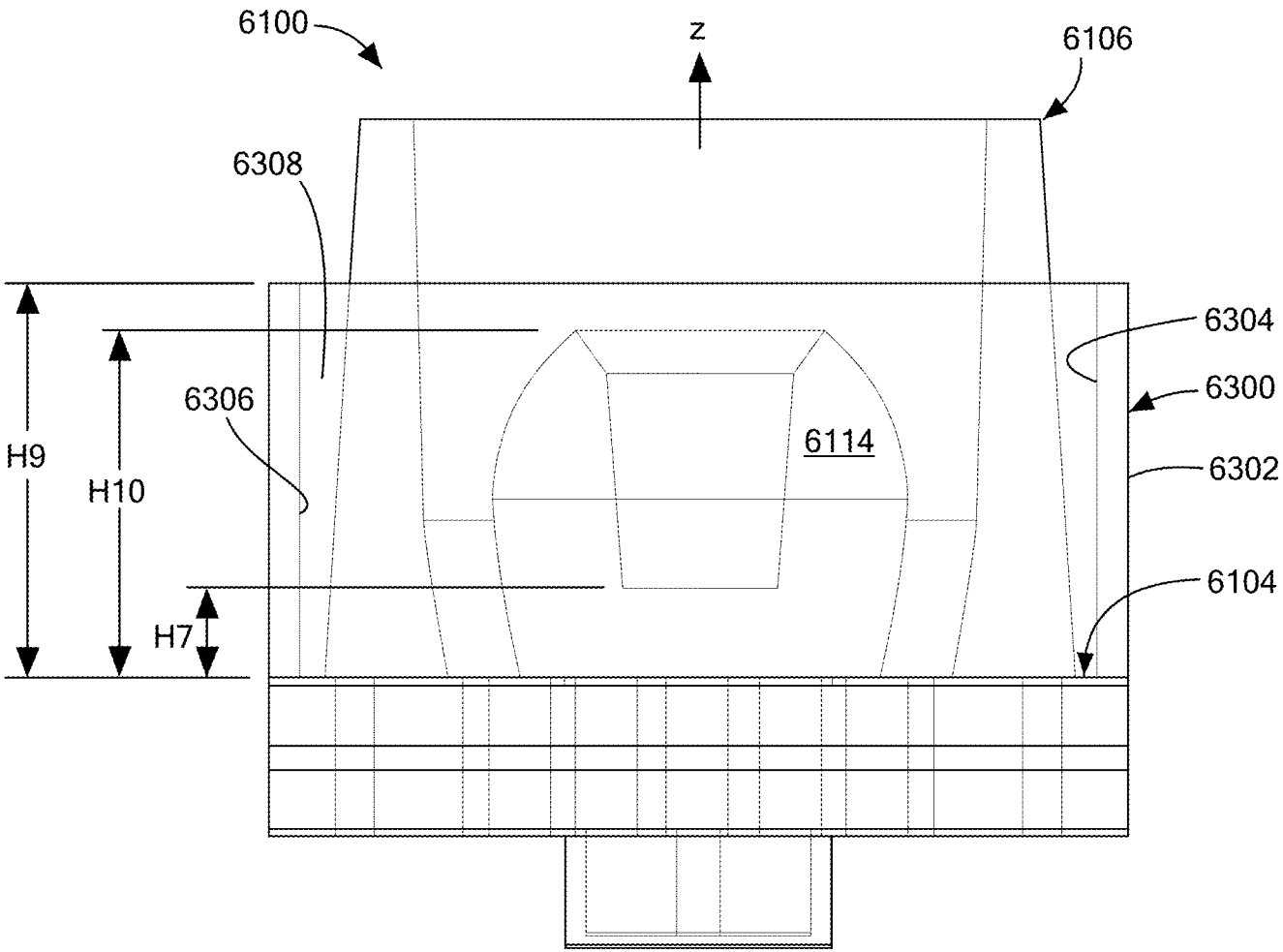
FIG. 6C depicts a transparent cross section elevation view of another form of the EM device of FIG. 6A, in accordance with an embodiment.
Figure 6D:
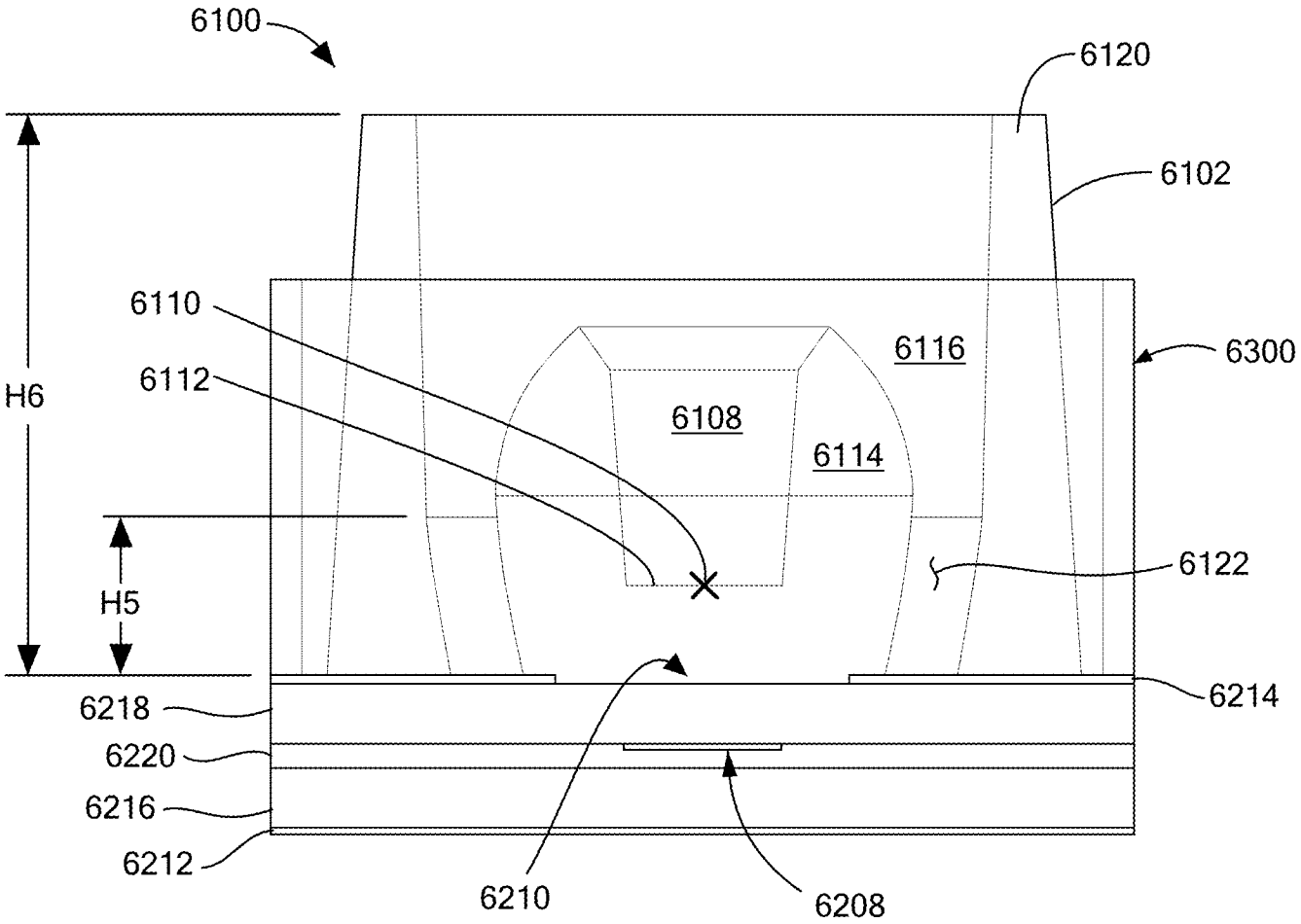
FIG. 6D depicts a transparent cross section elevation view of another form of the EM device of FIG. 6A, in accordance with an embodiment.

In an embodiment and with particular reference now to FIGS. 6A, 6B, and 6D, the base substrate 6200 includes an electrically conductive lower layer 6212 that provides an electrical ground reference potential, an electrically conductive upper layer 6214 that is electrically connected to the ground reference potential, and at least one dielectric substrate 6216, 6218 disposed between the lower 6212 and upper 6214 electrically conductive layers; and the proximal end 6104 of the 3D body 6102 is disposed on the upper layer 6214.

In an embodiment, the aforementioned at least one dielectric substrate includes a first dielectric substrate 6216 disposed adjacent an upper surface of the electrically conductive lower layer 6212, and a second dielectric substrate 6218 disposed adjacent a lower surface of the electrically conductive upper layer 6214; and the base substrate 6200 further includes a thin film adhesive bondply 6220 disposed between and affixed to the first 6216 and second 6218 dielectric substrates, wherein the stripline 6208 is disposed between the thin film adhesive 6220 and the second dielectric substrate 6218 below and orthogonal to the slotted aperture 6210.

In an embodiment, the 3D body 6102 has: a first region 6108 toward the center 6110 of the 3D body 6102 made from a dielectric material having a first average dielectric constant (Dk1-6100), the first region 6108 extending at least partially to the distal end 6106 of the 3D body 6102 from a first base structure 6112 proximate the proximal end 6104 of the 3D body 6102; the 3D body 6102 has a second region 6114 disposed radially outboard of the first region 6108 made from a dielectric material other than air having a second average dielectric constant (Dk2-6100) that is greater than the first average dielectric constant, the second region 6114 extending at least partially to the distal end 6106 of the 3D body 6102 from the proximal end 6104 of the 3D body 6102; the 3D body has a third region 6116 disposed radially outboard of the second region 6114 made from a dielectric material having a third average dielectric constant (Dk3-6100) that is less than the second average dielectric constant, the third region 6116 extending to the distal end 6106 of the 3D body 6102 from a second base structure 6118 proximate the proximal end 6104 of the 3D body 6102; the 3D body 6102 has a fourth region 6120 disposed radially outboard of the third region 6116 made from a dielectric material having a fourth average dielectric constant (Dk4-6100) that is greater than the third average dielectric constant, the fourth region 6120 extending to the distal end 6106 of the 3D body 6102 from the proximal end 6104 of the 3D body 6102; wherein the second base structure 6118 includes a relatively thin connecting structure 6122, disposed at the proximal end 6104 of the 3D body 6102, that is integrally formed with and bridges between the second region 6114 and the fourth region 6120, such that the second region 6114, the fourth region 6120, and the relatively thin connecting structure 6122, are integrally formed with each other to form a portion of the aforementioned monolithic of the EM device 6100, the relatively thin connecting structure 6122 having an overall height, H5, as observed in an elevation view of the EM device 6100, that is less than 30% of an overall height, H6, of the 3D body 6102; and wherein the second base structure 6118 in the third region 6116 is absent dielectric material of the monolithic except for the relatively thin connecting structure 6122.

In an embodiment and as observed in an elevation view of the EM device 6100, the first base structure 6112 of the first region 6108 has a thickness, H7, and is integrally formed and monolithic with the second region 6114. In an embodiment, H7 is equal to or less than 0.015 inches.

In an embodiment, the slotted aperture 6210 is completely covered by the first base structure 6112 of the first region 6108 and the second region 6114 of the 3D body 6102.

In an embodiment, the relatively thin connecting structure 6122 has at least two arms 6124 that bridge between the second region 6114 and the fourth region 6120. In an embodiment and as observed in a plan view of the EM device 6100, the relatively thin connecting structure 6122 has an overall width, W1, that is less than an overall width, W2, of the second region 6114.

In an embodiment, the 3D body 6102 is anchored to the base substrate by way of the dielectric material of the 3D body 6102 at least partially filling and being integral with the first plurality of vias 6204.

In an embodiment as observed in a plan view or an x-y plane cross-section of the EM device 6100 and with particular reference to FIGS. 6A and 6B, the first plurality of vias 6204 includes: a first pair of diametrically opposed vias 6222 having an overall width dimension, D3; a second pair of diametrically opposed vias 6224 having an overall width dimension, D4; and a third pair of diametrically opposed vias 6226 having an overall width dimension, D5. In an embodiment, D4 is less than D3, and D5 is equal to D4. In an embodiment, dimensions D3, D4, and D5, are diameter dimensions.

In an embodiment and with particular reference to FIGS. 6B, 6C, and 6D, the EM device 6100 further includes: an electromagnetically reflective structure 6300 having an electrically conductive structure 6302 and an electrically conductive electromagnetic reflector 6304 that is integrally formed with or is in electrical communication with the electrically conductive structure 6302; wherein the electromagnetically reflective structure 6300 is disposed on or is in electrical communication with the upper electrically conductive layer 6214; wherein the electrically conductive electromagnetic reflector 6304 forms a wall 6306 that defines and at least partially circumscribes or surrounds a recess 6308, as observed in a plan view of the EM device 6100; wherein the 3D body 6102 is disposed within the recess 6308. In an embodiment as observed in an elevation view of the EM device 6100, the wall 6306 of the reflector 6304 has a height, H9, that is greater than a height, H10, of the second region 6114.

Figure 6E:
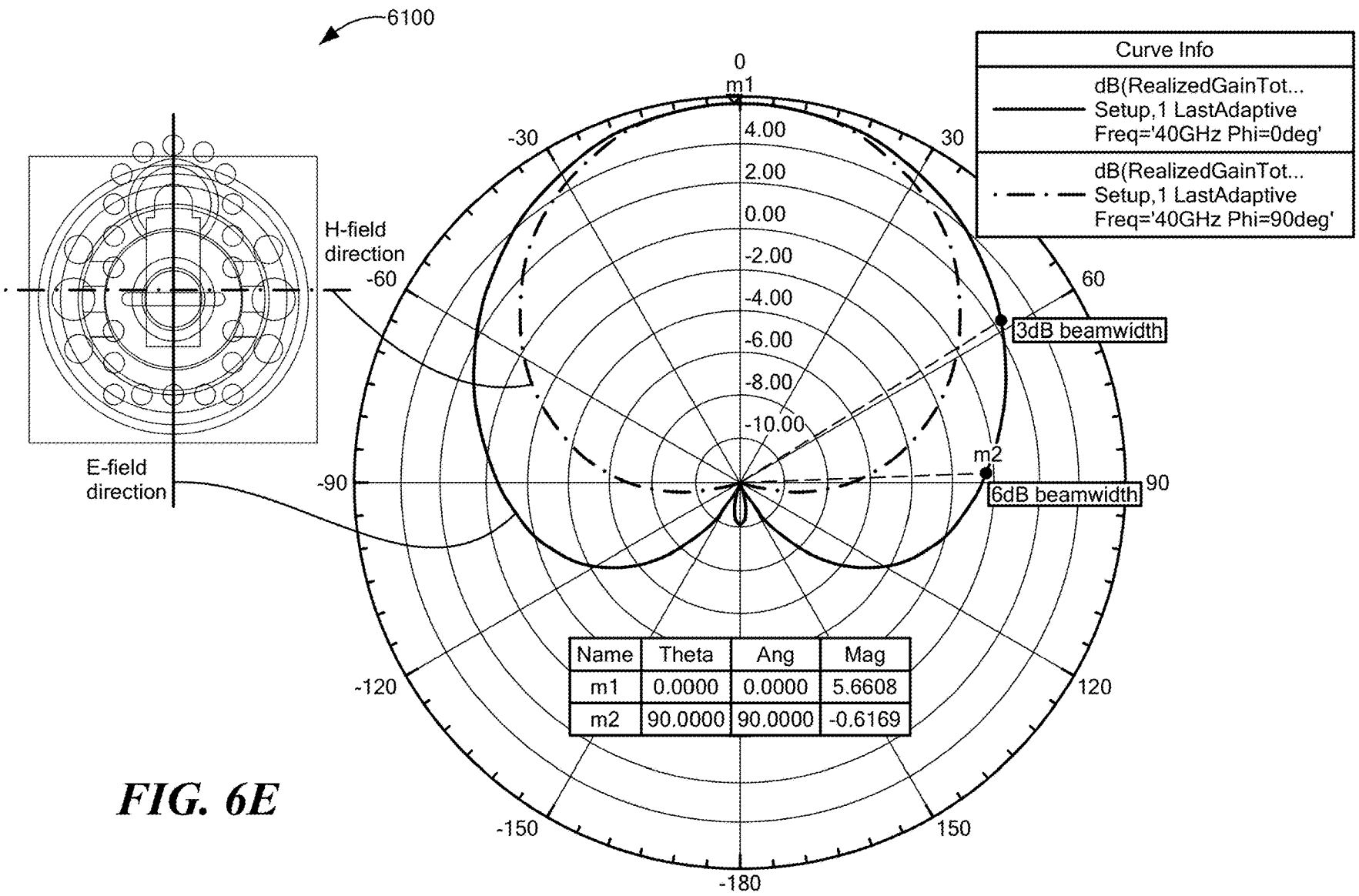
FIGS. 6E, 6F, 6G, and 6H, depict analytical modeling performance characteristics of a unit cell of the EM device of FIG. 6B, in accordance with an embodiment.
Figure 6F:
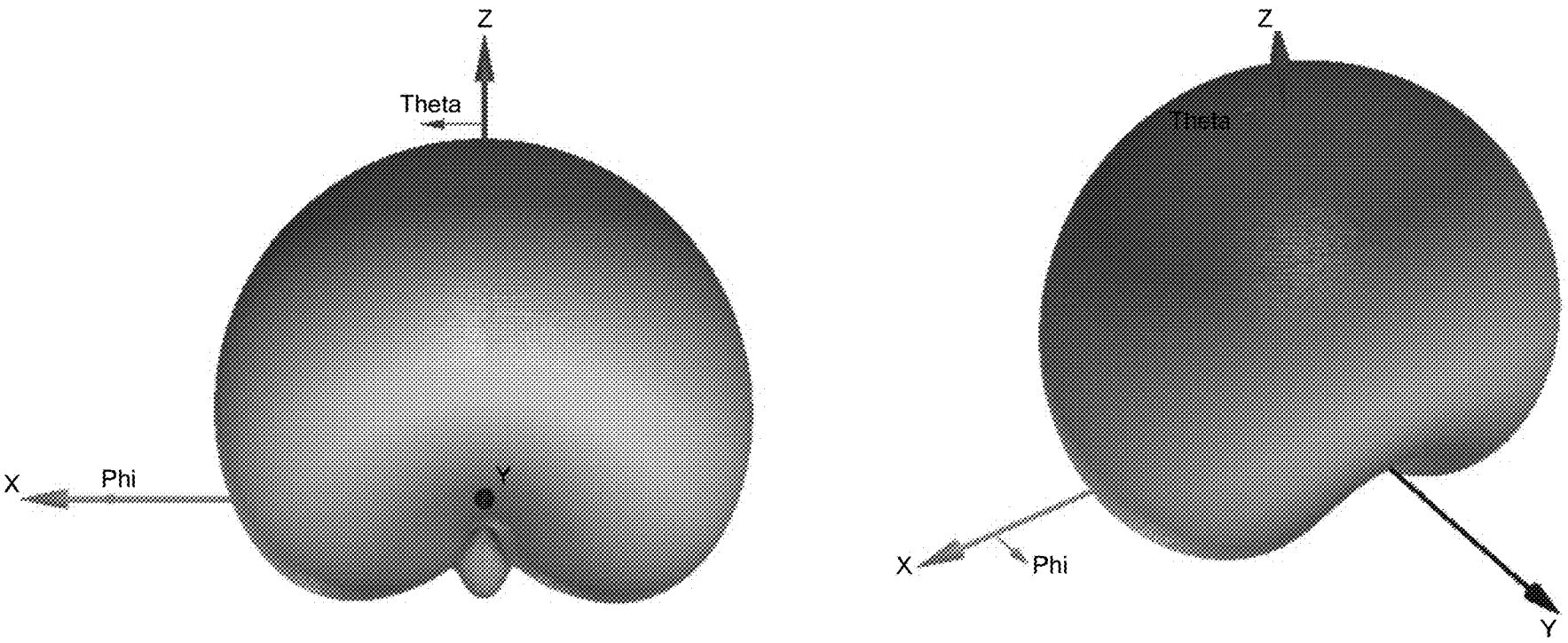

In an embodiment with particular reference to FIG. 6E, and in response to a 40 GHz electrical signal being present on the signal feed 6202, the 3D body 6102 radiates an EM field having a wide field of view, FOV, into the far field with the following characteristics: a gain profile that includes a 3 dBi beamwidth of equal to or greater than +/−60-degrees in the E-field direction (see FIG. 6E); a gain profile that includes a 3 dBi beamwidth of equal to or greater than +/−45-degrees in the H-field direction; a gain profile that includes a 6 dBi beamwidth of equal to or greater than +/−90-degrees in the E-field direction; and a gain profile that includes a 6 dBi beamwidth of equal to or greater than +/−60-degrees in the H-field direction.

Figure 6G:
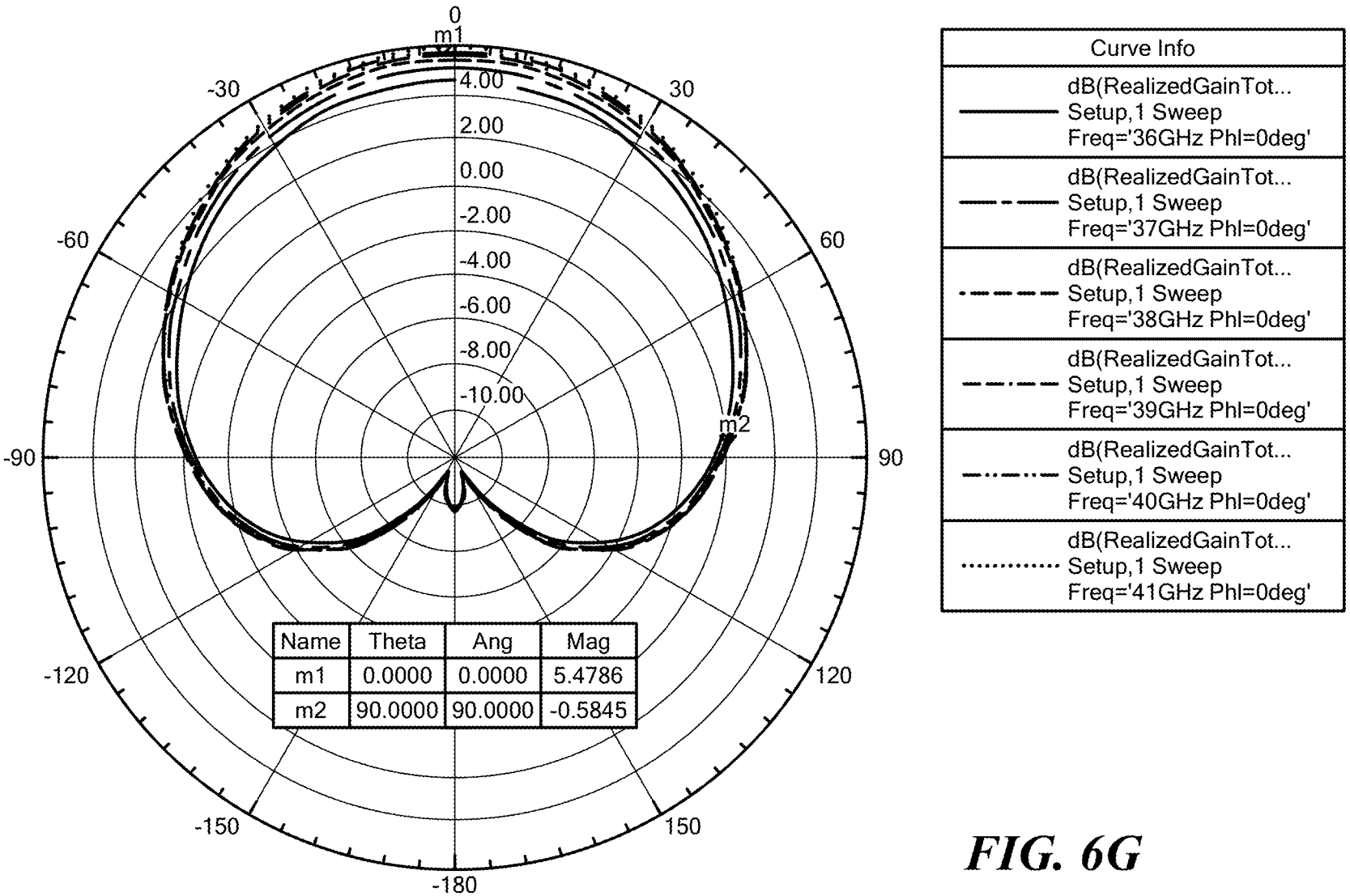
Figure 6H:
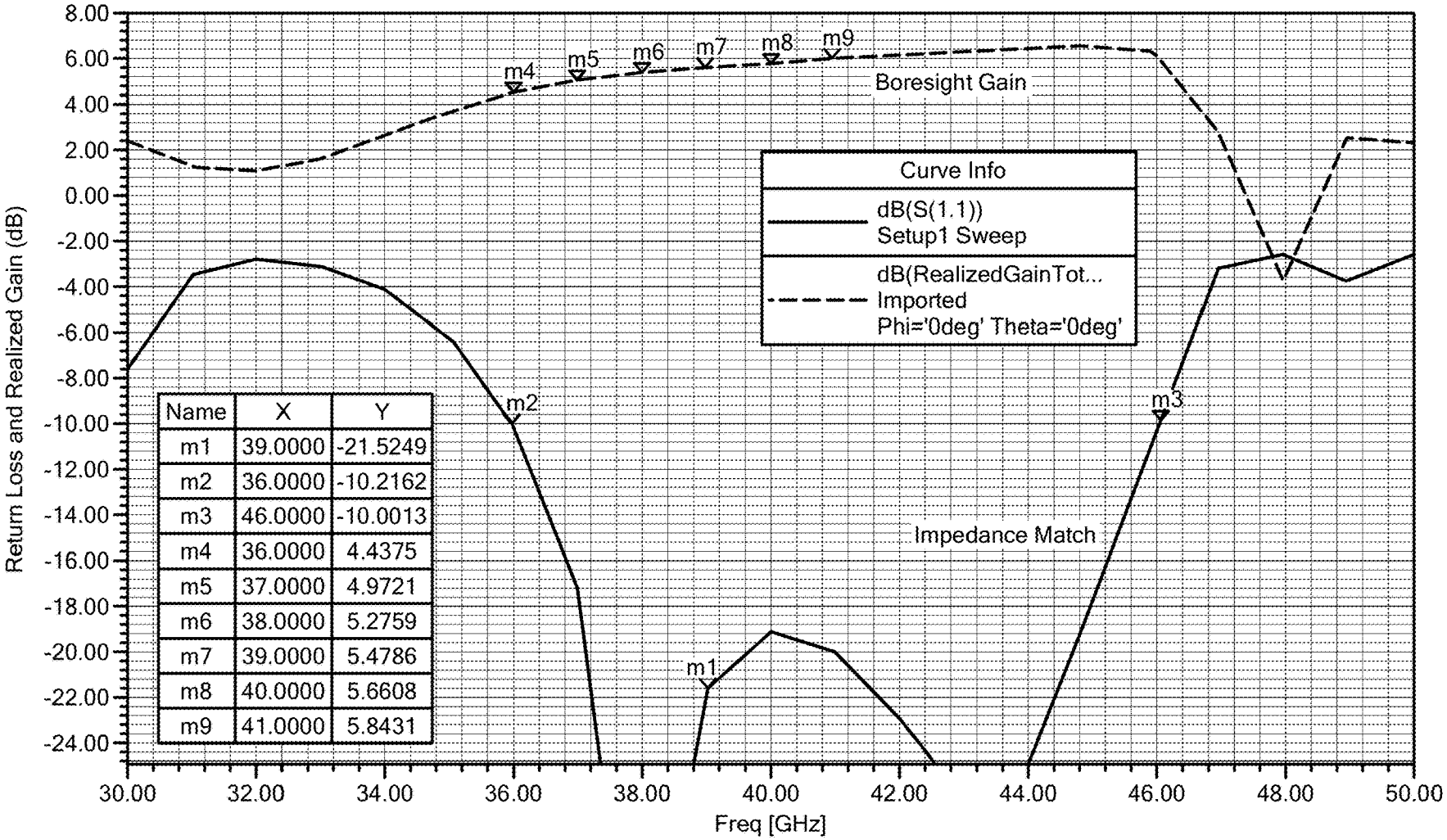

In an embodiment with particular reference to FIGS. 6G and 6H, and in response to a particular GHz electrical signal being present on the signal feed 6202, the 3D body 6102 radiates an EM field into the far field with the following characteristics: a boresight gain of about 4.4 dBi at 36 GHz to about 5.8 dBi at 41 GHz, with a resulting bandwidth greater than 10%. In an embodiment, and in response to a particular GHz electrical signal being present on the signal feed 6202, the 3D body 6102 radiates an EM field into the far field with the following characteristics: a boresight gain of about 4.4 dBi at 36 GHz to about 6 dBi at 46 GHz, with a resulting relatively flat gain and a bandwidth greater than 20%.

Figure 6I:
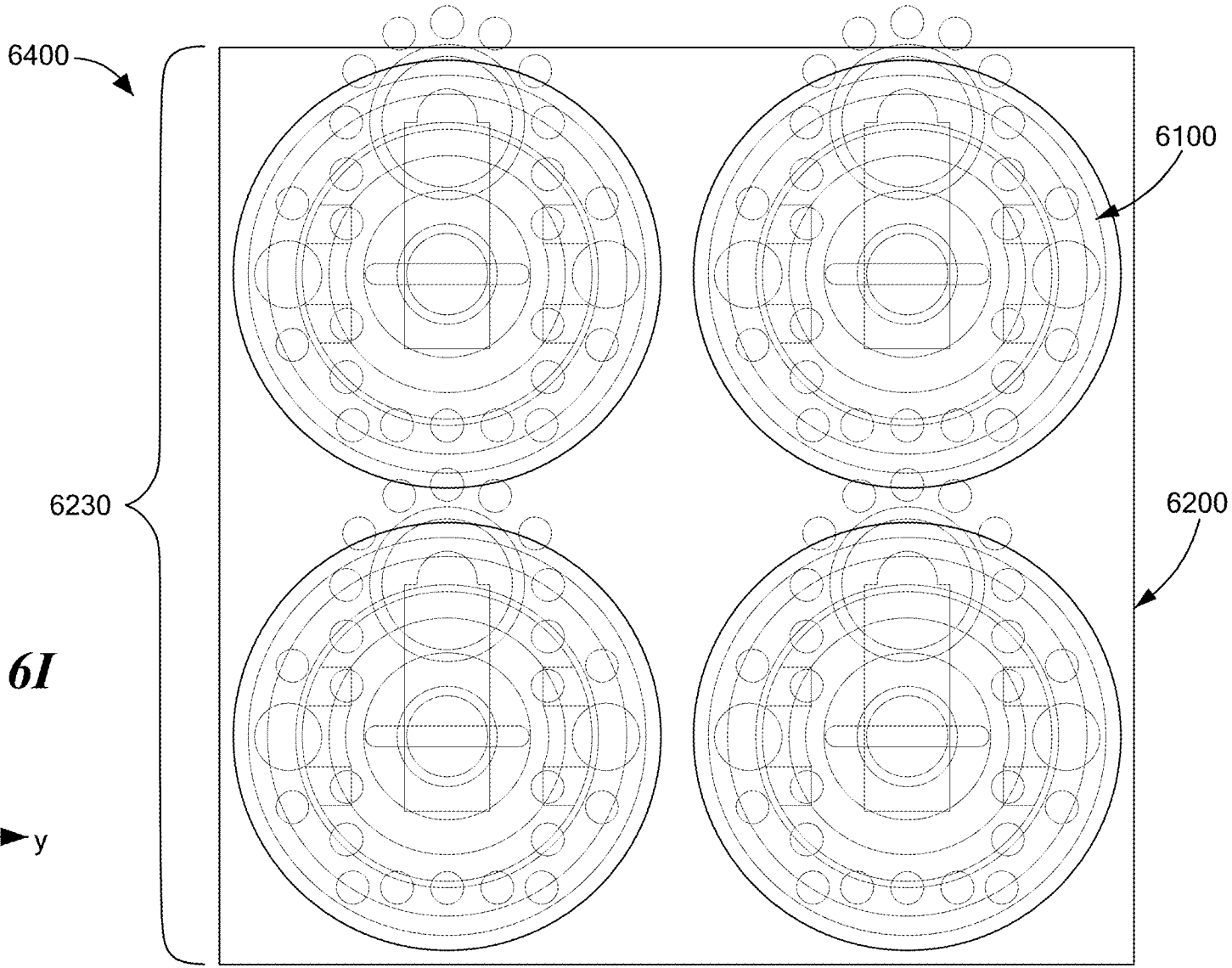
FIG. 6I depicts a transparent plan view of an array of the EM device of FIG. 6B, in accordance with an embodiment.
Figure 6J:
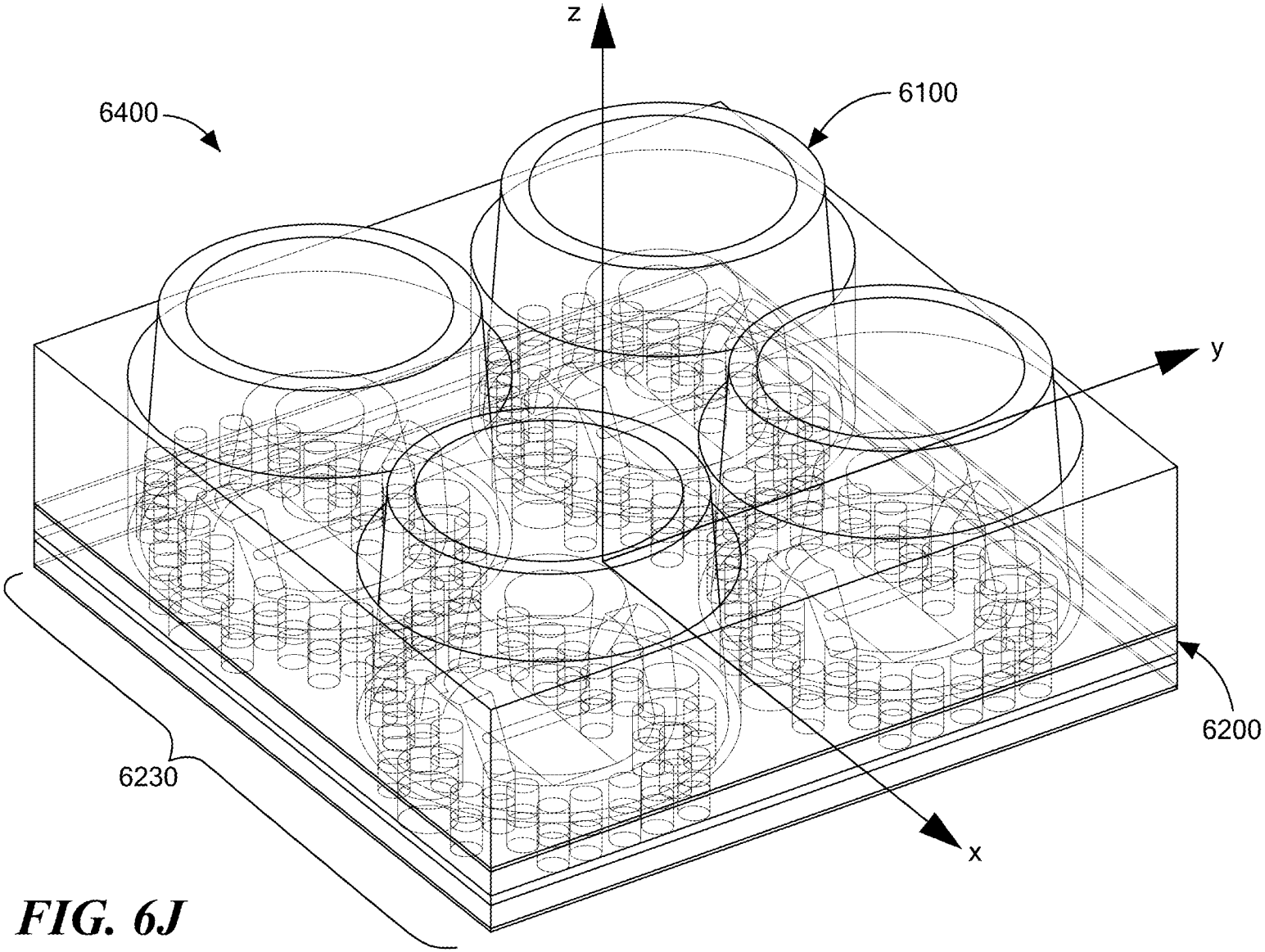
FIG. 6J depicts a transparent rotated isometric view of an array of the EM device of FIG. 6B, in accordance with an embodiment.

In an embodiment and with particular reference to FIGS. 6I and 6J, an array 6400 of the EM device 6100 is operational at an operating frequency and associated wavelength, wherein: the array 6400 comprises a plurality of the EM devices 6100 disposed in a side by side arrangement wherein the base substrate 6200 of each EM device 6100 is a contiguous extension of a neighboring base substrate 6200 to form an aggregate base substrate 6230, wherein each EM device 6100 has a discrete signal feed 6202 (see FIG. 6B) relative to an adjacent one of the plurality of EM devices 6100, and wherein each discrete signal feed 6202 is configured to electromagnetically excite a corresponding 3D body 6100 to radiate an EM field into the far field when a particular electrical signal is present on the associated signal feed 6202.

In an embodiment, a method of making the EM device 6100 includes: molding the 3D body 6102 onto a topside of the base substrate 6200 by injection molding a moldable dielectric medium through the first plurality of vias 6204 from an underside or backside of the base substrate 6200; and at least partially curing the dielectric medium.

The following description of an example antenna subsystem 7000 is made with particular reference to FIGS. 7A, 7B, 7C, and 7D, collectively, and in view of other figures and structures disclosed herein. The orthogonal set of x-y-z axes 7101 depicted in FIGS. 7A-7D, are for illustration purposes, and establishes the 3D arrangement of the various features of the EM device 7100 relative to each other.

In an embodiment, the example antenna subsystem 7000 for a steerable array of EM devices 7100 (such as any EM device 1100, 2100, 3100, 4100, 5100, 6100 disclosed herein) includes: a plurality of the EM devices 7100, each EM device 7100 of the plurality of EM devices 7100 having a wide FOV DRA 7150 arranged and disposed on a surface 7002 (see FIG. 7B); a subsystem board 7010 having, for each EM device 7100 of the plurality of EM devices 7100, a signal feed structure 7202 (see FIG. 7A); the plurality of EM devices 7100 being affixed to the subsystem board 7010.

In an embodiment, each DRA 7150 has a 3D body 7102 (see other 3D bodies disclosed herein) having a first region (see 1108, FIG. 1C, for example) toward the center of the 3D body 7102 made from a dielectric material having a first average dielectric constant (Dk1-7100), the first region extending to the distal end of the 3D body; and the 3D body 7102 has a second region (see 1112, FIG. 1C, for example) disposed radially outboard of the first region made from a dielectric material other than air having a second average dielectric constant (Dk2-7100) that is greater than the first average dielectric constant, the second region extending from the proximal end to the distal end of the 3D body.

In an embodiment, the plurality of EM devices 7100 are arranged in an x-by-y array. In an embodiment, the DRAs 7150 are arranged on a two-dimensional, 2D, surface. In an embodiment, the signal feed structure 7202 includes a signal line having a signal input end 7204. In an embodiment, the subsystem board 7010 further includes, for each EM device 7100, a signal communication path 7012 having an input port 7014 disposed at one end thereof, the other opposing end of the signal communication path 7012 being electrically connected to the signal input end 7204 of a corresponding signal feed structure 7202. In an embodiment, each input port 7014 of the subsystem board 7010 is connectable to an EM beam steering subsystem 7500 (see FIG. 7D).

Figure 7A:
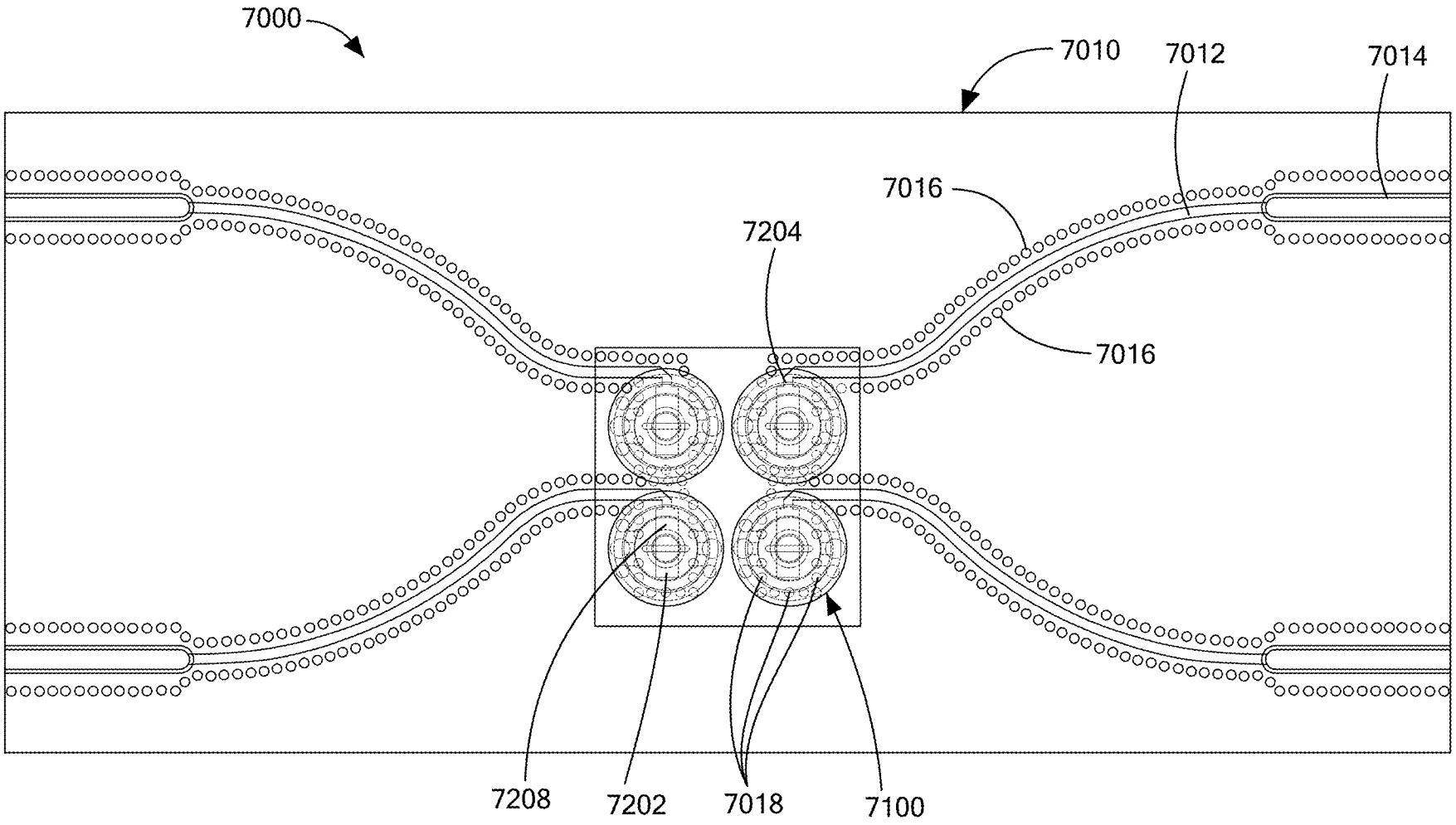
FIG. 7A depicts a transparent plan view of an antenna subsystem for a steerable array of an EM device, in accordance with an embodiment.
Figure 7B:
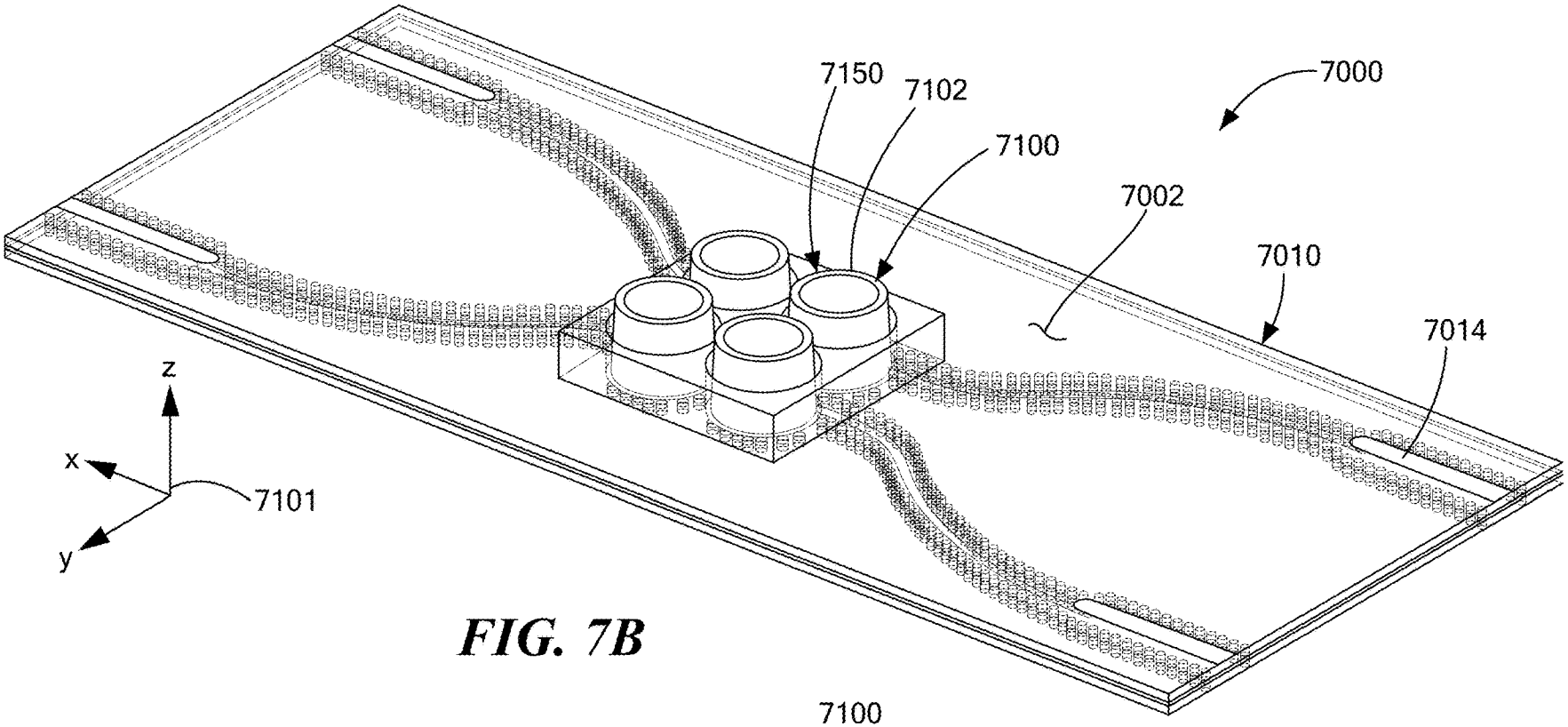
FIG. 7B depicts a transparent rotated isometric view of the array of FIG. 7A, in accordance with an embodiment.
Figure 7C:
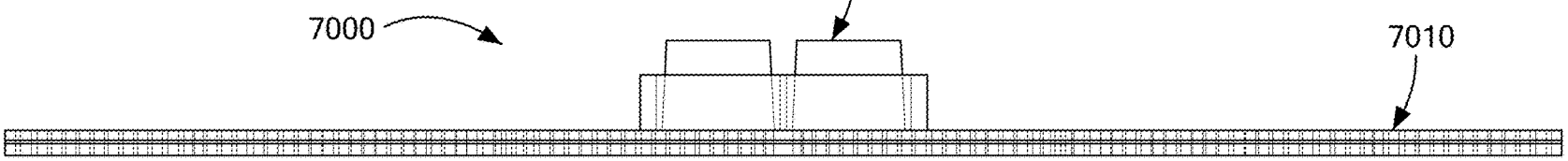
FIG. 7C depicts a transparent side elevation view of the array of FIG. 7A, in accordance with an embodiment.
Figure 7D:
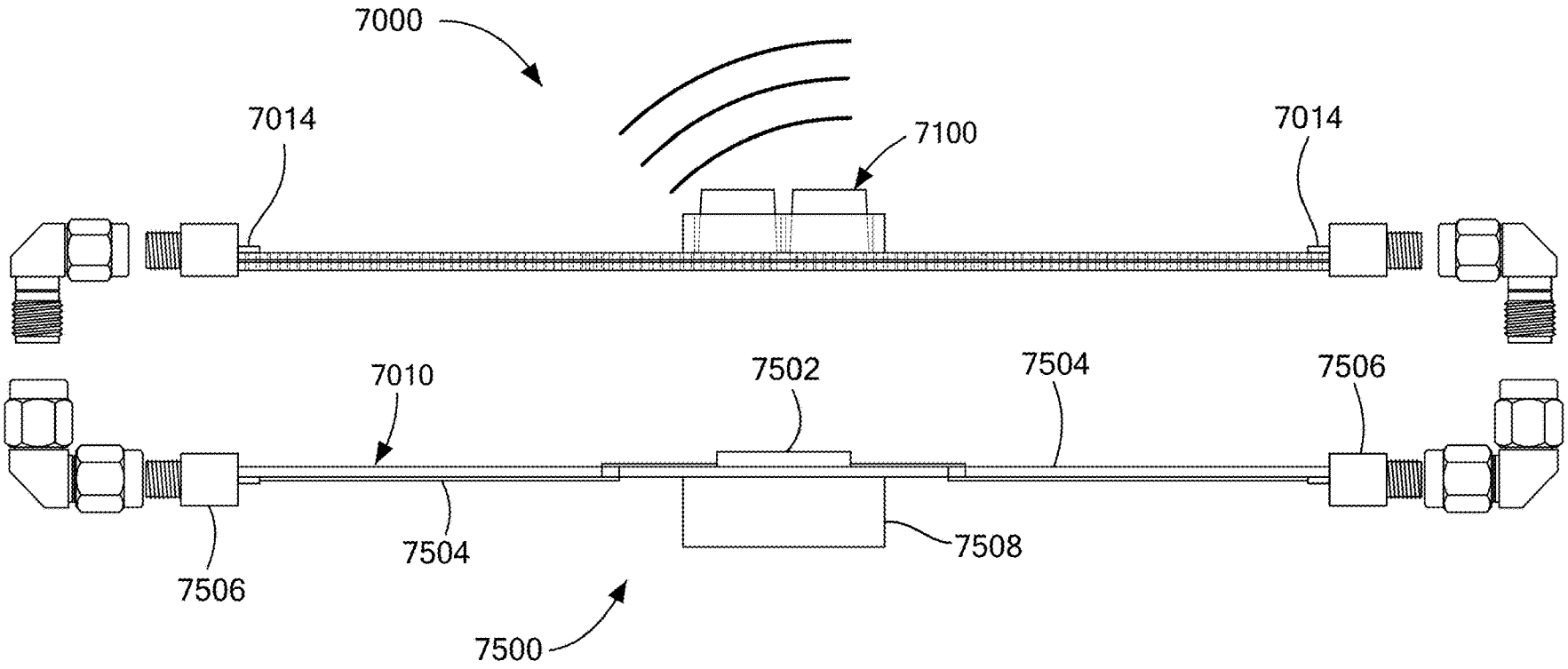
FIG. 7D depicts a transparent side elevation view of the antenna subsystem of FIGS. 7A, 7B, and 7C, with an EM beam steering subsystem coupled thereto, in accordance with an embodiment.

In an embodiment with particular reference to FIG. 7D, an EM beam steering subsystem 7500 includes an EM beam steering chip 7502 connected to a number of signal communication channels 7504, each signal communication channel 7504 associated with the EM beam steering chip 7502 having a corresponding output end 7506, the number of signal communication channels 7504 and output ends 7506 being equal in number to the plurality of EM devices

7100 depicted in FIGS. 7A and 7B; wherein each output end 7506 of a corresponding signal communication channel 7504 of the EM beam steering subsystem 7500 is connected to a corresponding input port 7014 of the subsystem board 7010 of the antenna subsystem 7000. In an embodiment, the beam steering chip 7502 is disposed in thermal communication with a heat sink 7508 disposed below the subsystem board 7010, which may also be configured to provide a phase shift and/or time delay to the beam steering function.

In an embodiment with particular reference to FIG. 7A, the subsystem board 7010 further includes a plurality of sets of non-conductive vias (see 6204, FIG. 6A, for example) that extend therethrough, each set of the non-conductive vias being associated with a different one of the plurality of EM devices 7100; each 3D body 7102 of a corresponding EM device 7100 is made from a dielectric material comprised of a medium other than air, each 3D body 7102 having a proximal end and a distal end (see 6104 and 6106, FIG. 6C, for example), the proximal end of each 3D body 7102 being disposed on the subsystem board 7010 so that each 3D body 7102 at least partially or completely covers a corresponding set of the non-conductive vias; and the plurality of sets of non-conductive vias are at least partially filled with the dielectric material of the associated 3D body 7102, such that each 3D body 7102 and the dielectric material of the corresponding set of non-conductive at least partially filled vias form a monolithic (see aforementioned description relating to EM device 6100). In an embodiment, the 3D body 7102 completely covers the corresponding set of the non-conductive vias. In an embodiment, the plurality of sets of non-conductive vias are completely filled with the dielectric material of the associated 3D body 7102. In an embodiment, the plurality of sets of non-conductive vias extend between the lower electrically conductive layer and the upper electrically conductive layer.

In an embodiment, the subsystem board 7010 further includes: an electrically conductive lower layer, an electrically conductive upper layer, a first dielectric substrate disposed adjacent an upper surface of the electrically conductive lower layer, a second dielectric substrate disposed adjacent a lower surface of the electrically conductive upper layer, and a thin film adhesive disposed between and affixed to the first and second dielectric substrates (see 6212, 6214, 6216, 6218, 6220, FIG. 6D, for example).

In an embodiment and with reference also to FIG. 6D, the signal feed structure 7202 further includes: a stripline 7208 (see also 6208, FIG. 6D, for example) disposed between the thin film adhesive 6220 and the second dielectric substrate 6218, the electrically conductive upper layer 6214 having a slotted aperture (see 6210, FIG. 6D, for example) disposed over and orthogonal to the corresponding stripline 7208 (see also 6208, FIG. 6D), each stripline 7208 having the signal input end 7204, each slotted aperture being completely covered by the 3D body 7102 (see also 6102, FIG. 6D) of the corresponding EM device 7100, the proximal end of the 3D body 7102 being disposed on the electrically conductive upper layer.

In an embodiment, similar to the stripline 7208, the signal communication path 7012 of the subsystem board 7010 is disposed between the thin film adhesive and the second dielectric substrate, the signal communication path 7012 having the input port 7014 disposed at one end thereof, the other opposing end of the signal communication path being electrically connected to the signal input end 7204 of a corresponding stripline 7208.

In an embodiment, the subsystem board 7010 further includes a first plurality of electrically conductive vias 7016 that connect the upper electrically conductive layer to the lower electrically conductive layer, the first plurality of electrically conductive vias 7016 being disposed on each side of respective ones of the plurality of signal communication paths 7012, which serve to provide an electrically conductive wall adjacent a corresponding signal communication path 7012.

In an embodiment, the substrate board 7010 further includes a second plurality of electrically conductive vias 7018 that connect the upper electrically conductive layer to the lower electrically conductive layer, the second plurality of electrically conductive vias 7018 being disposed on each side of, and at an end of, respective ones of the striplines 7208, which serve to provide an electrically conductive wall adjacent a corresponding signal feed structure 7202.

The following description of an example antenna subsystem 8000 is made with particular reference to FIGS. 8A, 8B, 8C, 8D, 8E, and 8F, collectively, and in view of other figures and structures disclosed herein. The orthogonal set of x-y-z axes 8101 depicted in FIGS. 8A-8D, are for illustration purposes, and establishes the 3D arrangement of the various features of the EM device 8100 relative to each other.

In an embodiment, the example antenna subsystem 8000 for a steerable array of EM devices 8100 (such as any EM device 1100, 2100, 3100, 4100, 5100, 6100 disclosed herein) includes: a plurality of the EM devices 8100, each EM device 8100 of the plurality of EM devices 8100 having a wide FOV DRA 8150 arranged and disposed on a surface 8002, each EM device 8100 of the plurality of EM devices 8100 further having a base substrate 8200, each base substrate 8200 comprising a signal feed structure 8202 disposed in EM signal communication with a corresponding DRA 8150; wherein the base substrate 8200 of each EM device 8100 is a contiguous extension of a neighboring base substrate 8200 to form an aggregate base substrate 8230, the DRAs 8150 being affixed to the aggregate base substrate 8230; wherein the aggregate base substrate 8230 includes a plurality of input ports 8204 equal in number to the number of DRAs 8150, each input port 8204 being electrically connected to a corresponding signal feed structure 8202 that is in signal communication with a corresponding DRA 8150; the antenna subsystem 8000 providing a structure suitable for an arrangement of the EM devices 8100 to any arrangement size formable from multiple ones of the antenna subsystem 8000.

In an embodiment, each DRA 8150 has a 3D body 8102 (see other 3D bodies disclosed herein) having a first region (see 1108, FIG. 1C, for example) toward the center of the 3D body 8102 made from a dielectric material having a first average dielectric constant (Dk1-8100), the first region extending to the distal end of the 3D body 8102; and the 3D body 8102 has a second region (see 1112, FIG. 1C, for example) outboard of the first region made from a dielectric material other than air having a second average dielectric constant (Dk2-8100) that is greater than the first average dielectric constant, the second region extending from the proximal end to the distal end of the 3D body.

In an embodiment, the plurality of EM devices 8100 are arranged in an x-by-y array. In an embodiment, the DRAs 8150 are arranged on a two-dimensional, 2D, surface 8002.

In an embodiment, each input port 8204 of the plurality of input ports 8204 of the aggregate base substrate 8230 is a solder pad. In an embodiment, the plurality of input ports 8204 of the aggregate base substrate 8230 are connectable to an EM beam steering subsystem 8500.

In an embodiment, the antenna subsystem 8000 further includes: an EM beam steering subsystem 8500 having an EM beam steering chip 8502 connected to a plurality of signal communication channels 8504, each signal communication channel 8504 associated with the EM beam steering chip 8502 having a corresponding output port 8506; wherein each output port 8506 of the EM beam steering subsystem 8500 is connected to a corresponding input port 8204 of the aggregate base substrate 8230 of the antenna subsystem 8000.

In an embodiment, each base substrate 8200 includes (with reference to details depicted in FIG. 6D and described herein above): an electrically conductive lower layer 6212, an electrically conductive upper layer 6214, a first dielectric substrate 6216 disposed adjacent an upper surface of the electrically conductive lower layer 6212, and a second dielectric substrate 6218 disposed adjacent a lower surface of the electrically conductive upper layer 6214, and a thin film adhesive 6220 disposed between and affixed to the first and second dielectric substrates 6216, 6218, a stripline 6208 disposed between the thin film adhesive 6220 and the second dielectric substrate 6218, the electrically conductive upper layer 6214 having a slotted aperture 6210 disposed over and orthogonal to the stripline 6208, each slotted aperture 6210 being completely covered by the 3D body 8102 of the corresponding EM device 8100, and the proximal end of the 3D body 8102 being disposed on the electrically conductive upper layer 6214.

In an embodiment, each input port 8204 is electrically connected to a corresponding stripline 6208 that is in signal communication with an associated slotted aperture 6210 disposed underneath the 3D body 8102 of a given EM device 8100.

In an embodiment, an antenna array 8600 for a steerable array of EM devices 8100 includes a tiled plurality 8300 of the antenna subsystem 8000. In an embodiment, the antenna array 8600 having the tiled plurality of antenna subsystems 8000 is formable to a non-planar configuration. In an embodiment, the antenna array 8600 has an aggregate base substrate 8230 in the form of a flexible circuit board.

Figure 8A:
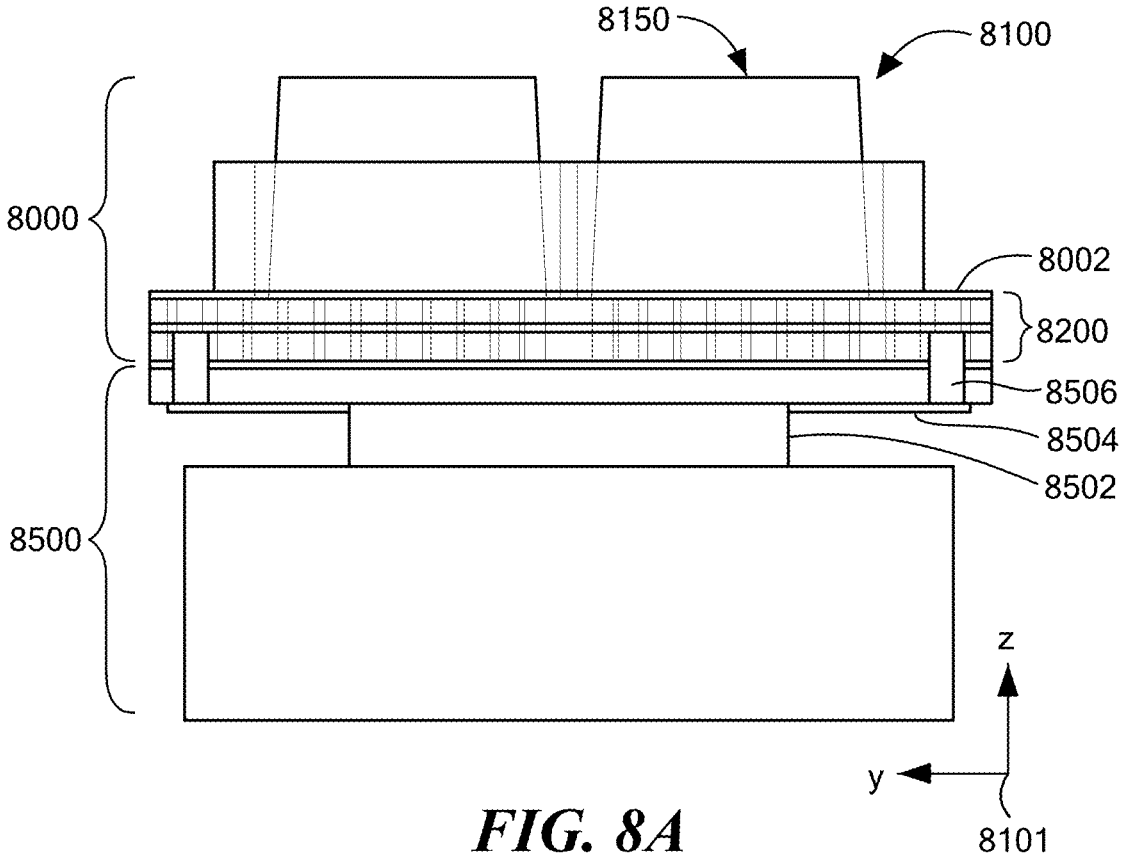
FIG. 8A depicts a transparent elevation view of an antenna subsystem for a steerable array of EM devices coupled to an EM beam steering subsystem, similar to that of FIG. 7B, in accordance with an embodiment.
Figure 8B:
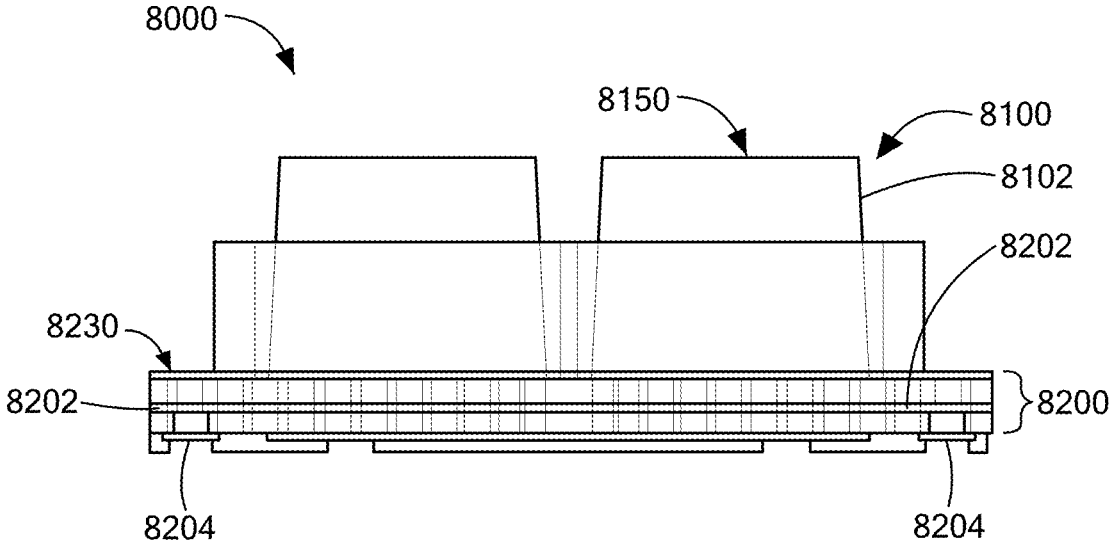
FIG. 8B depicts a transparent elevation view of the antenna subsystem of FIG. 8A, in accordance with an embodiment.
Figure 8C:
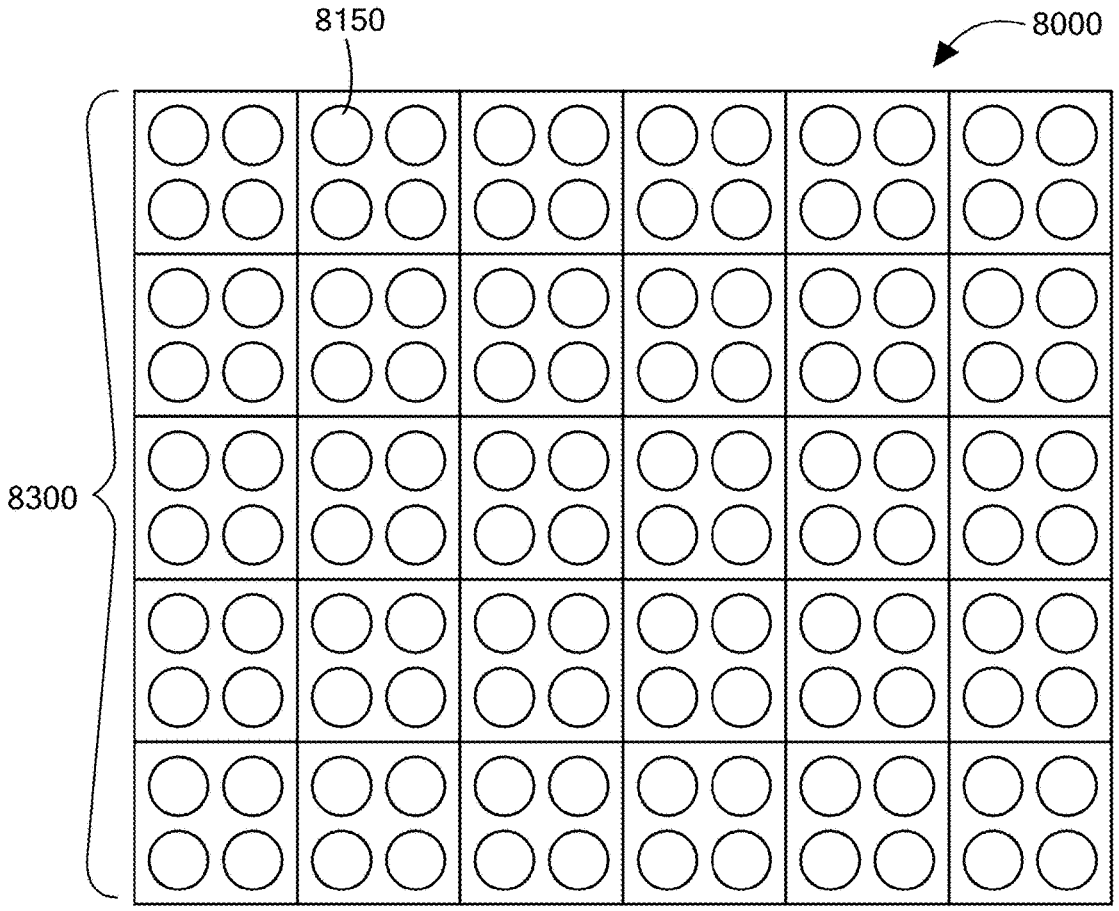
FIG. 8C depicts corresponding plan and transparent elevation views of a tiled planar array of the antenna subsystem of FIG. 8A, in accordance with an embodiment.
Figure 8C:
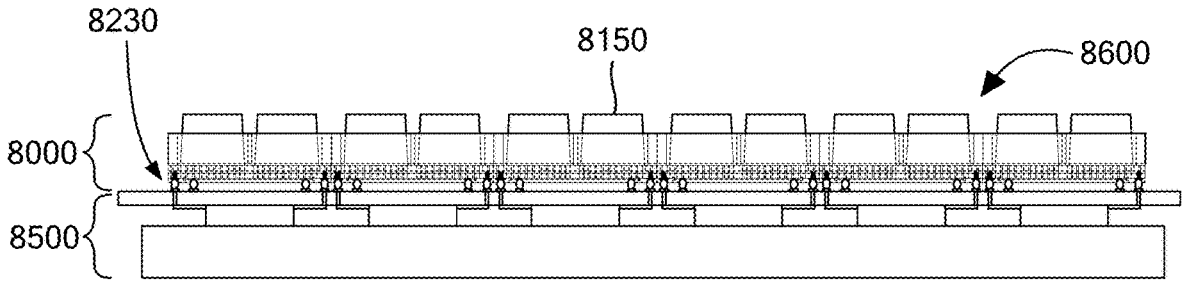
Figure 8D:
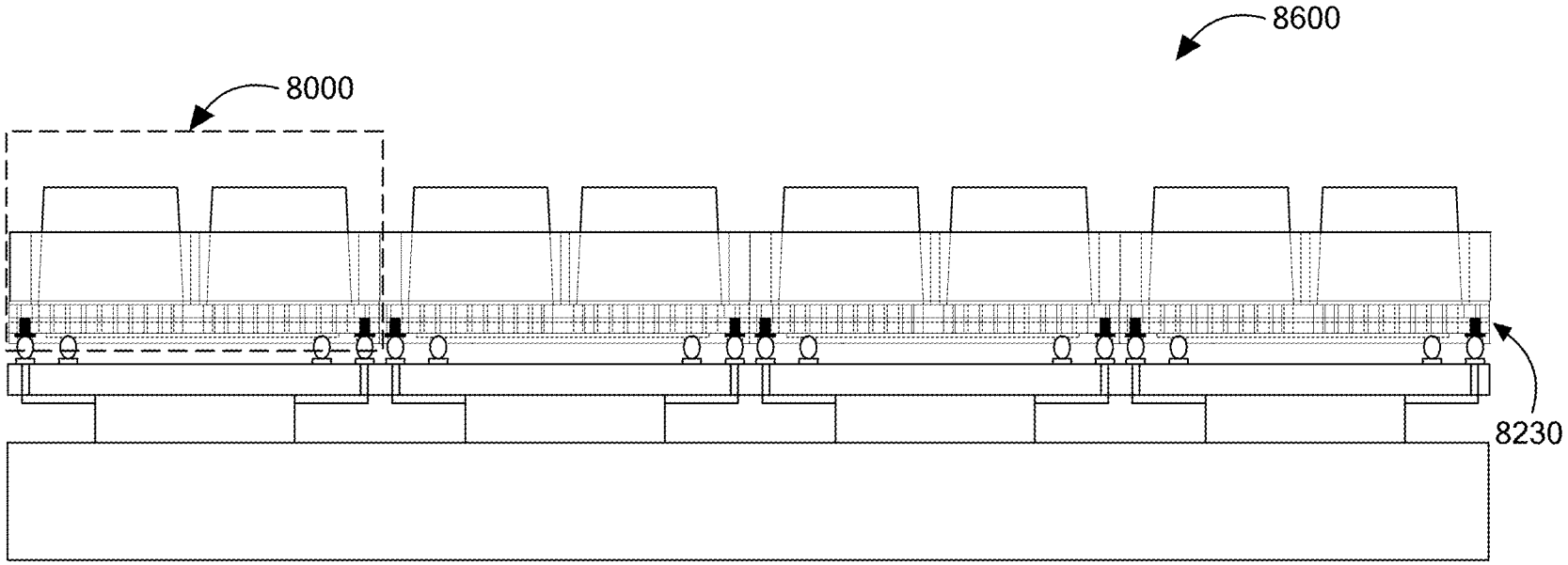
FIG. 8D depicts a transparent elevation view of the array of FIG. 8C, in accordance with an embodiment.
Figure 8E:
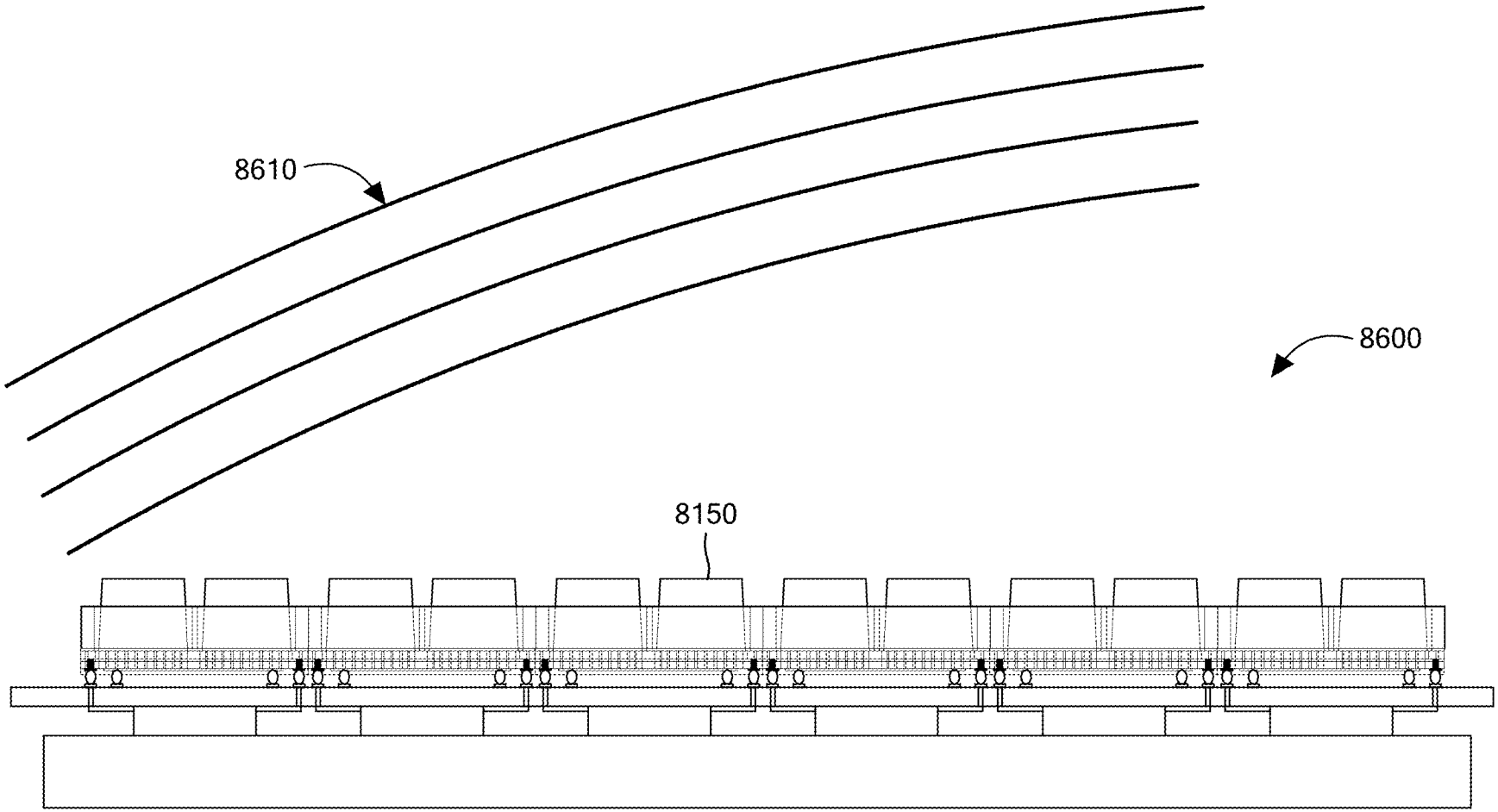
FIG. 8E depicts a transparent elevation view of the array of FIGS. 8C and 8D with a steerable electromagnetic beam illustrated, in accordance with an embodiment.

In an embodiment and as depicted in FIG. 8C, the antenna subsystem 8000 may comprise a tiled array 8300 having a 10×10 array of DRAs 8150, or a 5×5 array of tiled subsystems having a 2×2 array of DRAs 8150, which in an embodiment may be upwards of an 128×128 array of DRAs 8150, or a 64×64 array of tiled parts having a 2×2 array of DRAs 8150, or greater. FIG. 8E depicts a representation of a steerable antenna array 8600 having components depicted and described in connection with FIGS. 8A-8D that is productive of a steerable beam 8610, which in an embodiment is steerable in one-dimension or two-dimension, and may be configure to transmit, receive, or transmit and receive. In an embodiment, the antenna array 8600 may be employed as a communication system or radar system, for example.

Figure 8F:
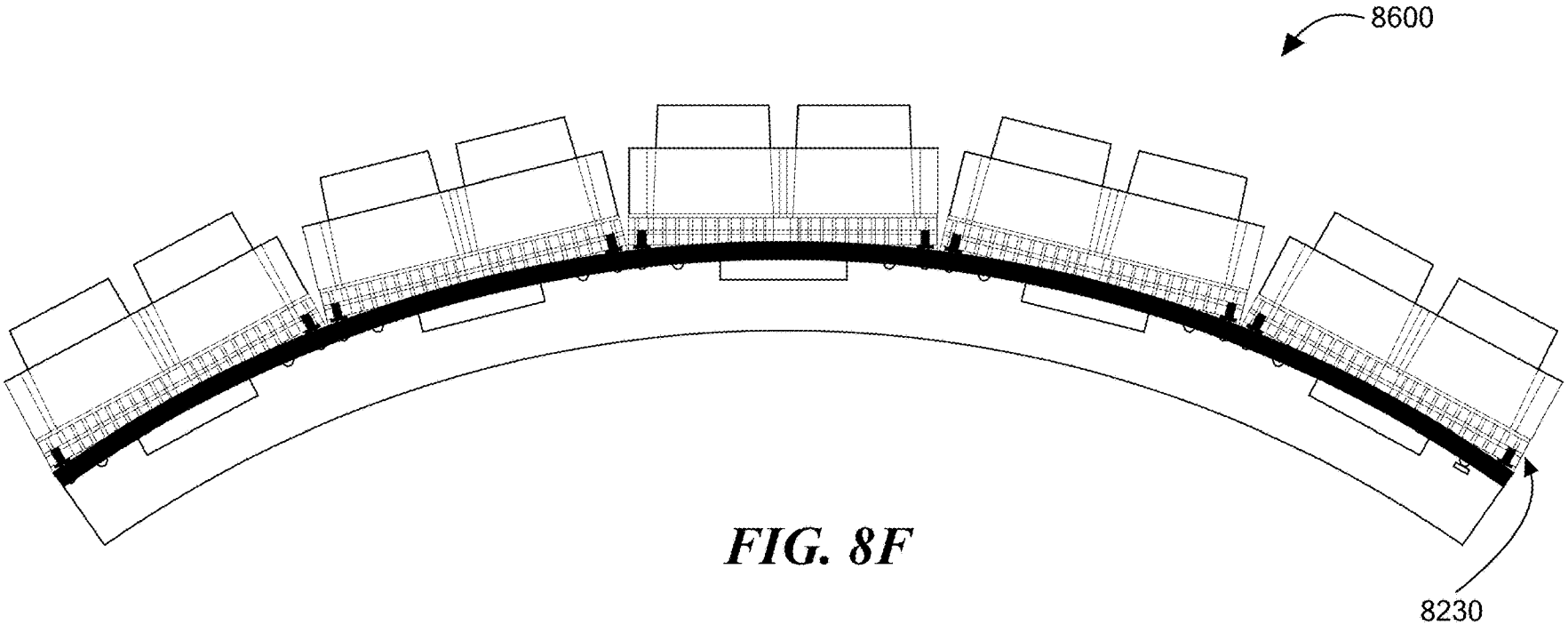
FIG. 8F depicts a transparent elevation view of a tiled non-planar array of the antenna subsystems and the EM beam steering subsystems of FIG. 8A, in accordance with an embodiment.

In an embodiment and as depicted in FIG. 8F, the antenna array 8600 may be arranged on a flexible circuit board 8230, which when appropriately curved may enable beam steering to +/−90 degrees. In an embodiment it is contemplated that only two arrayed panels would be needed to steer an EM beam a full 360 degrees, which would provide a substantial system level cost reduction as compared to existing beam steering antenna arrays.

While embodiments disclosed herein illustrate a representative electromagnetic signal feed as being a slotted aperture signal feed, it will be appreciated that this is for illustration purposes only, and that the scope of the invention encompasses any electromagnetic signal feed suitable for a purpose disclosed herein.

While certain combinations of individual features have been described and illustrated herein, it will be appreciated that these certain combinations of features are for illustration purposes only and that any combination of any of such individual features may be employed in accordance with an embodiment, whether or not such combination is explicitly illustrated, and consistent with the disclosure herein. Any and all such combinations of features as disclosed herein are contemplated herein, are considered to be within the understanding of one skilled in the art when considering the application as a whole, and are considered to be within the scope of the appended claims in a manner that would be understood by one skilled in the art.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. When an element is referred to as being "on" another element, it can be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

In view of all of the foregoing, it will be appreciated that various aspects of an embodiment are disclosed herein, which are in accordance with, but not limited to, at least the following aspects and combinations of aspects.

Aspect 1: An electromagnetic, EM, device, comprising: a three dimensional, 3D, body made from a dielectric material having a proximal end and a distal end; the 3D body having a first region toward the center of the 3D body made from a dielectric material having a first average dielectric constant, the first region extending at least partially to the distal end of the 3D body; and the 3D body having a second region outboard of the first region made from a dielectric material other than air having a second average dielectric constant that is greater than the first average dielectric constant, the second region extending from the proximal end to the distal end of the 3D body.

Aspect 2: The EM device of Aspect 1, wherein: the first region is centrally disposed within the 3D body.

Aspect 3: The EM device of any of Aspects 1 to 2, wherein: the first region comprises air.

Aspect 4: The EM device of any of Aspects 1 to 3, wherein: the first region is a depression in the 3D body, relative to the second region, that extends from the distal end toward the proximal end.

Aspect 5: The EM device of Aspect 4, wherein: the depression extends anywhere between about 30% and about 100% of the distance from the distal end to the proximal end of the 3D body.

Aspect 6: The EM device of any of Aspects 1 to 5, wherein: the 3D body further comprises a third region outboard of the second region made from a dielectric material having a third average dielectric constant that is less than the second average dielectric constant, the third region extending from the proximal end to the distal end of the 3D body.

Aspect 7. The EM device of Aspect 6, wherein: the third region comprises a combination of; a dielectric material having the second average dielectric constant, and another dielectric material.

Aspect 8. The EM device of Aspect 7, wherein: the other dielectric material of the third region is air.

Aspect 9. The EM device of any of Aspects 6 to 8, wherein: the third region comprises projections that extend radially outward from and are integral and monolithic with the second region.

Aspect 10. The EM device of Aspect 9, wherein: each one of the projections has a cross-section overall length, L1, and a cross-section overall width, W1, as observed in an x-y plane cross-section, where L1 and W1 are each less than λ, where λ is an operating wavelength of the EM device when the EM device is electromagnetically excited.

Aspect 11. The EM device of Aspect 10, wherein: L1 and W1 are each less than λ/4.

Aspect 12. The EM device of any of Aspects 9 to 11, wherein: each one of the projections has a cross-section shape, as observed in an x-y plane cross-section, that is tapered radially from broad to narrow.

Aspect 13. The EM device of any of Aspects 1 to 12, further comprising: a fourth region made from a dielectric material other than air having a fourth average dielectric constant; wherein the fourth region substantially surrounds the proximal end of the 3D body and wherein the fourth average dielectric constant is different from the third average dielectric constant.

Aspect 14. The EM device of any of Aspects 6 to 12, further comprising: a fourth region made from a dielectric material other than air having a fourth average dielectric constant; wherein the fourth region substantially surrounds the third region at the proximal end of the 3D body; and wherein the fourth average dielectric constant is different from the third average dielectric constant.

Aspect 15. The EM device of Aspect 14, wherein: the third region comprises a combination of; a dielectric material having the fourth average dielectric constant, and another dielectric material.

Aspect 16. The EM device of any of Aspects 14 to 15, wherein: the third region comprises projections that extend outward from and are integral and monolithic with the fourth region.

Aspect 17. The EM device of Aspect 16, wherein: each one of the projections that are monolithic with the fourth region has a cross-section overall length, L2, and a cross-section overall width, W2, as observed in an x-y plane cross-section, where L2 and W2 are each less than λ, where λ is an operating wavelength of the EM device when the EM device is electromagnetically excited.

Aspect 18. The EM device of Aspect 17, wherein: L2 and W2 are each less than λ/b 4.

Aspect 19. The EM device of any of Aspects 16 to 18, wherein: each one of the projections that are monolithic with the fourth region has a cross-section shape, as observed in an x-y plane cross-section, that is tapered outwardly from broad to narrow.

Aspect 20. The EM device of any of Aspects 14 to 19, wherein: the fourth region is integral and monolithic with the second region and the fourth average dielectric constant is equal to the second average dielectric constant.

Aspect 21. The EM device of Aspect 20, wherein: the third region comprises bridge sections that extend between the second and fourth regions across the third region, the bridge sections being integral and monolithic with both the second and fourth regions.

Aspect 22. The EM device of Aspect 21, wherein: each one of the bridge sections has a cross-section overall length, L3, and a cross-section overall width, W3, as observed in an x-y plane cross-section, where L3 and W3 are each less than λ, where λ is an operating wavelength of the EM device when the EM device is electromagnetically excited.

Aspect 23. The EM device of Aspect 22, wherein: L3 and W3 are each less than λ/4.

Aspect 24. The EM device of any of Aspects 1 to 23, wherein: the second region of the 3D body comprises a textured outer surface having texture features with overall dimensions in any direction that are less than λ, where λ is an operating wavelength of the EM device when the EM device is electromagnetically excited.

Aspect 25. The EM device of any of Aspects 1 to 24, wherein: all exposed surfaces of at least the second region of the 3D body draft inward from the proximal end to the distal end of the 3D body.

Aspect 26. The EM device of any of Aspects 1 to 25, further comprising: a base substrate having a signal feed configured to electromagnetically excite the 3D body to radiate an EM field into the far field; wherein the 3D body is disposed on the base substrate relative to the signal feed such that the 3D body is centrally electromagnetically excited when a particular electrical signal is present on the signal feed.

Aspect 101. An electromagnetic, EM, device, comprising: a three dimensional, 3D, body made from a dielectric material having a proximal end and a distal end; the 3D body having a first portion made from a dielectric material other than air having a first average dielectric constant, the first portion extending from the proximal end and only partially toward the distal end of the 3D body, the first portion forming an inner portion of the 3D body; the 3D body having a second portion made from a dielectric material other than air having a second average dielectric constant that is less than the first average dielectric constant, the second portion extending from the proximal end to the distal end of the 3D body, the second portion forming an outer portion of the 3D body that envelopes the inner portion; the first portion having a first inner region having a third average dielectric constant that is less than the first average dielectric constant; and the second portion having a second inner region having a fourth average dielectric constant that is less than the second average dielectric constant, the second inner region being an extension of the first inner region.

Aspect 102. The EM device of Aspect 101, wherein: the second portion has a frustoconical surface proximate the second inner region.

Aspect 103. The EM device of any of Aspects 101 to 102, wherein: the third average dielectric constant is equal to the fourth average dielectric constant.

Aspect 104. The EM device of any of Aspects 101 to 103, wherein: the first inner region and the second inner region each comprise air.

Aspect 105. The EM device of any of Aspects 101 to 104, wherein: at least one of the first inner region and the second inner region comprises a dielectric material other than air.

Aspect 106. The EM device of any of Aspects 101 to 105, wherein: the third average dielectric constant and the fourth average dielectric constant are both less than each of the first average dielectric constant and the second average dielectric constant.

Aspect 107. The EM device of any of Aspects 101 to 102, wherein: the fourth average dielectric constant is less than the third average dielectric constant.

Aspect 108. The EM device of any of Aspects 101 to 107, wherein: the first portion has an overall height, H1; the second portion has an overall height, H2; and H1 is less than about 70% of H2.

Aspect 109. The EM device of Aspect 108, wherein: H1 is about 50% of H2.

Aspect 110. The EM device of any of Aspects 101 to 109, wherein: the 3D body has axial symmetry about a central z-axis.

Aspect 111. The EM device of any of Aspects 101 to 110, wherein: the first portion and the second portion each have an outer cross-section shape, as observed in an x-y plane cross-section, that is circular.

Aspect 112. The EM device of any of Aspects 101 to 111, wherein: the first portion and the second portion each have an inner cross-section shape, as observed in an x-y plane cross-section, that is circular.

Aspect 113. The EM device of any of Aspects 101 to 112, wherein: the first inner region and the second inner region are each centrally disposed relative to central z-axis.

Aspect 114. The EM device of any of Aspects 101 to 113, wherein: the first portion has an overall outside cross-section dimension, D1, as observed in an x-y plane cross-section; the second portion has an overall outside cross-section dimension, D2, as observed in an x-y plane cross-section; and D1 is less than D2.

Aspect 115. The EM device of Aspect 114, wherein: D1 is less than about 70% of D2.

Aspect 116. The EM device of Aspect 115, wherein: D1 is about 60% of D2.

Aspect 117. The EM device of any of Aspects 101 to 116, wherein: the first average dielectric constant is equal to or greater than 10 and equal to or less than 20; and the second average dielectric constant is equal to or greater than 4 and equal to or less than 9.

Aspect 118. The EM device of any of Aspects 101 to 117, wherein: all exposed surfaces of the 3D body draft inward from the proximal end to the distal end of the 3D body.

Aspect 119. The EM device of any of Aspects 101 to 118, further comprising: a base substrate having a signal feed configured to electromagnetically excite the 3D body to radiate an EM field into the far field; wherein the 3D body is disposed on the base substrate relative to the signal feed such that the 3D body is centrally electromagnetically excited when a particular electrical signal is present on the signal feed.

Aspect 201. The EM device of Aspect 1, wherein: the first region extends from the distal end and only partially toward the proximal end of the 3D body; and second region is subordinate to the first region.

Aspect 202. The EM device of Aspect 201, wherein: the dielectric material of the first region comprises air.

Aspect 203. The EM device of any of Aspects 201 to 202, wherein: the dielectric material of the first region comprises a dielectric material other than air.

Aspect 204. The EM device of any of Aspects 201 to 203, wherein: the first region is a depression formed in the second region.

Aspect 205. The EM device of Aspect 204, wherein: the depression extends anywhere between about 30% and about 90% of the distance from the distal end to the proximal end of the 3D body.

Aspect 206. The EM device of any of Aspects 201 to 205, wherein: the first region has an overall outside cross-section dimension, D1, as observed in an x-y plane cross-section; the second region has an overall outside cross-section dimension, D2, as observed in an x-y plane cross-section; and D1 is less than D2.

Aspect 207. The EM device of Aspect 206, wherein: the second region has an outer cross-section shape, as observed in an x-y plane cross-section, that is circular.

Aspect 208. The EM device of Aspect 207, wherein: the second region has an inner cross-section shape, as observed in an x-y plane cross-section, that is circular.

Aspect 209. The EM device of any of Aspects 206 to 208, wherein: D1 and D2 are corresponding diameters of the first and second regions.

Aspect 210. The EM device of any of Aspects 201 to 209, wherein: the first region has a first cross-section profile, P1A, as observed in an x-z plane cross-section; the first region has a second cross-section profile, P1B, as observed in a y-z plane cross-section; and P1B is different from P1A.

Aspect 211. The EM device of any of Aspects 201 to 209, wherein: the first region has a first cross-section profile, P1A, as observed in an x-z plane cross-section; the first region has a second cross-section profile, P1B, as observed in a y-z plane cross-section; and P1B is the same as P1A.

Aspect 212. The EM device of any of Aspects 201 to 211, wherein: outer sidewalls of the 3D body are vertical, relative to a central z-axis.

Aspect 213. The EM device of any of Aspects 201 to 211, wherein: outer sidewalls of the 3D body are convex, relative to a central z-axis.

Aspect 214. The EM device of any of Aspects 201 to 211, wherein: outer sidewalls of the 3D body are concave, relative to a central z-axis.

Aspect 215. The EM device of any of Aspects 201 to 214, wherein: the second region has a first outer cross-section profile, P2A, as observed in an x-z plane cross-section; the second region has a second outer cross-section profile, P2B, as observed in a y-z plane cross-section; and P2B is the same as P2A.

Aspect 216. The EM device of any of Aspects 201 to 214, wherein: the second region has a first outer cross-section profile, P2A, as observed in an x-z plane cross-section; the second region has a second outer cross-section profile, P2B, as observed in a y-z plane cross-section; and P2B is different from P2A.

Aspect 217. The EM device of any of Aspects 201 to 216, further comprising: a third region made from a dielectric material having a third average dielectric constant, the third region enveloping at least the sides of the 3D body from the proximal end to at least the distal end of the 3D body, the third average dielectric constant being less than the second average dielectric constant and greater than the dielectric constant of air.

Aspect 218. The EM device of Aspect 217, wherein: the third region extends beyond the distal end of the 3D body.

Aspect 219. The EM device of any of Aspects 217 to 218, wherein: the dielectric material of the first region comprises the dielectric material of the third region.

Aspect 220. The EM device of any of Aspects 201 to 219, further comprising: a base substrate having a signal feed configured to electromagnetically excite the 3D body to radiate an EM field into the far field; wherein the 3D body is disposed on the base substrate relative to the signal feed such that the 3D body is centrally electromagnetically excited when a particular electrical signal is present on the signal feed.

Aspect 221. An array of the EM device of any of Aspects 201 to 216 operational at an operating frequency and associated wavelength, wherein: the array comprises a plurality of the EM devices, each EM device of the plurality of EM devices being physically connected to at least one other of the plurality of EM devices via a relatively thin connecting structure to form a connected array, each connecting structure being relatively thin as compared to an overall outside dimension of one of the plurality of EM devices, each connecting structure having a cross sectional overall height, H3, that is less than 20% of an overall height, H4, of a respective connected EM device and being formed from the dielectric material of the second region, each connecting structure and the associated EM device forming a single monolithic portion of the connected array.

Aspect 222. The array of Aspect 221, further comprising: a base substrate, wherein the array is disposed on the base substrate.

Aspect 223. The array of Aspect 222, wherein the connecting structure further comprises: at least one leg that is integrally formed with and monolithic with the connecting structure, the at least one leg extending down from the connecting structure to the base substrate.

Aspect 224. The array of Aspect 223, wherein: the second region comprises a first portion proximate the proximal end of the 3D body; and a second portion proximate the distal end of the 3D body.

Aspect 225. The array of Aspect 224, wherein: the second portion abuts and is in contact with the first portion Aspect 226. The array of Aspect 224, wherein: the second portion is proximate the first portion with a material gap of the second average dielectric constant therebetween.

Aspect 227. The array of any of Aspects 224 to 226, further comprising: a third region made from a dielectric material having a third average dielectric constant, the third region enveloping at least the sides of the 3D body from the proximal to at least the distal end of the 3D body, the third average dielectric constant being less than the second average dielectric constant and greater than the dielectric constant of air.

Aspect 228. The array of Aspect 227, wherein: the third region extends between adjacent ones of the plurality of EM devices of the array.

Aspect 229. The array of any of Aspects 227 to 228, wherein: the third region extends between adjacent ones of the first portion of corresponding ones of the plurality of EM devices of the array; and the third region does not extend between adjacent ones of the second portion of corresponding ones of the plurality of EM devices of the array.

Aspect 230. The array of any of Aspects 227 to 229, wherein: the second portion is proximate the first portion with a material gap of the second average dielectric constant therebetween.

Aspect 231. The array of Aspect 230, wherein: the material gap of the second average dielectric constant comprises air.

Aspect 232. The array of Aspect 230, wherein: the material gap of the second average dielectric constant comprises the dielectric material having the third average dielectric constant.

Aspect 233. The array of any of Aspects 222 to 232, wherein: the base substrate comprises a plurality of signal feeds, each signal feed of the plurality of signal feeds configured to electromagnetically excite a corresponding one of the plurality of EM devices to radiate an EM field into the far field; wherein a given one of the plurality of EM devices is disposed on the base substrate relative to a corresponding signal feed such that the given EM device is centrally electromagnetically excited when a particular electrical signal is present on the corresponding signal feed.

Aspect 301. The EM device of Aspect 1, wherein: the first region extends at least partially to the distal end of the 3D body from a first base structure proximate the proximal end of the 3D body; the second region extends at least partially to the distal end of the 3D body from the proximal end of the 3D body; the 3D body further having a third region outboard of the second region made from a dielectric material having a third average dielectric constant that is less than the second average dielectric constant, the third region extending to the distal end of the 3D body from a second base structure proximate the proximal end of the 3D body; and the 3D body further having a fourth region outboard of the third region made from a dielectric material having a fourth average dielectric constant that is greater than the third average dielectric constant, the fourth region extending to the distal end of the 3D body from the proximal end of the 3D body.

Aspect 302. The EM device of Aspect 301, wherein: the first base structure of the first region has a thickness, H7, and is integrally formed and monolithic with the second region.

Aspect 303. The EM device of Aspect 302, wherein: H7 is equal to or less than 0.015 inches.

Aspect 304. The EM device of any of Aspects 301 to 303, wherein: the first region is centrally disposed with respect to a central z-axis within the 3D body.

Aspect 305. The EM device of any of Aspects 301 to 304, wherein: the third region is a continuum of the first region; and each of the first region and the third region comprises air.

Aspect 306. The EM device of any of Aspects 301 to 305, wherein: the third region is a continuum of the first region; and at least one of the first region and the third region comprises a dielectric material other than air.

Aspect 307. The EM device of Aspect 305, wherein: the third region comprises a dielectric material that is different from the dielectric material of the first region.

Aspect 308. The EM device of Aspect 307, wherein: the dielectric material of the third region has a dielectric constant that is less than the dielectric constant of the dielectric material of the first region.

Aspect 309. The EM device of any of Aspects 301 to 308, wherein: the fourth region is a continuum of the second region such that the second and fourth regions are integrally formed with each other to form a monolithic; and the fourth average dielectric constant is equal to the second average dielectric constant.

Aspect 310. The EM device of any of Aspects 301 to 309, further comprising: a relatively thin connecting structure disposed at the proximal end of the 3D body and being integrally formed with and bridging between the second region and the fourth region, such that the second region, the fourth region, and the relatively thin connecting structure, form a monolithic, the relatively thin connecting structure having an overall height, H5, that is less than 20% of an overall height, H6, of the 3D body.

Aspect 311. The EM device of Aspect 310, wherein: the second base structure has a thickness H8 that is less than H5.

Aspect 312. The EM device of Aspect 311, wherein: H8 is equal to or less than 0.005 inches.

Aspect 313. The EM device of any of Aspects 301 to 312, wherein: the first region is a depression formed in the second region.

Aspect 314. The EM device of Aspect 313, wherein: the depression extends anywhere between about 30% and about 95% of the distance from a distal end of the second region to the proximal end of the 3D body.

Aspect 315. The EM device of any of Aspects 301 to 314, wherein: the second region and the first region have coexisting central z-axes; the third region and the second region have coexisting central z-axes; and the fourth region and the third region have coexisting central z-axes.

Aspect 316. The EM device of any of Aspects 301 to 315, wherein: the second region completely surrounds the first region; the third region completely surrounds the second region; and the fourth region completely surrounds the third region.

Aspect 317. The EM device of any of Aspects 301 to 316, wherein: the second region and the fourth region each have an outer cross-section shape, as observed in an x-y plane cross-section, that is circular.

Aspect 318. The EM device of any of Aspects 301 to 317, wherein: the second region and the fourth region each have an inner cross-section shape, as observed in an x-y plane cross-section, that is circular.

Aspect 319. The EM device of any of Aspects 301 to 318, wherein: all exposed surfaces of at least the second region and the fourth region of the 3D body draft inward from the proximal end toward the distal end of the 3D body.

Aspect 320. The EM device of any of Aspects 301 to 319, further comprising: a base substrate having a signal feed configured to electromagnetically excite the 3D body to radiate an EM field into the far field; wherein the 3D body is disposed on the base substrate relative to the signal feed such that the 3D body is centrally electromagnetically excited when a particular electrical signal is present on the signal feed.

Aspect 321. An array of the EM device of any of Aspects 301 to 319, wherein: the array comprises a plurality of the EM devices disposed on a base substrate; the base substrate comprises a plurality of signal feeds, each signal feed of the plurality of signal feeds being configured to electromagnetically excite a corresponding one of the plurality of EM devices to radiate an EM field into the far field; wherein a given EM device is disposed on the base substrate relative to a corresponding signal feed such the given EM device is centrally electromagnetically excited when a particular electrical signal is present on the corresponding signal feed.

Aspect 401. The EM device of Aspect 1, wherein: the first region extends at least partially to the distal end of the 3D body from a first base structure proximate the proximal end of the 3D body; the second region extends at least partially to the distal end of the 3D body from the proximal end of the 3D body; the 3D body further having a third region outboard of the second region made from a dielectric material having a third average dielectric constant that is less than the second average dielectric constant, the third region extending to the distal end of the 3D body from a second base structure proximate the proximal end of the 3D body; the 3D body further having a fourth region outboard of the third region made from a dielectric material having a fourth average dielectric constant that is greater than the third average dielectric constant, the fourth region extending to the distal end of the 3D body from the proximal end of the 3D body; wherein the second base structure comprises a relatively thin connecting structure, disposed at the proximal end of the 3D body, that is integrally formed with and bridges between the second region and the fourth region, such that the second region, the fourth region, and the relatively thin connecting structure, are integrally formed with each other to form a monolithic, the relatively thin connecting structure having an overall height, H5, that is less than 30% of an overall height, H6, of the 3D body; and wherein the second base structure in the third region is absent dielectric material of the monolithic except for the relatively thin connecting structure.

Aspect 402. The EM device of Aspect 401, wherein: the first base structure of the first region has a thickness, H7, and is integrally formed and monolithic with the second region.

Aspect 403. The EM device of Aspect 402, wherein: H7 is equal to or less than 0.015 inches.

Aspect 404. The EM device of any of Aspects 401 to 403, wherein: the relatively thin connecting structure comprises at least two arms that bridge between the second region and the fourth region.

Aspect 405. The EM device of any of Aspects 401 to 404, wherein: the relatively thin connecting structure has an overall width, W1, that is less than an overall width, W2, of the second region.

Aspect 406. The EM device of any of Aspects 401 to 405, wherein: the first region is centrally disposed with respect to a central z-axis within the 3D body.

Aspect 407. The EM device of any of Aspects 401 to 406, wherein: the third region is a continuum of the first region; and each of the first region and the third region comprises air.

Aspect 408. The EM device of any of Aspects 401 to 407, wherein: the third region is a continuum of the first region; and at least one of the first region and the third region comprises a dielectric material other than air.

Aspect 409. The EM device of Aspect 408, wherein: the third region comprises a dielectric material that is different from the dielectric material of the first region.

Aspect 410. The EM device of Aspect 409, wherein: the dielectric material of the third region has a dielectric constant that is less than the dielectric constant of the dielectric material of the first region.

Aspect 411. The EM device of any of Aspects 401 to 410, wherein: the monolithic has a dielectric constant equal to the second average dielectric constant.

Aspect 412. The EM device of any of Aspects 401 to 411, wherein: the first region is a depression formed in the second region.

Aspect 413. The EM device of Aspect 412, wherein: the depression extends anywhere between about 30% and about 95% of the distance from a distal end of the second region to the proximal end of the 3D body.

Aspect 414. The EM device of any of Aspects 401 to 413, wherein: the second region and the first region have coexisting central z-axes; the third region and the second region have coexisting central z-axes; and the fourth region and the third region have coexisting central z-axes.

Aspect 415. The EM device of any of Aspects 401 to 414, wherein: the second region completely surrounds the first region; the third region completely surrounds the second region; and the fourth region completely surrounds the third region.

Aspect 416. The EM device of any of Aspects 401 to 415, wherein: at least a portion of the second region has a convex outer surface.

Aspect 417. The EM device of any of Aspects 401 to 416, wherein: the second region and the fourth region each have an outer cross-section shape, as observed in an x-y plane cross-section, that is circular.

Aspect 418. The EM device of any of Aspects 401 to 417, wherein: the second region and the fourth region each have an inner cross-section shape, as observed in an x-y plane cross-section, that is circular.

Aspect 419. The EM device of any of Aspects 401 to 418, wherein: all exposed surfaces of at least the second region and the fourth region of the 3D body draft inward from the proximal end toward the distal end of the 3D body.

Aspect 420. The EM device of any of Aspects 401 to 419, further comprising: a base substrate having a signal feed configured to electromagnetically excite the 3D body to radiate an EM field into the far field; wherein the 3D body is disposed on the base substrate relative to the signal feed such that the 3D body is centrally electromagnetically excited when a particular electrical signal is present on the signal feed.

Aspect 421. An array of the EM device of any of Aspects 401 to 419, wherein: the array comprises a plurality of the EM devices disposed on a base substrate; the base substrate comprises a plurality of signal feeds, each signal feed of the plurality of signal feeds being configured to electromagnetically excite a corresponding one of the plurality of EM devices to radiate an EM field into the far field; wherein a given EM device is disposed on the base substrate relative to a corresponding signal feed such the given EM device is centrally electromagnetically excited when a particular electrical signal is present on the corresponding signal feed.

Aspect 501. The EM device of Aspect 1, further comprising: a base substrate comprising a first plurality of vias; wherein the 3D body includes a medium other than air, the proximal end of the 3D body being disposed on the base substrate so that the 3D body at least partially or completely covers the first plurality of vias; wherein the first plurality of vias are at least partially filled with the dielectric material of the 3D body, such that the 3D body and the dielectric material of the first plurality of vias form a monolithic.

Aspect 502. The EM device of Aspect 501, wherein: the 3D body completely covers the first plurality of vias.

Aspect 503. The EM device of any of Aspects 501 to 502, wherein: the first plurality of vias are completely filled with the dielectric material of the 3D body Aspect 504. The EM device of any of Aspects 501 to 503, wherein: the dielectric material of the 3D body is a moldable dielectric material.

Aspect 505. The EM device of any of Aspects 501 to 504, wherein: the base substrate further comprises a second plurality of vias that may be fully covered by the 3D body, partially covered by the 3D body, or fully exposed relative to the 3D body.

Aspect 506. The EM device of Aspect 505, wherein: the second plurality of vias that are fully or partially covered by the 3D body are either; at least partially filled with the dielectric material of the 3D body, or filled with an electrically conductive material; and the second plurality of vias that are fully exposed relative to the 3D body are filled with an electrically conductive material.

Aspect 507. The EM device of any of Aspects 501 to 506, wherein: the base substrate further comprises a signal feed configured to electromagnetically excite the 3D body to radiate an EM field into the far field when a particular electrical signal is present on the signal feed.

Aspect 508. The EM device of Aspect 507, wherein: the 3D body is disposed on the base substrate relative to the signal feed such that the 3D body is centrally electromagnetically excited when a particular electrical signal is present on the signal feed.

Aspect 509. The EM device of any of Aspects 507 to 508, wherein: the signal feed comprises a stripline and a slotted aperture, the slotted aperture being completely covered by the 3D body.

Aspect 510. The EM device of Aspect 509, wherein: the base substrate comprises an electrically conductive lower layer, an electrically conductive upper layer, and at least one dielectric substrate disposed between the lower and upper electrically conductive layers; and the proximal end of the 3D body is disposed on the upper layer.

Aspect 511. The EM device of Aspect 510, wherein the at least one dielectric substrate comprises a first dielectric substrate disposed adjacent an upper surface of the electrically conductive lower layer, and a second dielectric substrate disposed adjacent a lower surface of the electrically conductive upper layer, the base substrate further comprising: a thin film adhesive disposed between and affixed to the first and second dielectric substrates; wherein the stripline is disposed between the thin film adhesive and the second dielectric substrate below and orthogonal to the slotted aperture.

Aspect 512. The EM device of any of Aspects 501 to 511, wherein: the 3D body has a first region toward the center of the 3D body made from a dielectric material having a first average dielectric constant, the first region extending at least partially to the distal end of the 3D body from a first base structure proximate the proximal end of the 3D body; the 3D body has a second region outboard of the first region made from a dielectric material other than air having a second average dielectric constant that is greater than the first average dielectric constant, the second region extending at least partially to the distal end of the 3D body from the proximal end of the 3D body; the 3D body has a third region outboard of the second region made from a dielectric material having a third average dielectric constant that is less than the second average dielectric constant, the third region extending to the distal end of the 3D body from a second base structure proximate the proximal end of the 3D body; the 3D body has a fourth region outboard of the third region made from a dielectric material having a fourth average dielectric constant that is greater than the third average dielectric constant, the fourth region extending to the distal end of the 3D body from the proximal end of the 3D body; wherein the second base structure comprises a relatively thin connecting structure, disposed at the proximal end of the 3D body, that is integrally formed with and bridges between the second region and the fourth region, such that the second region, the fourth region, and the relatively thin connecting structure, are integrally formed with each other to form a portion of the monolithic, the relatively thin connecting structure having an overall height, H5, that is less than 30% of an overall height, H6, of the 3D body; and wherein the second base structure in the third region is absent dielectric material of the monolithic except for the relatively thin connecting structure.

Aspect 513. The EM device of Aspect 512, wherein: the first base structure of the first region has a thickness, H7, and is integrally formed and monolithic with the second region.

Aspect 514. The EM device of Aspect 513, wherein: H7 is equal to or less than 0.015 inches.

Aspect 515. The EM device of any of Aspects 512 to 514, wherein: the slotted aperture is completely covered by the first base structure of the first region and the second region of the 3D body.

Aspect 516. The EM device of any of Aspects 512 to 515, wherein: the relatively thin connecting structure comprises at least two arms that bridge between the second region and the fourth region.

Aspect 517. The EM device of any of Aspects 512 to 516, wherein: the relatively thin connecting structure has an overall width, W1, that is less than an overall width, W2, of the second region.

Aspect 518. The EM device of any of Aspects 501 to 517, wherein: the 3D body is anchored to the base substrate by way of the first plurality of vias.

Aspect 519. The EM device of any of Aspects 501 to 518, wherein: the first plurality of vias comprises: a first pair of diametrically opposed vias having an overall width dimension, D3, as observed in an x-y plane cross-section; a second pair of diametrically opposed vias having an overall width dimension, D4, as observed in an x-y plane cross-section; and a third pair of diametrically opposed vias having an overall width dimension, D5, as observed in an x-y plane cross-section.

Aspect 520. The EM device of Aspect 519, wherein: D4 is less than D3; and D5 is equal to D4.

Aspect 521. The EM device of any of Aspects 519 to 520, wherein: dimensions D3, D4, and D5, are diameter dimensions.

Aspect 522. The EM device of any of Aspects 501 to 521, further comprising: an electromagnetically reflective structure comprising an electrically conductive structure and an electrically conductive electromagnetic reflector that is integrally formed with or is in electrical communication with the electrically conductive structure; wherein the electromagnetically reflective structure is disposed on or is in electrical communication with the upper electrically conductive layer; wherein the electrically conductive electromagnetic reflector forms a wall that defines and at least partially circumscribes a recess; wherein the 3D body is disposed within the recess.

Aspect 523. The EM device of Aspect 522, wherein: the wall of the reflector has a height, H9, that is greater than a height, H10, of the second region.

Aspect 524. The EM device of Aspect 523, wherein: in response to a 40 GHz electrical signal being present on the signal feed, the 3D body radiates an EM field into the far field with the following characteristics: a gain profile that includes a 3 dBi beamwidth of equal to or greater than +/−60-degrees in the E-field direction; a gain profile that includes a 3 dBi beamwidth of equal to or greater than +/−45-degrees in the H-field direction; a gain profile that includes a 6 dBi beamwidth of equal to or greater than +/−90-degrees in the E-field direction; and a gain profile that includes a 6 dBi beamwidth of equal to or greater than +/−60-degrees in the H-field direction.

Aspect 525. The EM device of Aspect 523, wherein: in response to a particular GHz electrical signal being present on the signal feed, the 3D body radiates an EM field into the far field with the following characteristics: a boresight gain of about 4.4 dBi at 36 GHz to about 5.8 dBi at 41 GHz, with a resulting bandwidth greater than 10%.

Aspect 526. The EM device of Aspect 523, wherein: in response to a particular GHz electrical signal being present on the signal feed, the 3D body radiates an EM field into the far field with the following characteristics: a boresight gain of about 4.4 dBi at 36 GHz to about 6 dBi at 46 GHz, with a resulting bandwidth greater than 20%.

Aspect 527. An array of the EM device of any of Aspects 501 to 526, wherein: the array comprises a plurality of the EM devices disposed in a side by side arrangement wherein the base substrate of each EM device is a contiguous extension of a neighboring base substrate to form an aggregate base substrate, wherein each EM device comprises a discrete signal feed relative to an adjacent one of the plurality of EM devices, and wherein each discrete signal feed is configured to electromagnetically excite a corresponding 3D body to radiate an EM field into the far field when a particular electrical signal is present on the associated signal feed.

Aspect 528. A method of making the EM device of any of Aspects 501 to 526, comprising: molding the 3D body onto a topside of the base substrate by injection molding a moldable dielectric medium through the first plurality of vias from an underside of the base substrate; and at least partially curing the dielectric medium.

Aspect 601. An antenna subsystem for a steerable array of EM devices, comprising: a plurality of the EM devices, each EM device of the plurality of EM devices comprising a wide field of view, FOV, dielectric resonator antenna, DRA, arranged on a surface; a subsystem board comprising for each EM device of the plurality of EM devices a signal feed structure; the plurality of EM devices being affixed to the subsystem board.

Aspect 602. The antenna subsystem of Aspect 601, wherein: each of the DRA comprises a 3D body having a first region toward the center of the 3D body made from a dielectric material having a first average dielectric constant, the first region extending to the distal end of the 3D body; and the 3D body has a second region outboard of the first region made from a dielectric material other than air having a second average dielectric constant that is greater than the first average dielectric constant, the second region extending from the proximal end to the distal end of the 3D body.

Aspect 603. The antenna subsystem of Aspect 602, wherein: the plurality of EM devices are arranged in an x-by-y array.

Aspect 604. The antenna subsystem of any of Aspects 602 to 603, wherein: the DRAs are arranged on a two-dimensional, 2D, surface.

Aspect 604. The antenna subsystem of any of Aspects 602 to 603, wherein: the signal feed structure comprises a signal line having a signal input end.

Aspect 605. The antenna subsystem of Aspect 604, wherein: the subsystem board further comprises for each EM device a signal communication path having an input port disposed at one end thereof, the other opposing end of the signal communication path being electrically connected to the signal input end of a corresponding signal feed structure.

Aspect 606. The antenna subsystem of Aspect 605, wherein: each input port of the subsystem board is connectable to an EM beam steering subsystem.

Aspect 607. The antenna subsystem of Aspect 606, further comprising: an EM beam steering subsystem comprising an EM beam steering chip connected to a number of signal communication channels, each signal communication channel associated with the EM beam steering chip having a corresponding output end, the number of signal communication channels and output ends being equal in number to the plurality of EM devices; wherein each output end of a corresponding signal communication channel of the EM beam steering subsystem is connected to a corresponding input port of the subsystem board of the antenna subsystem.

Aspect 608. The antenna subsystem of any of Aspects 602 to 607, wherein: the subsystem board further comprises a plurality of sets of non-conductive vias that extend therethrough, each set of the non-conductive vias being associated with a different one of the plurality of EM devices; each 3D body of a corresponding EM device is made from a dielectric material comprised of a medium other than air, each 3D body having a proximal end and a distal end, the proximal end of each 3D body being disposed on the subsystem board so that each 3D body at least partially or completely covers a corresponding set of the non-conductive vias; and the plurality of sets of non-conductive vias are at least partially filled with the dielectric material of the associated 3D body, such that each 3D body and the dielectric material of the corresponding set of non-conductive at least partially filled vias form a monolithic.

Aspect 609. The antenna subsystem of Aspect 608, wherein: the 3D body completely covers the corresponding set of the non-conductive vias.

Aspect 610. The antenna subsystem of any of Aspects 608 to 609, wherein: the plurality of sets of non-conductive vias are completely filled with the dielectric material of the associated 3D body.

Aspect 611. The antenna subsystem of any of Aspects 608 to 610, wherein: the subsystem board further comprises: an electrically conductive lower layer, an electrically conductive upper layer, a first dielectric substrate disposed adjacent an upper surface of the electrically conductive lower layer, a second dielectric substrate disposed adjacent a lower surface of the electrically conductive upper layer, and a thin film adhesive disposed between and affixed to the first and second dielectric substrates.

Aspect 612. The antenna subsystem of Aspect 611, wherein: the signal feed structure further comprises: a stripline disposed between the thin film adhesive and the second dielectric substrate, the electrically conductive upper layer comprising a slotted aperture disposed over and orthogonal to the corresponding stripline, each stripline having the signal input end, each slotted aperture being completely covered by the 3D body of the corresponding EM device, the proximal end of the 3D body being disposed on the electrically conductive upper layer.

Aspect 613. The antenna subsystem of any of Aspects 611 to 612, wherein: the signal communication path of the subsystem board is disposed between the thin film adhesive and the second dielectric substrate, the signal communication path having the input port disposed at one end thereof, the other opposing end of the signal communication path being electrically connected to the signal input end of a corresponding stripline.

Aspect 614. The antenna subsystem of any of Aspects 611 to 613, wherein: the subsystem board further comprises a first plurality of electrically conductive vias that connect the upper electrically conductive layer to the lower electrically conductive layer, the first plurality of electrically conductive vias being disposed on each side of respective ones of the plurality of signal communication paths.

Aspect 615. The antenna subsystem of any of Aspects 612 to 614, wherein: the substrate board further comprises a second plurality of electrically conductive vias that connect the upper electrically conductive layer to the lower electrically conductive layer, the second plurality of electrically conductive vias being disposed on each side of, and at an end of, respective ones of the striplines.

Aspect 616. The antenna subsystem of any of Aspects 608 to 609, wherein: the plurality of sets of non-conductive vias extend between the lower electrically conductive layer and the upper electrically conductive layer.

Aspect 617. The antenna subsystem of any of Aspects 601 to 616, wherein: the plurality of the EM devices are according to a corresponding EM device of any of Aspects 25, 116, 219, 319, and 419.

Aspect 701. An antenna subsystem for a steerable array of EM devices, comprising: a plurality of the EM devices, each EM device of the plurality of EM devices comprising a wide field of view, FOV, dielectric resonator antenna, DRA, arranged on a surface, each EM device of the plurality of EM devices further comprising a base substrate, each base substrate comprising a signal feed structure disposed in EM signal communication with a corresponding DRA; wherein the base substrate of each EM device is a contiguous extension of a neighboring base substrate to form an aggregate base substrate, the DRAs being affixed to the aggregate base substrate; wherein the aggregate base substrate comprises a plurality of input ports equal in number to the number of DRAs, each input port being electrically connected to a corresponding signal feed structure that is in signal communication with a corresponding DRA; the antenna subsystem providing a structure suitable for an arrangement of the EM devices to any arrangement size formable from multiple ones of the antenna subsystem.

Aspect 702. The antenna subsystem of Aspect 701, wherein: each DRA comprises a 3D body having a first region toward the center of the 3D body made from a dielectric material having a first average dielectric constant, the first region extending to the distal end of the 3D body; and the 3D body has a second region outboard of the first region made from a dielectric material other than air having a second average dielectric constant that is greater than the first average dielectric constant, the second region extending from the proximal end to the distal end of the 3D body.

Aspect 703. The antenna subsystem of any of Aspects 701 to 702, wherein: the plurality of EM devices are arranged in an x-by-y array.

Aspect 704. The antenna subsystem of any of Aspects 701 to 703, wherein: the DRAs are arranged on a two-dimensional, 2D, surface.

Aspect 705. The antenna subsystem of any of Aspects 701 to 704, wherein: each input port of the plurality of input ports of the aggregate base substrate is a solder pad.

Aspect 706. The antenna subsystem of any of Aspects 701 to 705, wherein: the plurality of input ports of the aggregate base substrate are connectable to an EM beam steering subsystem.

Aspect 707. The antenna subsystem of any of Aspects 701 to 706, further comprising: an EM beam steering subsystem comprising an EM beam steering chip connected to a plurality of signal communication channels, each signal communication channel associated with the EM beam steering chip having a corresponding output port; wherein each output port of the EM beam steering subsystem is connected to a corresponding input port of the aggregate base substrate of the antenna subsystem.

Aspect 708. The antenna subsystem of any of Aspects 702 to 707, wherein each base substrate comprises: an electrically conductive lower layer, an electrically conductive upper layer, a first dielectric substrate disposed adjacent an upper surface of the electrically conductive lower layer, and a second dielectric substrate disposed adjacent a lower surface of the electrically conductive upper layer, and a thin film adhesive disposed between and affixed to the first and second dielectric substrates, a stripline disposed between the thin film adhesive and the second dielectric substrate, the electrically conductive upper layer comprising a slotted aperture disposed over and orthogonal to the stripline, each slotted aperture being completely covered by the 3D body of the corresponding EM device, and the proximal end of the 3D body being disposed on the electrically conductive upper layer.

Aspect 709. The antenna subsystem of Aspect 708, wherein: each input port is electrically connected to a corresponding stripline that is in signal communication with an associated slotted aperture disposed underneath the 3D body of a given EM device.

Aspect 710. An antenna array for a steerable array of EM devices comprising a tiled plurality of the antenna subsystem of any of Aspects 701 to 709.

Aspect 711. The antenna array of Aspect 710, wherein the tiled plurality of antenna subsystems is formable to a non-planar configuration.

Aspect 712. The antenna array of Aspect 711, wherein the aggregate base substrate is a flexible circuit board.

Aspect 713. The antenna subsystem of any of Aspects 701 to 712, wherein: the plurality of the EM devices are according to a corresponding EM device of any of Aspects 26, 117, 220, 320, 420, and 520.

The invention claimed is:

1. An electromagnetic, EM, device, comprising:

a three dimensional, 3D, body made from a dielectric material having a proximal end and a distal end;

the 3D body having a first region toward the center of the 3D body made from a dielectric material having a first average dielectric constant, the first region extending at least partially to the distal end of the 3D body; and the 3D body having a second region outboard of the first region made from a dielectric material other than air having a second average dielectric constant that is greater than the first average dielectric constant, the second region extending from the proximal end to the distal end of the 3D body.

2. The EM device of claim 1, wherein:

the first region extends from the distal end and only partially toward the proximal end of the 3D body; and the second region is subordinate to the first region.

3. The EM device of claim 2, wherein:

the dielectric material of the first region comprises air.

4. The EM device of claim 2, wherein:

the dielectric material of the first region comprises a dielectric material other than air.

5. The EM device of claim 2, wherein:

the first region is a depression formed in the second region.

6. The EM device of claim 5, wherein:

the depression extends anywhere between about 30% and about 90% of the distance from the distal end to the proximal end of the 3D body.

7. The EM device of claim 2, wherein:

the first region has an overall outside cross-section dimension, D1, as observed in an x-y plane cross-section;

the second region has an overall outside cross-section dimension, D2, as observed in an x-y plane cross-section; and D1 is less than D2.

8. The EM device of claim 7, wherein:

the second region has an outer cross-section shape, as observed in an x-y plane cross-section, that is circular.

9. The EM device of claim 8, wherein:

the second region has an inner cross-section shape, as observed in an x-y plane cross-section, that is circular.

10. The EM device of claim 7, wherein:

D1 and D2 are corresponding diameters of the first and second regions.

11. The EM device of claim 2, wherein:

the first region has a first cross-section profile, P1A, as observed in an x-z plane cross-section;

the first region has a second cross-section profile, P1B, as observed in a y-z plane cross-section; and P1B is different from P1A.

12. The EM device of claim 2, wherein:

the first region has a first cross-section profile, P1A, as observed in an x-z plane cross-section;

the first region has a second cross-section profile, P1B, as observed in a y-z plane cross-section; and P1B is the same as P1A.

13. The EM device of claim 2, wherein:

outer sidewalls of the 3D body are vertical, relative to a central z-axis.

14. The EM device of claim 2, wherein:

outer sidewalls of the 3D body are convex, relative to a central z-axis.

15. The EM device of claim 2, wherein:

outer sidewalls of the 3D body are concave, relative to a central z-axis.

16. The EM device of claim 2, wherein:

the second region has a first outer cross-section profile, P2A, as observed in an x-z plane cross-section;

the second region has a second outer cross-section profile, P2B, as observed in a y-z plane cross-section; and P2B is the same as P2A.

17. The EM device of claim 2, wherein:

the second region has a first outer cross-section profile, P2A, as observed in an x-z plane cross-section;

the second region has a second outer cross-section profile, P2B, as observed in a y-z plane cross-section; and P2B is different from P2A.

18. The EM device of claim 2, further comprising:

a third region made from a dielectric material having a third average dielectric constant, the third region enveloping at least the sides of the 3D body from the proximal end to at least the distal end of the 3D body, the third average dielectric constant being less than the second average dielectric constant and greater than the dielectric constant of air.

19. The EM device of claim 18, wherein:

the third region extends beyond the distal end of the 3D body.

20. The EM device of claim 18, wherein:

the dielectric material of the first region comprises the dielectric material of the third region.

21. The EM device of claim 2, further comprising:

a base substrate having a signal feed configured to electromagnetically excite the 3D body to radiate an EM field into the far field;

wherein the 3D body is disposed on the base substrate relative to the signal feed such that the 3D body is centrally electromagnetically excited when a particular electrical signal is present on the signal feed.

22. An array of the EM device of claim 2 operational at an operating frequency and associated wavelength, wherein:

the array comprises a plurality of the EM devices, each EM device of the plurality of EM devices being physically connected to at least one other of the plurality of EM devices via a relatively thin connecting structure to form a connected array, each connecting structure being relatively thin as compared to an overall outside dimension of one of the plurality of EM devices, each connecting structure having a cross sectional overall height, H3, that is less than 20% of an overall height, H4, of a respective connected EM device and being formed from the dielectric material of the second region, each connecting structure and the associated EM device forming a single monolithic portion of the connected array.

23. The array of claim 22, further comprising:

a base substrate, wherein the array is disposed on the base substrate.

24. The array of claim 23, wherein the connecting structure further comprises:

at least one leg that is integrally formed with and monolithic with the connecting structure, the at least one leg extending down from the connecting structure to the base substrate.

25. The array of claim 24, wherein:

the second region comprises a first portion proximate the proximal end of the 3D body; and a second portion proximate the distal end of the 3D body.

26. The array of claim 25, wherein:

the second portion abuts and is in contact with the first portion.

27. The array of claim 25, wherein:

the second portion is proximate the first portion with a material gap of the second average dielectric constant therebetween.

28. The array of claim 25, further comprising:

a third region made from a dielectric material having a third average dielectric constant, the third region enveloping at least the sides of the 3D body from the proximal to at least the distal end of the 3D body, the third average dielectric constant being less than the second average dielectric constant and greater than the dielectric constant of air.

29. The array of claim 28, wherein:

the third region extends between adjacent ones of the plurality of EM devices of the array.

30. The array of claim 28, wherein:

the third region extends between adjacent ones of the first portion of corresponding ones of the plurality of EM devices of the array; and the third region does not extend between adjacent ones of the second portion of corresponding ones of the plurality of EM devices of the array.

31. The array of claim 28, wherein:

the second portion is proximate the first portion with a material gap of the second average dielectric constant therebetween.

32. The array of claim 31, wherein:

the material gap of the second average dielectric constant comprises air.

33. The array of claim 31, wherein:

the material gap of the second average dielectric constant comprises the dielectric material having the third average dielectric constant.

34. The array of claim 23, wherein:

the base substrate comprises a plurality of signal feeds, each signal feed of the plurality of signal feeds configured to electromagnetically excite a corresponding one of the plurality of EM devices to radiate an EM field into the far field;

wherein a given one of the plurality of EM devices is disposed on the base substrate relative to a corresponding signal feed such that the given EM device is centrally electromagnetically excited when a particular electrical signal is present on the corresponding signal feed.

* * * * *